US007176373B1

(12) United States Patent
Longo

(10) Patent No.: US 7,176,373 B1
(45) Date of Patent: Feb. 13, 2007

(54) INTERACTIVE PERFORMANCE INTERFACE FOR ELECTRONIC SOUND DEVICE

(76) Inventor: Nicholas Longo, 2315 Grant St. #2, Berkeley, CA (US) 94703

( * ) Notice: Subject to any disclaimer, the term of this patent is extended or adjusted under 35 U.S.C. 154(b) by 527 days.

(21) Appl. No.: 10/723,889

(22) Filed: Nov. 26, 2003

Related U.S. Application Data

(63) Continuation-in-part of application No. 10/117,239, filed on Apr. 5, 2002, now abandoned.

(51) Int. Cl.
*G10H 1/00* (2006.01)
*G10H 3/00* (2006.01)

(52) U.S. Cl. ..... 84/626; 84/600; 84/622; 84/659; 84/662

(58) Field of Classification Search ..... None
See application file for complete search history.

(56) References Cited

U.S. PATENT DOCUMENTS

| | | | | |
|---|---|---|---|---|
| 4,211,141 | A | 7/1980 | Jensen et al. | |
| 4,332,183 | A | 6/1982 | Deutsch | |
| 4,524,668 | A | 6/1985 | Tomisawa et al. | |
| 4,726,276 | A | 2/1988 | Katoh et al. | |
| 5,160,799 | A | 11/1992 | Tozuka et al. | |
| 5,216,189 | A | 6/1993 | Kato | |
| 5,241,126 | A | 8/1993 | Usa et al. | |
| 5,247,131 | A | 9/1993 | Okamoto et al. | |
| 5,260,570 | A | 11/1993 | Hagino et al. | |
| 5,610,353 | A | 3/1997 | Hagino | |
| 5,648,630 | A | 7/1997 | Van der Voort | |
| 5,726,374 | A | 3/1998 | Van der Voort | |
| 5,827,989 | A | 10/1998 | Fay et al. | |
| 5,922,982 | A | 7/1999 | Ishibashi | |
| 6,018,118 | A | 1/2000 | Smith et al. | |
| 6,087,578 | A | 7/2000 | Kay | |
| 6,316,710 | B1 | 11/2001 | Lindemann | |
| RE37,654 | E | 4/2002 | Longo | |
| 6,407,326 | B1 | 6/2002 | Kondo | |
| 6,924,425 | B2 * | 8/2005 | Naples et al. | 84/609 |
| 2002/0056358 | A1 * | 5/2002 | Ludwig | 84/738 |
| 2002/0162445 | A1 * | 11/2002 | Naples et al. | 84/610 |
| 2006/0090632 | A1 * | 5/2006 | Ludwig | 84/645 |

OTHER PUBLICATIONS

Marcelo M. Wanderly, Norbert Schnell, Joseph Rovan, ESCHER—Modeling and Performing Composed Instruments in real-time Proceedings of the 1998 IEEE International Conference on Systems, Man and Cybernetics (SMC'98), pp. 1080-1084, 1998.
Yamaha Corporation of America, WX7 Wind Controller Manual.
Mathew Wright, David Wessel, Adrian Freed, New Musical Control Structures from Standard Gestural Controllers, Proceedings of the International Computer Music Conference, 1997.

(Continued)

*Primary Examiner*—Marlon Fletcher

(57) ABSTRACT

An Interactive Performance Interface for use with an audio system uses at least one performance mode to provide access to control rate and audio rate signals activated by interaction rate signals synthesized by interactive control envelopes. Audio signals, control rate signals, interactive envelopes and performance modes are all selectable and may be user-activated with user controls that change function according to a hierarchy of conditional latches.

30 Claims, 35 Drawing Sheets

OTHER PUBLICATIONS

Camille Goudeseune, Composing with Parameters for Synthetic Instruments, PhD Thesis, University of Illinois at Urbana-Champagne, 2001.
Alex G.E. Mulder, PhD thesis, Simon Fraser University, Burnaby BC, Canada. 1998.
Andy Hunt, Marcelo M. Wanderly, Ross Kirk, Towards a Model for Instrumental Mapping in Expert Musical Interaction, Proceedings of the International Computer Music Conference, 2000.
Nicola Orio, Norbert Schnell, Marcelo M. Wanderley, Input Devices for Musical Expression, Borrowing Tools from HCI, NIME Conference, Seattle, WA, Apr. 2001.
Joseph Paradiso, Oberheim 4 Voice MIDI Interface User's Manual, 1991.
Joseph Butch Rovan, Marcelo M. Wanderley, Shlomo Dubnov and Philippe Depalle, Instrumental Gestural Mapping Strategies as Expressivity Determinants in Computer Music Performance, Proceedings of the AIMI International Workshop,A. Camurri, ed. Genoa: Associazione di Informatica Musicale Italiana, Oct. 3-4, 1997, pp. 68-73.
Zoltan Janosy, Matti Karjalainen, Vesa Valimaki, Intelligent Synthesis Control with Applications to a Physical Model of the Acoustic Guitar, Proceedings of the International Computer Music Conference 1994.
Tim Anderson, Debbie Horn, Using Hyper-Instruments for the re-distribution of the performance control interface, Proceedings fo the Interantional Computer Music Conference, 1994.
Peter Desain and Henkjan Honing, Towards Algorithmic Descriptions of Continuous Modulations of Musical Parameters, Proceedings of the International Music Conference, 1995.
Perry R. Cook, A Hierarchical System for Controlling Synthesis by Physical Modeling, Proceedings of the International Computer Music Conference, 1995.

* cited by examiner

FIGURE 6A

AND GATE 211

```
Public Function AndGate(ByVal Left As Boolean, ByVal Right As Boolean) As Boolean

 If Left And Right Then
  AndGate = True
 End If

End Function
```

FIGURE 6B

TRANSPARENT LATCH 212

```
Public Function TransLatch(In1 As Boolean, In2 As Boolean) As Boolean
 Static Trans As Boolean

 Trans = Not AndGate(Not (AndGate(In1, Not (In2))), _
        Not (AndGate(Not (AndGate(In1, In2)), Trans)))
 TransLatch = Trans

End Function
```

FIGURE 6C

EDGE TRIGGERED LATCH 213

```
Public Function Latch(In1 As Boolean, In2 As Boolean) As Boolean
 Static Latched, Transed As Boolean

 Latched = AndGate(Not (AndGate(Not (In1), Transed)), _
        Not (AndGate(Not (AndGate(Not (In1), _
        Not (AndGate(Not (AndGate(In1, In2)), Transed)))), Not (Latched))))
 Transed = TransLatch(In1, In2)
 Latch = Latched

End Function
```

FIGURE 8A

FLIP FLOP 218

```
Public Attack As Boolean

Function FlipFlop(Note, Op as Boolean)

   If Not Note and Op and Attack Then Attack = False
   If Not Op and Not Attack then Attack = True

   Debug.Print Attack
End Function
```

FIGURE 8B

SEQUENTIAL LATCH 216

```
Public Attack As Boolean

Function SeqLatch(Note, Op as Boolean)
Static Gate as Boolean

   If Gate And Op Then Attack = True
   If Not Op Then Attack = False
   If Note And Not Op Then Gate = True
   If Not Note Then Gate = False

   Debug.Print Attack
End Function
```

SIMPLE
LATCH 215

```
Public Function AttRel1(Note As Boolean, Op As Boolean) As Boolean
Static AttackLeft as Boolean

    If Note And Op And Not AttackLeft Then
        AttackLeft = True
    End If

    If Not Note And Not Op And AttackLeft Then
        AttackLeft = False
    End If

    AttRel1 = AttackLeft

End Function
```

FIGURE 10A

```
Public AttackLeft, AttackRight As Boolean

Public Function AttRel1(Note As Boolean, Op As Boolean) As Boolean
Static AttRel1 as Boolean

    If Note And Not Op Then
      AttackLeft = True
    End If

    If Not Note And Not Op Then
      AttackLeft = False
    End If

    AttRel1 = AttackLeft

End Function
```

FIGURE 10B

```
Public AttackLeft, AttackRight As Boolean

Function AttRel2(Note As Boolean, Op As Boolean)

    If Note And Not Op And Not AttackRight Then
      AttackLeft = True
    End If

    If Note And Op And Not AttackLeft Then
      AttackRight = True
    End If

    If Not Note And Op Then
      AttackRight = False
    End If

    If Not Note And Not Op Then
      AttackLeft = False
    End If

    Debug.Print AttackLeft
    Debug.Print AttackRight

End Function
```

FIGURE 11A

```
Public AttackLeft, as Boolean

Function AttRel8(Note As Boolean, Op As Boolean)
Static Gate1, Gate2 as Boolean

    If Note And Not Op And Gate1 Then
      AttackLeft = True
    End If
    If Not Note And Op And Not Gate1 Then
      AttackLeft = False
    End If
    If Not Note And Not Op And Not AttackLeft Then
      Gate1 = True
    End If
    If Not Note And Not Op And AttackLeft Then
      Gate1 = False
    End If
    Debug.Print AttackLeft

End Function
```

Attack Latch 210

FIGURE 11B

```
Public AttackLeft, AttackRight as Boolean

Function AttRel5(Note As Boolean, Op As Boolean)
Static Gate1, Gate2 as Boolean

    If Note And Not Op And Not AttackRight Then
      AttackLeft = True
      Gate1 = False
    End If
    If Note And Op And Not AttackLeft Then
      AttackRight = True
      Gate2 = False
    End If
    If Not Note And Op Then
      Gate2 = True
    End If
    If Not Note And Not Op Then
      Gate1 = True
    End If
    If Not Note And Not Op And Gate2 Then
      AttackRight = False
    End If
    If Not Note And Op And Gate1 Then
      AttackLeft = False
    End If
    Debug.Print AttackLeft
    Debug.Print AttackRight
End Function
```

FIGURE 15

```
Public AttackLeft, AttackRight As Boolean

Function AttRel4(Note As Boolean, Op As Boolean)

If Note And Op And Not AttackRight Then
   AttackLeft = True
End If

If Note And Not Op And Not AttackLeft Then
   AttackRight = True
End If

If Not Note And Not Op Then
   AttackLeft = False
End If

If Not Note And Op Then
   AttackRight = False
End If

Debug.Print Attack Left
Debug.Print Attack Right

End Function
```

FORWARD ATTACK LATCH 310

FIGURE 16A

```
Public AttackLeft as Boolean

Public Function AttRel7(Note As Boolean, Op As Boolean) As Boolean
Static Gate1, Gate2 as Boolean

    If Note And Op And Gate2 Then
      AttackLeft = True
    End If
    If Not Note And Not Op And Not Gate2 Then
      AttackLeft = False
    End If
    If Not Note And Op Then
      Gate2 = False
    End If
    If Note And Not Op Then
      Gate2 = True
    End If
    Debug.Print AttackLeft

End Function
```

FIGURE 16B

```
Public AttackLeft, AttackRight as Boolean

Function AttRel6(Note As Boolean, Op As Boolean)
Static Gate1, Gate2 as Boolean

    If Note And Op And Gate2 Then
      AttackLeft = True
    End If
    If Note And Not Op And Gate1 Then
      AttackRight = True
    End If
    If Note And Op And Not AttackLeft Then
      Gate1 = True
    End If
    If Note And Not Op And Not AttackRight Then
      Gate2 = True
    End If
    If Not Note And Not Op And Not Gate2 Then
      AttackLeft = False
      Gate1 = False
    End If
    If Not Note And Op And Not Gate1 Then
      AttackRight = False
      Gate2 = False
    End If
    Debug.Print AttackLeft
    Debug.Print AttackRight

End Function
```

FIGURE 17

```
Public Attack as Boolean

Function AttackRelease(Note as Boolean, Op as Boolean)
Static Gate1, Gate2 as Boolean

        If Gate2 = True and Op = False Then
            Attack = False
            Gate2 = False
        End If

        If Attack = True and Note = False Then Gate2 = True

        If Gate1 = True And Op = True Then
            Attack = True
            Gate1 = False
        End If

        If Attack = False and Note = True Then Gate1 = True

        Debug.Print Attack

End Function
```

FORWARD ATTACK LATCH 310

FIGURE 18

```
Public Function AttackD(Note As Boolean, Op As Boolean) As Boolean
Static Gate1, Gate2, Gate3 as Boolean

    If Gate3 And Op Then
      AttackD = True
      Gate3 = False
    End If

    If Gate2 And Note Then
      Gate3 = True
      Gate2 = False
    End If

    If Gate1 And Not Op Then
      AttackD = False
      Gate2 = True
      Gate1 = False
    End If

    If Not Note And Op Then
      Gate1 = True
    End If

    If Not Note And Not Op Then
      Gate2 = True
    End If

End Function
```

FORWARD ATTACK LATCH 310

FIGURE 19

```
Public AttackLeft, AttackRight as Boolean

Function AttackOn(Note As Boolean, Op As Boolean)
Static  Gate1, Gate2, Gate3, Gate4 as Boolean

        If Gate4 = True And Op = False Then
           AttackRight = False
           Gate4 = False
        End If

        If Gate3 = True And Op = False Then
           AttackLeft = False
           Gate3 = False
        End If

        If AttackRight = True And Note = False Then
           Gate4 = True
        End If

        If AttackLeft = True And Note = False Then
           Gate3 = True
        End If

        If Gate2 = True And Op = False Then
           AttackRight = True
           Gate1 = False
           Gate2 = False
        End If

        If Gate1 = True And Op = True Then
            AttackLeft = True
           Gate1 = False
           Gate2 = False
        End If

        If AttackRight = False And AttackLeft = False And Note = True Then
           Gate1 = True
           Gate2 = True
        End If

        If AttackLeft = False And AttackRight = False And Note = True Then
           Gate1 = True
           Gate2 = True
        End If

        Debug.Print AttackLeft
        Debug.Print AttackRight

End Function
```

FIGURE 20

```
Public AttackLeft, AttackRight as Boolean

Function BiAttackD(Note As Boolean, Op As Boolean)
Static Gate1, Gate2, Gate3, Gate4  as Boolean

        If Gate3 And Op Then
           AttackLeft = True
           Gate3 = False
        End If

        If Gate4 And Not Op Then
           AttackRight = True
           Gate4 = False
        End If

        If Gate2 And Op Then
           AttackRight = False
           Gate2 = False
           Gate1 = True
        End If

        If Gate1 And Not Op Then
           AttackLeft = False
           Gate2 = True
           Gate1 = False
        End If

        If Gate2 And Note Then
           Gate3 = True
           Gate2 = False
        End If

        If Gate1 And Note Then
           Gate4 = True
           Gate1 = False
        End If

        If Not Note And Op Then
           Gate1 = True
           Gate4 = False
        End If

        If Not Note And Not Op Then
           Gate2 = True
           Gate3 = False
        End If

        Debug.Print AttackLeft
        Debug.Print AttackRight

End Function
```

FIGURE 23A

```
Public Note, Op, Attack As Boolean
Public Count As Integer

Function CountLatch(Note, Op)

If Note = 0 And Op = 0 And Count = 0 Then Count = 1
If Note = 1 And Op = 0 And Count = 1 Then
   Count = 2
   Attack = 1
End If

If Note = 0 And Op = 0 And Count = 2 Then Count = 1
If Note = 0 And Op = 1 And Count = 1 Then
   Count = 0
   Attack = 0
End If

Debug.Print Attack
End Function
```

FIGURE 23B

```
Public NoteLast, OpLast, Attack As Boolean
Public NoteTime, OpTime As Variant

Function TimeLatch(Note As Boolean, Op As Boolean)

If Note <> NoteLast Then NoteTime = Time()
If Op <> OpLast Then OpTime = Time()

If Note And Op Then
   If OpTime > NoteTime Then Attack = True
End If

If Not Note And Not Op Then
   If OpTime > NoteTime Then Attack = False
End If

NoteLast = Note
OpLast = Op

Debug.Print Attack
End Function
```

INTERACTIVE PERFORMANCE INTERFACE FOR ELECTRONIC SOUND DEVICE

FIELD OF THE INVENTION

This application is a Continuation in Part of application Ser. No. 10/117,239 filed Apr. 5, 2002, now abandoned, all parts of which are herein incorporated by reference. The present invention relates generally to the field of electronic musical instruments and to the problem of user interaction with electronic sound production devices. It may be implemented as an interactive audio system or provide a performance layer for existing audio systems and may include the Gesture Synthesis methods disclosed in U.S. Pat. No. 6,066,794 to Longo (2000) and Reissue Patent RE37,654 Longo (2002) of which all parts of both are herein incorporated by reference. This application also relates to Disclosure Document No. 472287, received in the United States Patent and Trademark Office on May 10, 2000, and Disclosure Document No. 479794, received in the United States Patent and Trademark Office on Sep. 15, 2000.

BACKGROUND OF THE INVENTION

Many kinds of interfaces have been designed to allow a user to interact with sound production circuitry. Some are mechanical devices built to resemble traditional musical instruments such as a guitar or saxophone. Others are unique to electronic instruments, and have all manner of fanciful constructions. User interfaces include circuitry to generate electronic signals called control signals, responsive to user interaction gestures. Additional circuitry generates electrical signals that produce sound responsive to these control signals. Control signals include discrete events and continuously varying streams of data.

The continuous data is referred to as "control rate data". Control rate data is commonly generated responsive to continuous user interaction gestures including for example, manipulation of control operators such as wheels and joysticks, the generated control rate data representing displacement of such operators. Control rate data may also be generated automatically responsive to a discrete user interaction gesture such as depression of a key. Further, control rate data may be generated by processing functions responsive to input control rate data.

In the present invention a control rate data is any stream of data that has a frequency of vibration that is below that which may be perceived as an audio tone. The frequency may be determined using the period of a control rate signal, as represented by the start point and end point, or by inflection points of a user gesture, or by zero crossing points of a repeating wave form. In general, control rate signals operate in the same frequency range as human gestures.

This data may be generated only when it changes value, or at a constant sample rate determined by a clock. Thus the functions described herein may be called in response to data representing a change from previously received data, or at a constant clock rate. When control rate data is sampled from physical controllers, a clock rate higher than the rate of change of the data must be used to obtain useful accuracy. The sample rate of control rate signals is usually in the range 20–10,000 samples per second, but may be higher or lower. The periodic frequency of audio tones is in about the same range as the sampling rate of control rate signals. This is significant because control rate signals are typically used to vary the pitch, volume or timbre of audio tones. Pitch is related to the periodic frequency of zero crossing points of an audio wave form. Volume is related to the peak amplitude of an audio wave form. Timbre is related to inflection points or wave shape of an audio wave form, and may also involve other aspects of a tone, including noise content, changes over time, and salient characteristics. So each data point of a control rate signal corresponds roughly to a single wave form of an audio tone. Control rate signals may have a higher sample rate, such as those generally used to represent audio rate data. However, the rate at which control rate data changes value is so much lower than that of audio rate data, that such high sampling rates are generally considered to be wasteful of computer processing power. P In addition to continuous control rate data, discrete data values representing user interaction gestures are generally used to represent "notes". The term note as used herein refers to any audio signal, including signals having primarily noise or varying pitch content, as well as typical musical note audio signals having perceivable discrete pitch content. The wide availability of MIDI based audio equipment has made it commonplace for piano style keyboards and other interfaces designed to facilitate playing of musical tones, to be used to play sounds of any description.

User interaction gestures representing selection of audio signals by, for example, depressing the keys of a piano style keyboard are referred to herein as note selections. Note selections may also be used to determine the value of one parameter of an audio signal. For example, MIDI note numbers selected with a piano style keyboard typically represent a selected pitch of an audio signal having perceivable discrete pitch content.

Thus in the present invention, note selections refer to discrete selections made by user interaction gestures that intersect a fixed location on a continuous line or plane. Examples are striking the keys on a piano style keyboard, or selecting a position along a fretboard or continuous membrane. Such a selection may be seen as the endpoint of a continuous user gesture that is activated perpendicular to the line or plane. Such note selections occur at what is defined here as "interaction rate" and generate "interaction rate data". Interaction rate data occurs at roughly the same rate as zero crossing, peak amplitudes, or inflection points of control rate signals. So in the present invention, interaction rate data may also be generated responsive to continuous user interaction gestures such as manipulation of a wheel or lever, when crossing position, velocity, or acceleration thresholds, by starting, stopping or changing direction of motion, or by intersection with a time threshold. All gestures performed by a user to interact with an electronic audio system may thus generate and be represented by interaction rate data.

In the present invention, additional interaction rate data may be synthesized by processing functions, such as counting, multiplexing, indexing, and combining interaction rate data using logic operations. Advantageously, logic functions referred to as latches may be used to store results of previous processing of interaction rate data in order to create interaction rate data hierarchies that represent the hierarchical decision process a musician uses to creates musical phrases and melodies. This hierarchical interaction rate data, generated by a hierarchy of conditional latches encoded in the interface electronics, provides a means of changing the roles played by the physical devices used to interact with the sound production circuitry. This reflects the way a musician temporarily changes the position and/or orientation of arms, hands and fingers in order to interact with an instrument in different ways.

The user interaction gestures a musician employs to play music may be separated into "selection gestures", "activation gestures" and "modulation gestures". For example a note is selected on a violin using one hand, and then the note is activated using the other. In the present invention, the action of bowing may be represented by interaction rate event data for start, change of direction and stop points, and by control rate signals connecting these points, representing velocity or position of the bow. Once the note is activated, additional notes may be both selected and activated by performing selection gestures with the fingerboard.

Typical modulation gestures include vibrato, portamento slides, and other pitch variations, as well as subtle variations in volume and/or timbre of a sounding note. Modulation gestures may likewise be represented by interaction rate event data and connecting control rate data.

In general, selection gestures refer to note selection and activation gestures refer to note activation. Modulation gestures refer to modification of activated notes. However, each of these three types may also be subdivided into selection, activation and modulation gestures. That is, just as notes are selected, activated and modulated, gestures are also selected, activated, and modified, each of which gesture may be represented by interaction rate data.

For example, notes may be activated on a guitar by picking with an up or down stroke, or by bowing or striking a string. So an activation gesture itself is selected using a gesture that positions the hand to perform the selected gesture. Then the activation gesture is itself activated, which activates the note.

There may also be more than one type of note selection gesture. Notes may be selected on a guitar by fingering a string, or by releasing a string leaving the string open, or by fingering and then bending a string prior to activation. Note selection also consists of three parameters, representing three ranges of pitch resolution, which may be selected separately. These are base note selection (open string), note increment selection (fret), and fine note selection (bend) all of which may be done prior to activation. Each of these three ranges of pitch selections may be made separately or together, before or after activation of a note. Volume and timbre may also be selected and varied in similar ranges.

Some of the many types of modulation gestures have been mentioned. However, sometimes a gesture is not so easily classified. For example, after a note is activated, a new note may be selected by hammering on a new fret or fingerboard position. This is a selection gesture that is also a modulation gesture of a sounding note. In a sense, it is also an activation gesture, since the action of hammering the string down on a fret produces perturbations of the sound that are distinguishable aurally as a characteristic of a new note activation. The new note selected by a hammer-on gesture may then be activated anew with a picking gesture, which is a commonly used technique.

So there is a blurring of the distinction between selection, modulation, and activation gestures. Each gesture may serve more than one purpose, each of which is a contributing factor to the listener's perception of its meaning within a musical context. Gestures may blend one into another. This is not just sloppy musicianship. It is intentional and very effective for creating continuity within a musical "phrase". A musical phrase may thus be represented by a series of interaction rate event data representing user selection, activation and modulation gestures, each of which may overlap to create a sense of continuity.

The MIDI data protocol is a widely accepted standard specification for representing interaction rate data typically generated by playing notes on a piano-style keyboard, known as note-ons and note-offs. The MIDI specification also specifies continuous control rate data that represents manipulating simple operators such as joysticks, wheels and levers.

When playing a keyboard based MIDI synthesizer, as when playing a piano, notes are selected by a transverse gesture along the keyboard and activated by a motion perpendicular to the selected key. However MIDI note-on data consists of a single packet that represents simultaneous selection and activation of notes. That is, both selection and activation events are combined into a MIDI note-on event. In the present invention a number of advantages are obtained by separating note selection and activation.

Some MIDI wind controllers, such as a Yamaha WX7 internally specify separate selection and activation data, used to generate MIDI note-on and note-off data. Similarly, guitar controllers may also use separate selection and activation data and also channelization of the strings, so gestures may be performed separately for each note activated by each string. Janosy, ICMC 1994, specifies separating MIDI note selection and activation data for the purpose of simulating guitar playing on a piano style keyboard. Janosy also specifies a chord mode channel for playing chords selected by one finger, and also a kind of solo mode for playing lines, that includes recognition of modulation gestures. Further, Janosy identifies a number of typical gesture types used in guitar playing.

However the above prior art instruments fails to specify means of selecting and activating gestures, or significantly, for blending gestures to create phrases. They also fail to recognize that notes may be advantageously channelized according to activation gesture or modulation gesture, as well as selection gesture, or that these represent performance modes that may themselves be selected and activated by the user. Thus, advantages may be obtained by separating selection and activation of notes, gestures and performance modes, and by making these selections and activations available to the user via an Interactive Performance Interface, as will be seen presently.

Besides the problem of MIDI note-ons and note-offs, it is a well-known limitation of MIDI that continuous control rate data generated by specified control operators modulates all sounding notes at the same time. This is rarely the case in a real musical performance, and generally makes for uninteresting sounding music. A new standard called ZIPI was developed, but not commercialized, which is based on the model of an orchestra rather than a piano style keyboard. It specifies that control rate data may be directed to individual notes so that each note may be modulated separately. However for an individual musician to modulate each note separately and distinctly from other notes, he or she must perform separate modulation gestures for each note, a difficult if not impossible task for polyphonic music. Otherwise, an entire orchestra of musicians is required, each playing a separate electronic instrument playing and modulating one note of a polyphonic ZIPI synthesizer.

One enhancement to the MIDI specification that addresses this limitation is called "Polyphonic Aftertouch". This provides a type of MIDI control rate data that is applied to each note individually. It is designed so that pressure pads under each note of a piano style keyboard may be used to modulate that note discretely. However, this arrangement requires that each modulation gesture be started after a note is activated and resolved before the note is deactivated, which only occasionally occurs in traditional music performance.

Besides that, modulation gestures cannot be applied selectively to groups of notes, or across a sequence of notes using Polyphonic Aftertouch.

Another enhancement to MIDI is called MONO mode. This allows for only one note at a time to sound. If a second note is played before releasing the previous note, the second note continues the first note with only a change in pitch. However, new notes played this way in MONO mode simply start a new notes without the attack portion of the pre-programmed control envelope. If a note is played after all previous notes have been released, the new note is re-attacked. Such an arrangement is ineffective for creating realistic or varied transitions between notes.

This problem is partially addressed in U.S. Pat. No. 5,216,189, to Kato (1993), which specifies selectable preset curves which can be used to create note transitions. Unfortunately this requires a fingering scheme commonly known as "fingered portamento" or "fingered legato" that requires that a note be held down while additional notes are selected in order to effect simulated note transitions. This requirement is awkward at best and does not allow for lateral displacement of the hand along the keyboard, which is a staple piano keyboard playing technique.

In U.S. Pat. No. 6,316,710, Lindemann, a variety of pre-composed audio files are provided that may be activated to create realistic sounding note transitions. Lindemann also provides a "sound segment sequencer", that processes user interaction gestures and makes decisions about what audio file to play. Unfortunately, Lindemann only provides the example similar to the fingered portamento scheme described above, wherein a MIDI style note-on signal such as from a wind controller be maintained in order to create slur transitions. The above examples fail to recognize the importance of different performance modes for interacting with electronic instruments, as represented by different hierarchies of selection, activation and modulation gestures, including selection, activation and possibly modulation gestures for the performance modes themselves. This is because these inventions fail to account for the role different modes of operation of arms, hands and fingers play in a musical performance.

In contrast to the prior art, the inventor has discovered that a flexible, easy to use performance interface for an audio system can be implemented by electronically modeling the decisions and actions a musician makes in performance. This discovery stems from the inventor's previous discovery that audio synthesis systems work by mirroring perceptual modes used to hear and process audio signals. Which insight can be extended to physical devices such as loudspeakers that mirror human ears, and control devices that mirror human limbs. The inventor further extended this theory to include the simulation of muscle activation required when interacting with a musical instrument, which was the subject of U.S. Pat. No. 6,066,794, Longo. In the present invention, the inventor further extends the analogy of reflection to include the operation of joints and limbs via decisions a musician-user makes, to create a flexible performance interface.

Traditional musical instruments necessarily reflect the modes of movement of the human body. But the interface of an acoustic instrument is limited because it must support an internally resonant acoustical system. This is why acoustical instruments usually take years to learn to play well. For example, a guitar fretboard is arranged so a musician's fingers may be positioned transversely across the strings, in order to select chord voicings. The musician's hand can also be rotated, so the fingers fall longitudinally in succession along the frets of a single string. These are two performance modes for a guitar. However these gestures are notoriously difficult for a beginning guitarist to perform, because they also require interacting with strings stretched taught in a manner designed to cause the guitar body to resonate.

However performance modes such as those described above can be modeled electronically using circuits that represent the action of the fingers and hand. The decision to use one performance mode or another can also be modeled, and the option to switch from one to another provided to the performer via an electronic performance interface. Because such an electronic interface does not suffer from the limitations imposed by the necessity of manipulating a resonant acoustical system, both the selection of modes and performance actions may be made available to the user via simple operators that are comfortable to use.

Control envelopes are known in the art. They were invented by early audio synthesizer pioneers to represent a series of gestures a musician typically performs to activate, sustain and release a note. In a conventional electronic instrument, control envelopes are triggered together with an audio signal, both responsive to a received note-on event, and then they perform automatic modulations to the audio signal. Control envelopes typically consist of a series of "breakpoints" and "line segments" that connect the breakpoints. Lamentably, automatically generated control envelopes always sound the same. Some prior art instruments specify envelopes for which minor variations can be introduced by several means known in the art, but these are generally limited to a single variation of a single segment of a control envelope.

Control envelopes are sometimes referred to in the art as wave forms. Envelope wave forms generally have a longer period than control rate signals such as low frequency oscillators, which further modulate an audio signal under control of an envelope. Envelope wave forms represent "human actions" consisting of a series of gestures combined to produce a given result. For example, the action of throwing a baseball consists of a combined series of sequential and simultaneous gestures of many joints in the human body, mainly the shoulder, arm, elbow, wrist and hand. Each of the separate gestures have a start point and an end point, each of which may be represented by interaction rate data. These may also be seen as data points of an interaction rate signal representing the human action of throwing a baseball. The breakpoints of a control envelope also occur at interaction rate, and thus may also be thought of as an interaction rate signal.

The breakpoints and line segments of a control envelope also have a hierarchical structure. This structure can be represented by a hierarchical arrangement of conditional latches. In the present invention, the breakpoints and an unlimited number and variety of line segments of control envelopes can be selected, activated and modulated in real time, using a limited number of easily manipulated control operators. This can be accomplished because latches remember the result of combinations of gestures. Once a latch is activated and interaction rate data synthesized, it becomes possible for the same operators used to activate the latch to then perform other functions enabled by the latch. In addition, some operators, such as the keys of a typical piano style keyboard, automatically return to a starting point when released by the user, thus changing the state of the operator. In the present invention, once a latch has been activated, the user may release such an operator, while the latch remembers the result of the previous gesture, thus freeing his or her hand to manipulate other operators.

This gives the musician precise control over continuous control functions usually performed automatically by control envelopes. In addition, the functions of envelopes may be expanded, for example by using Longo's gesture synthesis functions, to generate more interesting sounding control rate interpolations between breakpoints than provided for by conventional envelope line segments. Further, synthesized interaction rate data may be used to activate additional audio rate signals, note sequences and other effects. Such a hierarchical latch activated structure is referred to in the present invention as an "interactive control envelope".

Thus the present invention provides a performance interface architecture for an audio synthesizer. The provided interface can simulate musical decisions as well as the performance actions of musicians using interactive performance modes. It suffers from neither the physical difficulties imposed by the construction of traditional instruments, nor from the narrow performance options provided by prior art electronic interface circuitry. Since the present invention is implemented in the electronic domain, it is ideally flexible for representing the kinds intricate, overlapping musical relationships between notes and gestures found in traditional music. The advantages obtained are empowering for electronic musicians and the musical results that can be achieved are startling.

SUMMARY OF THE INVENTION

Each note played on a conventional electronic musical instrument typically initiates an audio rate signal and at least one automatically performed control signal known in the art as a control envelope. Each control envelope includes a series of interaction rate data points, known as breakpoints. Line segments interpolate between breakpoints at control rate, according to pre-selected parameters. Thus a control envelope is an interaction rate signal which includes a series of interaction rate data points, with interpolation at control rate between them.

Control envelopes are typically activated together with an audio signal and used to vary the audio signal automatically. Envelope line segments are specified in one of two ways, either as a target value representing a break point, plus a time to reach the specified target values or as a target value plus a rate at which the segment will progress toward the specified target value. In addition, line segments may be specified to have a curvature according to a mathematical formula, or according to a table of values which is read out.

As will be shown, it is advantageous to make the series of breakpoint target values and other parameters of a control envelope available for sequential selection and activation by the user via an interactive hierarchy of conditional latches. In the present invention, each breakpoint and line segment of an interaction rate signal is synthesized responsive to user selection and activation gestures. A hierarchical structure that includes conditional latches for synthesizing such an interaction rate signal is referred to as an interactive control envelope. Interactive control envelopes may be used in place of the traditional pre-programmed control envelopes in a tone synthesizer, or may be used to supplement or supersede them at the user's discretion.

Interactive control envelopes may include transitional and embellishing audio signals and note sequences as well as control rate signals. Audio signals may be interpolated from control rate signals, synthesized by conventional wave table or physical modeling methods, played back from stored samples, segments or partials, or by other audio synthesis methods. Additional functions activated by interaction rate data may include pre-recorded or algorithmically generated segments and loops containing audio data, and/or control data. Such additional functions may include arpeggiators or auto-accompaniment, and may involve algorithms based on randomization, fuzzy logic, chaos, set theory and other mathematical data generation methods.

Thus in the present invention, interaction rate signals are advantageously synthesized by interactive control envelopes responsive to user interaction gestures that generate interaction rate data. The interaction rate data may be generated by sequential user actions or combinations of user actions that select and activate latches. Interaction rate signals are acted on and modified by other interaction rate signals. Control rate signals are generated responsive to interaction rate data, and may be acted on and modified by interaction rate signals and also control rate signals. Audio rate signals are generated responsive to interaction rate data and/or control rate data synthesized by interactive control envelopes responsive to user actions. Audio rate signals may themselves be modified by audio rate signals. The resulting combinations of musical effects generated responsive to interaction rate data synthesized by an interactive control envelope as described herein, may be referred to as a musical phrase.

Interactive control envelopes include an "Attack Latch" that synthesizes initial data for an interactive control envelope referred to as "Attack Data". This Attack Data may be used to activate or latch on an audio signal or score sequence that initiates a phrase, initialize audio and control rate signal parameters used to synthesize a phrase, and/or activate a control rate signal that functions as would an Attack segment of a traditional control envelope, except that here, the Attack segment inititiates a phrase. Attack Data may also enable and sometimes select a second Attack Latch that represents a second level in an interactive control envelope hierarchy.

Attack Data may also function within an interactive control envelope to select a "Continuation Latch". One or more Continuation Latches may be used to synthesize additional data points of an interaction rate signal, referred to as "Continuation Data", when activated by interaction rate data generated by user interaction gestures. Continuation Data may activate audio signals and control rate signals representing additional segments of a phrase.

For example, a note selection may be used to simulate a guitar hammer-on, so that the pitch of a sounding string changes by the difference between the pitch represented by the note selection and the previous pitch. Then a note deselection may be used to simulate a pull-off to an open string, so the pitch drops to a base pitch, or to a pitch one or two octaves below the selected pitch. Note selections may also be used to simulate gestures such as damping a string by touching it to stop it from sounding before subsequent note activations. Thus interaction rate data generated by note selections and deselections, and also by operator deflection and release, are used to select and synthesize data points of an interaction rate signal representing a phrase.

Object oriented programming environments for developing audio synthesis algorithms are known in the art. It is advantageous to supply such an environment with a number of new objects, including Attack Latches that may be used to build interactive control envelopes according to the present invention. Preferably the user of such a programming environment may select from among a variety of Attack Latches and Continuation Latches that may be presented as graphical screen objects suitable for connection with other screen objects by creating references one to the other, or by connecting them with graphical patch cords.

Other objects that may be included with such a system include interaction rate data generators to be discussed presently, control rate signal generating objects and audio rate signal generating objects responsive to interaction rate data.

A further advantage of the present invention is that more natural sounding control rate line segments may be synthesized than those typically employed by a prior art control envelope, by specifying a target value plus a variable rate of change to progress toward the target, or a variable overall time to reach the target, rather than either a set rate of change or a set overall time. This is because a longer gesture will naturally take longer to reach it's target than a short one, even when the user intends it to happen in a set amount of overall time, as for example, in time to a rhythm. The term "rate of change" herein means rate of change of data values, which is distinguished from the more generic term "rate" which refers to a general range of either sampling rates or rate of change of values of a specified data type, as for example, control rate data. Varying the overall time of gesture to reach a target value, or varying the target value to be reached in a set overall time, both vary the rate of change of the value.

In the present invention, gesture distances may be represented by interval distances between note selections, even when referring to control rate data that modifies other parameters of an audio rate signal than pitch. So the rate of change, or overall time, may be varied according to interval of the gesture, as would be the case for a musician playing gestures on a real instrument. Preferably, the rate of change is varied so the overall time varies responsive to interval distance. To create other effects simulating playing conditions, rate of change may be varied responsive to the position value or velocity of control rate data used to modulate the line segment, or according to velocity or count of interaction rate data.

Additional objects may be provided to the user of an object oriented development environment, that generate control rate data responsive to synthesized interaction rate data from Attack Latches and Continuation Latches. Such objects may be used to generate line segments that interpolate between target values and that have a variable rate of change determined by values input by the user at interaction rate or control rate.

It is a further advantage of the present invention to make a number of "performance modes" available to the user. Each performance mode includes at least one interactive control envelope such as one of those described above, plus the audio signals, sequences and control rate signals specified to be activated by interaction rate data synthesized by the interactive control envelope. Performance modes may be selected by user interaction gestures that activate a latch for the performance mode. Once latched, the user's hands are free to perform additional interaction gestures using the same operators, and/or additional operators, to select and activate additional interactive control envelopes and latches used to activate and control, audio signals, sequences and control rate signals for the performance mode. Four such performance modes and variations of them will now be listed as preferred embodiments of the present invention. Further details and additional variations will be discussed in the following description of the preferred embodiments.

In one embodiment of the invention, referred to as "Line Mode", notes are selected using a note selection device, prior to activation by a separate operator. Notes or note sequences are latched so they may then be modulated using the original note selection device, and also modulated as well as reactivated using the original activating operator. This is accomplished using an Attack Latch implemented as part of an interactive control envelope referred to as a "Line Envelope". Selected notes may be channelized discretely. Notes thus channelized may be harmonized, and control rate and, audio rate signals follow a harmonization scheme. In a variation of this embodiment, all selected notes may be grouped on one channel until activated. Notes are thus channelized according to a user interaction gesture that activates the Attack Latch. Additional selected notes may be grouped on another channel, allowing further activations without deactivating previously activated notes. Fewer channels are required for the latter scheme, but harmonization is limited. In either of these channelization variations, notes may be activated sequentially by a series of activation gestures. Similarly modulation gestures may act on sounding notes simultaneously or sequentially.

In another embodiment of the invention, referred to as "Channel Mode", notes or note sequences are channelized discretely by selection gestures which also activate the notes. Note selections are discretely latched to channels, whereafter modulation gestures may discretely effect channelized notes, according to an interactive control envelope referred to as "Channel Envelope".

Selections may latch when selected according to a first on, first off channelization scheme, or they may latch upon receipt of attack data from the output of an Attack Latch implemented as part of a Channel Envelope. Once a selection is latched, subsequent selections of the same note are activated on the latched channel. This way, modulations may discretely effect a note, whereafter the note may be released during or in between modulations, and then the note reactivated with the effect of the modulation unchanged. This may occur repeatedly until the selection is unlatched. When notes are thus channelized discretely, note modulations may follow a harmonization scheme. In the first on, first off channelization scheme, the selection may be unlatched when all channels are full and an additional note is selected. When a selection is latched according to a Channel Envelope Attack Latch, the selection remains latched until the Attack Latch is deactivated.

In a variation of Channel Mode, multiple notes may be selected and activated on a single channel, until performance of a modulation gesture latches the current selections to that channel according to direction of modulation, whereafter additional notes are activated on a second channel. Notes are thus channelized according to a modulation gesture. Similarly to a variation of Line Mode, fewer channels are required for the latter scheme, but harmonization of notes is limited. In another variation, notes may be discretely channelized as selected, and then selections latched to these channels responsive to a modulation gesture performed with a separate operator, according to direction of modulation. Selections are thus latched according to an Attack Latch similar to that which latches activations in Line Mode.

In a third embodiment of the invention, referred to as "Fingered Mode", the user of a note selection device such as a piano style MIDI keyboard can employ the "fingered legato" playing technique to activate an Attack Latch implemented as part of a "Fingered Envelope" that latches on a note or sequence. In contrast to the prior art, the user doesn't have to hold down a note to remain in Fingered Mode, but can thereafter modulate the note at will using the same note selection device. The Attack Latch is released using a separate series of user gestures, such as selecting the same note twice in succession or deflecting a separate control operator. The Attack Latch may also latch the selection of the original first and/or second note used to activate it, so that reselection of one or both of these notes is required to deactivate the latch.

In a fourth embodiment of the invention, referred to as "Operator Mode", a note or sequence is activated responsive to operation of a sequence of control operators. After activation, modulations may then be performed using the same operators, until a deactivation sequence is performed. Any of the above embodiments may also be implemented as a sub-envelope, which activates and modulate notes and sequences at a lower hierarchical level from the original interactive control envelope used to implement the performance mode. Additional variations of the above embodiments are also possible to implement by recombining their elements, as will be seen presently. In each of the above performance modes, notes are dynamically allocated and latched to selection channels and/or activation channels. Notes are preferably latched according to an interactive control envelope. Dynamic channelization can be implemented using the current MIDI specification, by assigning and latching notes to separate MIDI channels and channelizing control rate signals appropriately.

Other objects and advantages of the invention will be made apparent by the following drawings and description.

BRIEF DESCRIPTION OF THE DRAWINGS

FIGS. 6A, 6B, and 6C show Visual Basic functions that simulate the circuit elements depicted in FIGS. 5A and 5B.

FIGS. 8A and 8B show Visual Basic functions that simulate the circuits in FIGS. 7A, 7B, and 7C.

FIG. 10A shows Visual Basic code for a basic Channel Envelope Forward Attack Latch FIG. 10B shows Visual Basic code for a basic Channel Envelope Forward and Reverse Attack Latch.

FIG. 11A shows a code module for a Channel Envelope Forward Attack Latch

FIG. 11B shows a code module for a Channel Envelope Forward and Reverse Attack Latch.

FIG. 15 shows Visual Basic code for a simple Line Envelope Forward and Reverse Attack Latch FIG. 16A shows Visual Basic code for a Line Envelope Forward Attack Latch.

FIG. 16B shows Visual Basic code module for a Line Envelope Forward and Reverse Attack Latch.

FIG. 17 shows Visual Basic code for a Line Envelope Attack Latch.

FIG. 18 shows alternative Visual Basic code for a Line Envelope Attack Latch.

FIG. 19 shows Visual Basic code for a Line Envelope Forward and Reverse Attack Latch.

FIG. 20 shows alternative Visual Basic code for a Line Envelope Forward and Reverse Attack Latch.

FIG. 23A shows Visual Basic code for a Count Latch.

FIG. 23B shows Visual Basic code for a Time Latch.

DETAILED DESCRIPTION

Figure 1:
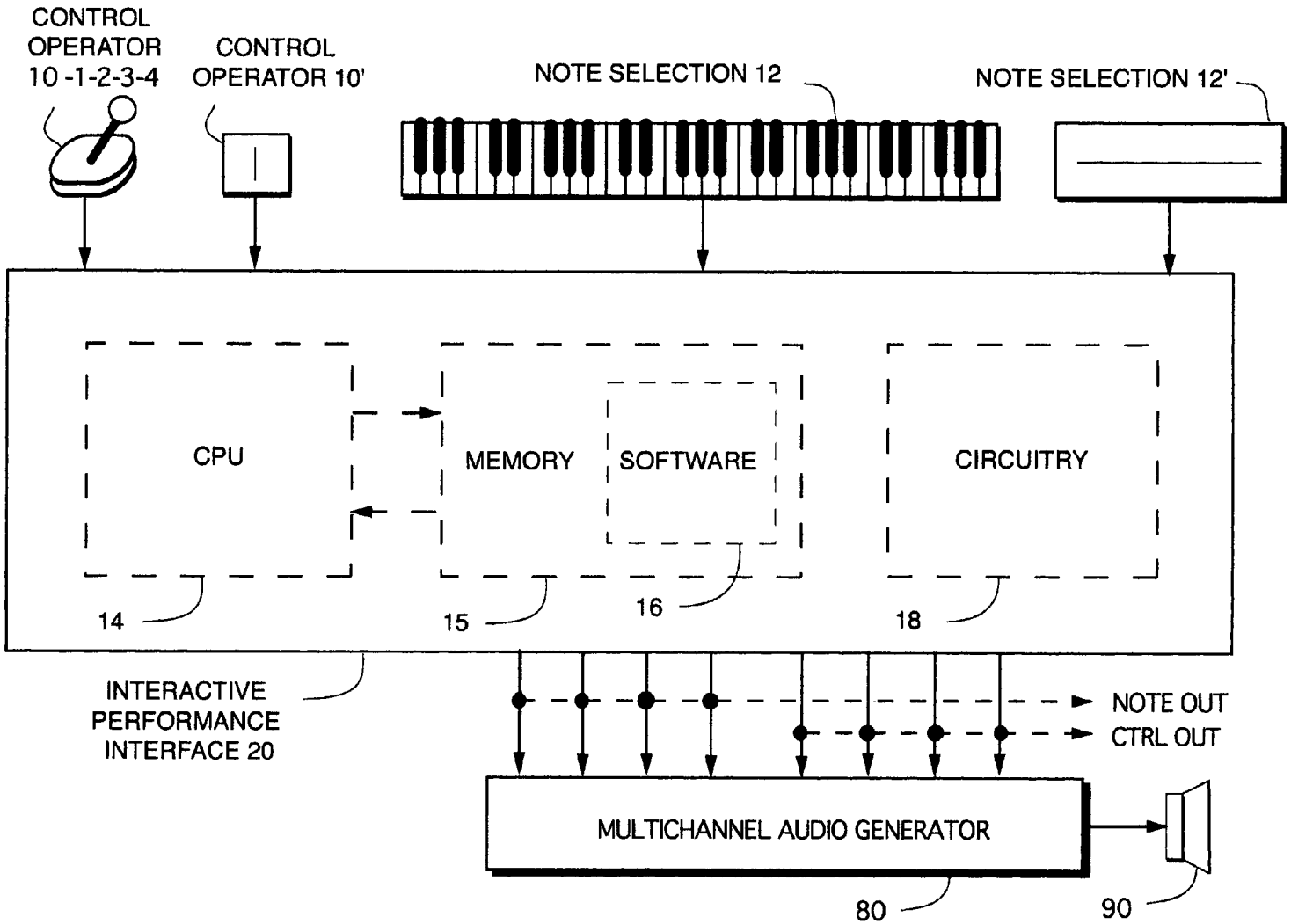
FIG. 1 shows an Interactive Performance Interface with user input devices and audio generator.

FIG. 1 shows an overview of an Interactive Performance Interface, with accompanying user input devices and audio tone generator. Note Selection 12 depicts a piano style keyboard of the sort typically used to simultaneously select and activate notes of a MIDI synthesizer. In the present invention, a musician may use the keyboard only to select a note, or a parameter of a note, such as frequency or pitch. The audio signal that creates the note itself may be subsequently generated responsive to manipulation of a control operator. Alternatively, any electrical or mechanical device which can detect a position selected with a user interaction gesture may be used, represented in FIG. 1 by Note Selection 12'. Selections are usually made by intersecting the selection device with a motion perpendicular to a line or plane. Examples of alternative devices include a continuous pad or membrane, a simulated guitar neck or violin neck, or even a light beam capable of detecting position when a hand passes through it. If the selection device is continuous, as per a control ribbon, the position data may be quantized to a specified resolution. Another device that senses motion or position, and generates continuous control data, may be used to generate a discrete selection signal by stopping motion or by sampling at a given point in time.

Once a note is selected, a continuous device such as Control Operator 10-1-2-3-4 shown in FIG. 1 may be used to activate and/or modify it. Pictured is a four way joystick controller. Alternatively, any device or devices that can generate a continuous control rate signal representing a continuous user gesture, or continuous modulation of applied force by the user, may be used. Such an alternative control operator is represented in FIG. 1 by Control Operator 10'.

Operation of a control operator is specified in terms of motion or pressure along a one dimensional axis. Continuous position, velocity, acceleration or pressure may be detected from which values may be derived. Such motion or pressure has two directions, referred to in the present invention as "deflection" and "release". The pictured joystick is specified as four operators, each of which may be deflected and released by the user. Alternatively, the terms forward and reverse, up and down, left and right, or other terms that describe a user gesture that progresses to an apex and returns to a starting point may be used. A continuous circular gesture may be represented as viewed from the edge, or be described by a sine wave that has positive and negative portions and zero crossing points. Alternatively a jog wheel, computer mouse or trackball type of device that continuously increments one or more parameters of motion may be used to generate continuous control rate data, from which direction data may also be derived.

Interactive Performance Interface 20 may be embodied as a processor or CPU 14, coupled to a Memory 15 that preferably includes random access memory and read only memory, where Software 16 is stored or loadable into Memory 15. As such, Memory 15 is a computer readable medium (without limitation magnetic, storage, optical storage, etc.) that can hold Software 16. Upon execution by processor or CPU 14, Software 16 may carry out at least one of the functions of generating interaction rate event data responsive to user operation of a specified input device or devices, synthesizing an interaction rate signal responsive to the interaction rate event data, and synthesizing control rate signals responsive to the synthesized interaction rate signal.

Alternatively or in addition, any of these functions may be embodied in circuitry 18. Circuitry 18 includes standard electronic components so configured as to carry out one or more of the above functions.

Multichannel Audio Generator 80 outputs audio signals according to the data input from Interactive Performance Interface 20. Multichannel Audio Generator 80 may be a MIDI synthesizer or synthesizers, a multichannel sound card for a personal computer, audio generation circuitry or dedicated DSP processor, including memory storage for use with a CPU such as CPU 14, or other audio signal generation device specified to activate audio signals responsive to data received from Interactive Performance Interface 20. Audio signals are output to Loudspeaker 90 provided for use with Multichannel Audio Generator 80.

Figure 2:
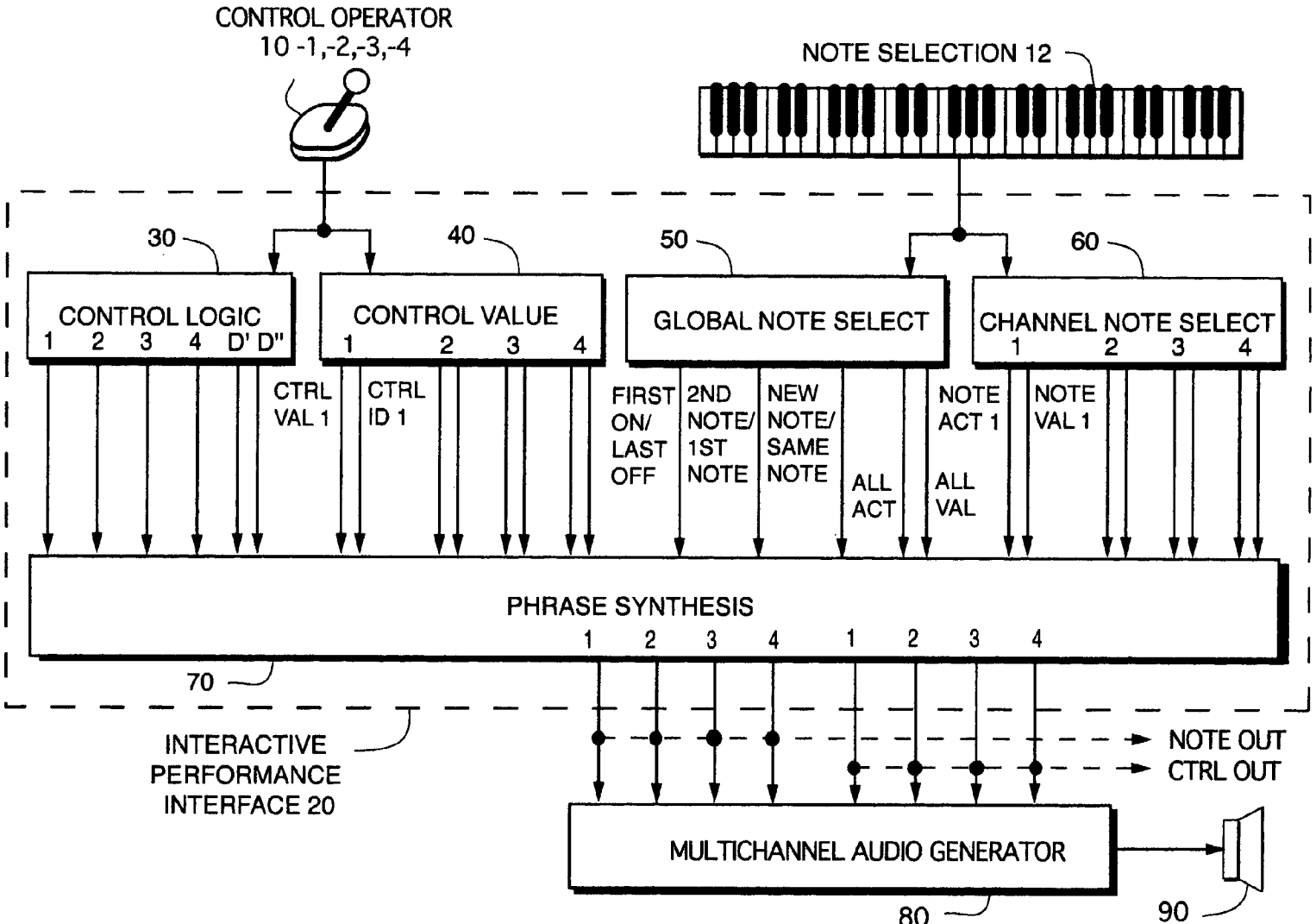
FIG. 2 shows interaction rate event data generators and Phrase Synthesis.

FIG. 2 shows functions for generating and synthesizing interaction rate data and continuous control rate data used to synthesize interaction rate signals and control rate signals in Phrase Synthesis 70. Channel Note Select 60 outputs interaction rate selection data for each note selected with Note Selection 12 on a discrete channel. Selections may then be latched to each channel.

When a note selection is latched to a channel, the selection is output on the same channel each time the same note is reselected. Each selection may latch to a channel automatically until all channels are full, whereupon selections wrap around. Channels may be reused in a cyclically rotating fashion or according to some other selection hierarchy. Advantageously, selections may instead latch to discrete channels responsive to data synthesized by an interactive control envelope. Accordingly, a feedback path may be provided from an interactive control envelope or envelopes to Channel Note Select 60 to cause note selections to latch to a channel. Separate Channel Note Selects may also be provided for each interactive control envelope, so that selections may be latched according to schemes implemented specific to various Performance Modes.

For example, notes may be grouped on a single channel until latched, whereafter notes are grouped on another channel. Or note selections may initially be channelized according to selection as depicted, but then rechannelized according to an interactive control envelope, activated responsive to activation or modulation gestures, prior to being output to Multichannel Tone Generator 80. Or all notes may be input to an implementation of an interactive control envelope and channelized responsive to a count of output latch activations. In general, note selections may be latched to a channel or channels responsive to user selection, activation, or modulation gestures.

It will be appreciated that such dynamic channelization is required because most audio systems known in the art have fewer audio channels than note selections. So note selections must be assigned and reassigned to audio channels according to a channelization scheme. In another embodiment, a note selection device may be subdivided into "split zones" each of which may be treated as a separate note selection device. As such, each such split zone may be assigned to a discrete audio channel. Or each split zone may itself be assigned to several channels, and each split zone require a channelization scheme as discussed above. It will further be appreciated that each note of a note selection device may be discretely mapped to a separate audio channel, so dynamic channelization is not required.

A number representing selected position, or note number for each selection made with Note Selection 12 is output from Channel Note Select 60 to Phrase Synthesis 70. Interaction rate data representing selection and deselection for each channel is also output from Channel Note Select 60 to Phrase Synthesis 70. If a selection is latched to a channel, only reselection of the latched note number will cause selection data to be output.

Global Note Select 50 processes note selections and outputs interaction event data global to all selections regardless of channel. "First On/Last Off" data sends a logical true for a transition from no selected notes to one or more notes selected, and sends a logical false for a transition from one or more notes selected to no notes selected. First On/Last Off data may alternatively be represented by two values, wherein First On sends a selected first note value and then a zero for all notes off, while Last Off sends a note value for the last note deselected and a zero for a first note selection. Similarly, 2nd Note/1st Note data sends a logical True when a second note is selected prior to the first note being released, and sends a logical False for a transition from two notes selected to one note selected. Additional data may be provided for additional note selections, for example, 3rd Note/2nd Note and so on. These data are equivalent to direction dependent thresholds activated by a continuous count of selected or deselected notes.

In Global Note Select 50, "New Note/Same Note" data sends a logical True for a transition from a selected note to a new note and a logical False for a repeat selection of the same note. These may be separated into two values wherein New Note sends a note number for a newly selected note and a zero otherwise, while Same Note likewise sends a note number for a repeated note and a zero otherwise. Additional data may provide threshold activation data for a continuous count of repeat selections of a single note, or repeat selections of new notes.

In Global Note Select 50, All Activate, abbreviated All Act, sends a logical true for each note selected and a logical false for each note deselected. All Value, abbreviated All Val sends a position value for each note selected. This embodiment is a two dimensional representation of a selection gesture, wherein All Value is a discrete number representing a selected note or position along an axis and All Act is logic data representing direction of motion perpendicular to the axis, i.e. select or deselect. Alternatively, one interaction rate data value can be used that sends a discrete number representing both position and selection, with a subsequent zero representing deselection. Alternatively data may be output representing the interval difference of each successive note selection or deselection, along with activation data.

Data output from Global Note Select 50 is input to Phrase Synthesis 70. It will be appreciated that the functions of Channel Note Select 60 and Global Note Select 50 may be integrated into the performance modes themselves. It is convenient for the purposes of illustration and discussion to separate them so their purpose may be more easily understood.

Continuous control rate signals may represent position, and/or velocity, and/or acceleration. Velocity and acceleration data may be derived from position data. Additional processing may be necessary to derive position data along a specified axis or dimension in space. In FIG. 2, Control Value 40 processes position data detected from Control Operator 10-1-2-3-4 and outputs four control rate signals to Phrase Synthesis 70, one for each direction of motion of the depicted joystick. In addition, when each control operator is activated, data identifying the activated operator is sent. Labeled Ctrl ID in the diagram, this data may be used to map parameter selections onto the audio or control rate signal generation functions activated responsive to the control operator.

Continuous control rate data may also be derived from an audio signal for use by the Phrase Synthesis functions. The audio signal may be output from Phrase Synthesis 70, or other source. Control rate data thus derived may be generated by detecting zero crossings, amplitude of periodic audio wave forms, local and maxima and minima and/or inflection points.

Interaction rate event data representing activation, deactivation or change of direction of a control operator, or motion along an axis is also useful in Phrase Synthesis 70. Such data may be used to simulate activation of a string, such as bowing or plucking. The activation data may be a logical 1, representing a logical True for activation and 0 representing logical False for deactivation. Alternatively, a logic data of 1 may indicate motion in one direction and a 0 indicate motion in the opposite direction. Detected pressure or change of direction of motion may generate such data. A single threshold or detected difference between successive position values, may indicate activation and/or direction of motion of a control operator. Two thresholds may be used to separately indicate activation and direction for forward and reverse deflection of a control operator. The endpoint of an operator deflection, an ending threshold of a deflection, an interaction rate time threshold, or detection of zero motion may also generate useful interaction rate event data. It isn't necessary to use the numbers 1 and 0. Any symbols or numbers, such as a plus and minus or positive and negative numbers may be used to indicate forward and reverse direction, or activation and deactivation. A separate symbol or a 0 may be used to represent no motion.

A value representing a peak deflection and release values may be used to indicate manipulation of an operator, and the value also mapped onto audio or control rate signal generation functions. These may be positive and negative values to indicate direction of deflection. Direction data may also be integrated with continuous control rate data, or with dynamic interaction rate data. For example, positive number values representing velocity, position or pressure may indicate deflection, while negative values represent release. These may be continuous control rate values or discrete interaction rate values. For example, a discrete velocity value that also indicates direction, and is mapped onto signal generation functions may be derived from motion of a control operator. Thus, Control Logic 30 in FIG. 2 derives interaction rate data from physical operators or from continuous control rate data input from Control Operator 10-1-2-3-4 and outputs the interaction rate data to Phrase Synthesis 70. It will be appreciated that the functions of Control Logic 30 and Control Value 40 may be integrated into the performance modes themselves.

Phrase Synthesis 70 outputs interaction rate signals synthesized in Phrase Synthesis 70 and continuous control rate signals, activated by interaction rate signals synthesized in Phrase Synthesis 70. The interaction rate signals and control rate signals may each be used to activate and modulate audio signals and sequences generated by Multichannel Audio Generator 80.

Figure 3:
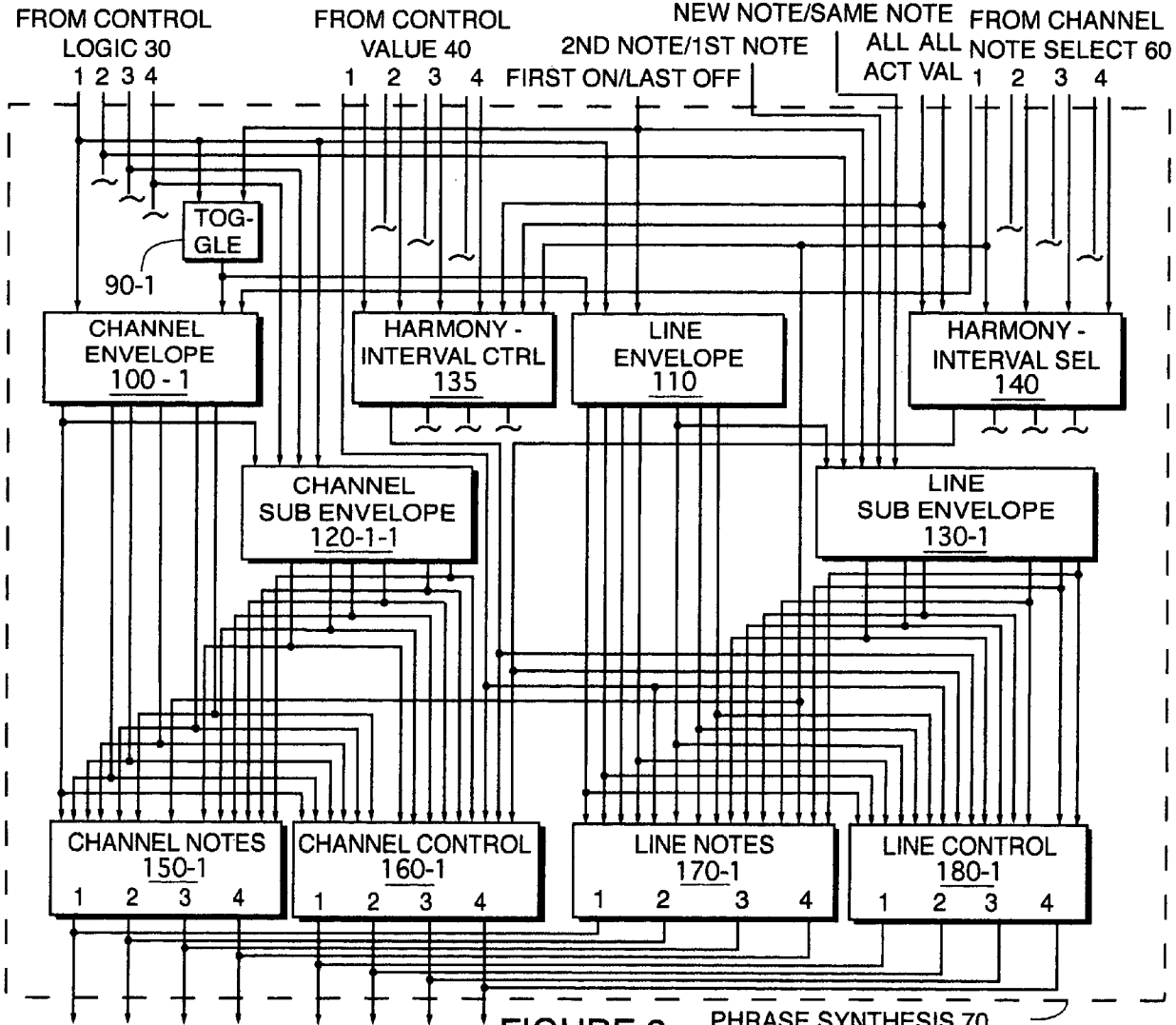
FIG. 3 shows an overview of Phrase Synthesis architecture.

FIG. 3 depicts function blocks representing elements of Phrase Synthesis 70. These elements are arranged according to a logical hierarchy of latches. Each latch synthesizes data responsive to a selection and activation gesture made by the user. The function of a latch is to remember that a sequence of selection and activation gestures were performed. Once set to a logical True, a latch remains True even though the user deselects or releases at least one of the selection device or control operator used to perform the selection and activation gestures. In other words, the logical input conditions that activated the latch may change, but the output remains the same, until a specific set of input conditions are met that deactivate the latch. The advantage is that the user's hands are free to perform other gestures with different operators. This is usefull when operating devices that automatically return to a starting position, such as the keys on a typical MIDI keyboard, or a spring loaded joystick. The user may let go of the device in order to operate another one, while the latch remains activated. In addition once a latch is thus activated, another set of latches are typically enabled, so the same selection device and/or control operator may be then be used for further selection and/or activation gestures.

A latch referred to as an Attack Latch, acts to enable a subset of latches that may be activated by further manipulation of control operators and/or note selection devices once the Attack Latch is activated. The structure made up of an Attack Latch and it's subset of latches are referred to here as an interactive control envelope. The Attack Latch state is True when activated and False when deactivated. The Attack Latch True and False data correspond to the data that start the Attack and Release control data segments of a traditional synthesis control envelope. In addition to activating functions that generate control rate line segments, they may each also be used to activate audio signals, so that different sounds or sequences may be used for the Attack and Release portions of a phrase. In the present embodiment, Channel Envelope 100-1 and Line Envelope 100 are depicted with a Forward Attack Latch and a Reverse Attack Latch, each corresponding to forward and reverse deflection of a control operator used to either select or activate the corresponding latches.

It will be appreciated that this implementation represents a bi-polar utilization of continuous control operators. Interactive control envelopes may also be implemented with a single Attack Latch that is selected or activated by a single direction of motion of a control operator. In the present embodiments, a note selection device is operated to select or activate an Attack Latch in a single direction of motion, the action usually performed to activate a note on a piano-style keyboard. This is a uni-polar representation of note selection gestures. It will be appreciated that implementations utilizing a bi-polar representation of selection gestures is also possible. In the present embodiment, such bi-polar selection gestures are used as continuation gestures, and uni-polar operator deflections are used as decay and damp gestures.

The Attack Latch that activates an interactive control envelope typically selects at least one Continuation Latch that can then be activated to send additional data used for Phrase Synthesis 70. These correspond to starting points for additional segments of a traditional control envelope. They may also be used to activate additional audio signals and sequences. The Attack Latch may also enable a second Attack Latch implemented as part of a Sub-Envelope, that makes up a lower level in a hierarchy of latch circuits. The Sub-Envelope Attack Latch may itself enable another Attack Latch, and so on. Several Sub-Envelopes may be accessible by working through a hierarchy of latches.

An additional Reset, or Clear input may be provided for all latches in the hierarchy so they may all be deactivated by the top level Attack Latch deactivation. A separate Reset button may also be provided to the user for use during performance. These inputs may also be used to initialize an envelope by setting latch outputs to False when a Performance Mode is activated, or when an Attack Latch is activated or deactivated. Additionally, a Preset function may set a latch output to True prior to manipulation of input data.

Two performance modes are depicted in FIG. 3, Line Mode and Channel Mode, alternately enabled by Toggle 90-1. As depicted in Phrase Synthesis 70, Channel Mode includes Channel Envelope 100-1 and Channel Sub-Envelope 100-1-1. Line mode includes Line Envelope 110 and Line Sub-Envelope 110-1. Channel Sub-Envelope 100-1-1 includes an embodiment of Operator Mode as described in the summary above. Line Sub-Envelope 110-1 includes an embodiment of Fingered Mode.

As depicted in FIG. 3, once a user deselects all notes, Toggle 90-1 can be activated by deflecting and releasing Control Operator 10-1 activates Toggle 90-1. Toggle 90-1 may be implemented using a standard J-K Latch circuit with the J and K inputs tied together and controlled by First Note/Last Note data, or a software equivalent thereof. Software equivalents of logic circuit elements will be discussed presently. It will be appreciated that another series of selection and activation gestures may be used to activate Toggle 90-1, or that it's functions may be integrated into the performance modes themselves. Not shown are Toggle 90-2-3-4 which may be provided for activation by Control Operator 10-2, 10-3 and 10-4. These may alternately switch between additional performance modes provided for the user. It will also be appreciated that a conditional toggle circuit may also be implemented as part of an interactive control envelope either as an Attack Latch or an associated latch, with a first input that enables and a second that toggles the latch output True and False as described above.

In a simpler embodiment, a single performance mode may be implemented. Or instead of Toggle 90-1-2-3-4 a hierarchical menu or series of buttons may be provided for the musician to select among a multiplicity of performance modes. However it may be more advantageous to the user to switch performance modes using the selection device and control operators in a similar manner to navigating among interactive control envelopes. Toggle 90-1 is thus advantageously placed at the top of the latch hierarchy.

When Channel Envelope 100-1 is enabled by Toggle 90-1, it's Forward Attack Latch is also selected and may be activated by interaction rate event data Note Act 1, from Channel Note Select 60. Otherwise, Channel Envelope 100-1 is first selected by interaction rate event data Control Logic 1 from Control Logic 30 and then activated by Note Act 1. These selection and activation gestures cause Forward Attack Data or Reverse Attack Data to be synthesized by Channel Envelope 100-1 and sent to Channel Notes 150-1 and Channel Control 160-1. Not shown are Channel Envelopes 100-2-3-4, which are selected and activated by interaction rate event data from Note Act 2, 3 and 4 of Channel Note Select 60. Interaction rate signals synthesized by Channel Envelopes 100-2-3-4 are sent to Channel Notes 150-2-3-4 and Channel Control 160-2-3-4 also not shown.

Note selection values from Channel Note Select 60 may also be sent to Channel Notes 150-1-2-3-4. In a standard MIDI implementation, note selection values from Channel Notes 150 are automatically mapped to the pitch of a generated tone. These selection values may also be mapped to other parameters of control functions, audio generators or score sequences in Phrase Synthesis 70, activated responsive to data from Channel Envelope 100-1.

In the depicted embodiment, audio signals and control rate signals are activated on separate channels by Channel Envelopes 100-1-2-3-4. In an alternative embodiment, audio signals may be activated on one channel by Channel Envelope 100-1 Forward Attack Data and on another channel by Channel Envelope 100-1 Reverse Attack Data. Each of these Attack Data sent to Channel Control 160-1 may also activate a control rate offset constant in addition to, or in place of, a continuous control rate signal, and/or initialize parameters of audio signals activated responsive to Channel Envelope 100-1.

Continuation Latches are enabled and selected within Channel Envelope 100-1 by Forward or Reverse Attack Data. Depicted are Forward and Reverse Select Continuation and Operator Data. This data is synthesized responsive to selection and deselection of notes using Note Selection 12 or deflection and release of Control Operator 10-1. Additional Forward and Reverse Continuation Data may be synthesized responsive to deflection of Operator 10-2-3-4.

Each Continuation Data thus synthesized is sent to Channel Notes 150-1 and Channel Operator 160-1, and each may activate additional audio signals or sequences, as well as continuous control rate signals or control rate offset constants. Likewise, Continuation Data synthesized by Channel Envelopes 100-2-3-4 may be sent to Channel Notes 150-2-3-4 and Channel Control 150-2-3-4.

Channel Sub Envelope 120-1-1 is enabled and selected by Attack Data from Channel Envelope 100-1. Channel Sub Envelope 120-1-1 is thus a lower level in the latch hierarchy. The interaction rate signals synthesized by Channel Sub Envelope 120-1-1 may be used in Phrase Synthesis 70 in place of, or in addition to Channel Envelope 100-1 Continuation Data.

The advantage of this arrangement becomes more evident when more than one control operator used. Channel Sub-Envelope 120-1-1 uses data from Control Operators 10-2-3-4. Not depicted are Channel Sub-Envelopes 120-1-2, 120-1-3 and 120-1-4. Once Channel Envelope 100-1 is activated and latched, operation of each additional Control Operators 10-2-3-4 may activate separate Sub-Envelopes. Once a Sub-Envelope is itself activated and latched, separate Continuation Data may be synthesized using note selections and control operator devices.

There are thus a multiplicity of separate Continuation Data that may be synthesized starting with Channel Envelope 100-1 and progressing to a variety of Sub-Envelopes via different pathways. Each Sub-Envelope synthesizes is own Attack Data and Continuation Data. All the interaction rate signals may be sent to Channel Notes 150-1 and Channel Control 160-1 to be used to activate additional audio or control rate signals. Additional sets of Sub-Envelopes may be implemented to be enabled by each of Channel Envelope 100-2-3-4, and the interaction rate signals synthesized by these sets of Sub-Envelopes sent to Channel Notes 150-2-3-4 and Channel Control 160-2-3-4. Such an arrangement is useful for introducing controllable variations to simultaneously and sequentially activated signals, creating orchestral effects.

It will be appreciated that the functions of all the disclosed interactive control envelopes may be integrated into one large interactive control envelope. They are separated here for the purposes of illustration and discussion so that their operation may be more clearly understood. It will also be appreciated that fewer than four channels or more than four channels may be implemented in Phrase Synthesis 70. Functions of Phrase Synthesis 70 may also be incorporated into those of the interactive control envelopes. For example, latches may be specified to gate audio and control rate signals that are input to the envelope through to one channel or another, according to the same sort of conditional operations described herein for Attack Latches and Continuation Latches.

Line Envelope 110 and Line Sub-Envelope 130-1 work in a similar manner to that described above for Channel Envelope 100-1 and Channel Sub-Envelope 120-1-1. Attack Data and Continuation Data synthesized by Line Envelope 110 and Line Sub-Envelope 130-1 are sent to Line Notes 170-1 and Line Control 180-1 for use in Phrase Synthesis 70.

Attack Data synthesized by Line Envelope 110 may activate as many as all four provided channels of audio and control signals simultaneously, responsive to deflection a control operator, preceded by note selections. Once activated, audio signals may be modulated responsive to Continuation Data synthesized by Line Envelope 110. As depicted, there is one envelope with two sides, corresponding to forward and reverse deflection of the activating control operator. One envelope controls all audio channels, and only one side may be activated at a time. In an alternative embodiment, audio signals may be activated sequentially. This may require a separate Line Envelope for each audio channel. Audio signals thus activated may likewise be deactivated sequentially or simultaneously. Activation of Line Envelope 110 may also channelize parameter selections such as note numbers, to be used by Line Notes 170-1 and Line Control 180-1, and/or channelize signal data generated by functions of Line Notes 170-1 and Line Control 180-1.

As depicted, Channel Envelope 100-1 is implemented so that notes are activated sequentially responsive to note selection together with a pitch offset. The offset wil typically be dependent on deflection of a control operator that is subsequently used to activate a pitch bend function. The purpose of this arrangement is for notes to be activated at the selected pitch even if a control operator has already been deflected and pitch bend signal activated for another note. So one or more notes may be activated and then an operator deflected to activate a pitch bend signal, then additional notes activated without a pitch bend effect. Then the control operator may be released to activate a reverse pitch bend effect for all activate notes. To implement this arrangement, separate Channel Latches are required for each direction of operator deflection. In a limited embodiment, a single Channel Latch may be implemented for only one side so that activation of one side such that after note activations and deflection of the control operator, other notes may be activated as continuations but not bent. Or activation of one side may preclude activation the other, so that if notes are bent either before or after initial deflection of a control operator, no further notes may be bent until the original notes are released. The workings of both Channel Envelopes and Line Envelopes will be discussed in more detail presently.

In the prior art, pitch bend performed by a control operator bends all notes the same amount. However the resulting chord may not fit into the harmonization scheme of the music, resulting in a discordant sound. In the present invention, harmonized pitch bend modulation may be made on several channels simultaneously by deflecting a single control operator, according to a harmonization scheme determined by Harmony-Interval 135. When a pitch bend gesture is activated, Harmony-Interval 135 sets the interval of the pitch bend for each channel by fitting the sounding notes into a flat or a hierarchical harmonization scheme, and determining an appropriate bend interval for each note.

An initial value for the bend interval may be determined using a constant number mapped to a control operator selection, or may be calculated responsive to other data, for example, by taking the difference between successive note selections or deselections. In order to conform the bend to a harmonization scheme, a number representing the pitch of the note prior to the bend must be known, by reference to a note selection or activation. This number may be combined with the accumulated or summed value of any pitch increments, such as previously activated pitch bends, and then combined with the bend interval to obtain a number representing the target pitch of a note. A number for the target pitch is then conformed to a musical scale by referenc to an indexed array representing the scale, and an interval to reach the target pitch is calculated. The target pitch may also be dependent on a hierarchical chord structure that alters the scale array, or selects among different scales. Alternatively, the target pitch may be fit into a chord selected from a reference library. The chord selection may be dependent on other currently or previously activated notes. The target pitch may be further adjusted according to a scale related to the selected referenced chord, or otherwise adjusted by pre-determined or dynamic musical parameters.

Harmony-Interval 135 may also serve to map control data onto other parameters of Phrase Synthesis 70 than pitch. It may be useful to provide a number of such mappings, activated responsive to the interactive control envelopes. This way mappings may change subject to the latch hierarchy. Harmony-Interval 135-1 data is sent to Channel Control 160-1 and Line Control 180-1. Harmony-Interval 135-2-3-4 data, are sent to Channel Control 160-2-3-4 and Line Control 180-2-3-4, not shown in FIG. 3.

The prior art provides for automatic pitch glide from one note to the next in Mono mode or fingered portamento mode. Both of these are limited to one sounding note. In the present invention, two or more channels are provided so that multiple activated notes may glide from one note to the next simultaneously according to individual note selections made with Note Selection 12. Alternatively, automatic pitch glides for several simultaneously sounding notes may be made on one channel at a time, in a cyclic manner. The interval between successive notes is computed by Harmony-Interval 140-1 and interval data sent to Channel Control 160-1 and/or Line Control 180-1 for use in Phrase Synthesis 70. Harmony-Interval 140 operates in a similar manner to Harmony-Interval 135, but maps data from note selections rather than control operators. It will be appreciated that a variety of simulated gestures for moving continuously from one pitch to the next may be provided. For example, these may include a control rate signal for a simulated guitar hammer-on, or an audio rate signal for a valve closing on a wind instrument.

Note deselections may also activate a control rate or audio rate signal such as a simulated pull-off. If many notes are selected simultaneously, pull-off interval data may be calculated as each note is deselected. Each deselection may pull-off to a pitch determined by one of a number of possible embodiments. For instance, a deselected note may pull-off to the pitch of the next most recently selected note, or the nearest in pitch, or the furthest in pitch, or the next most recently selected furthest in pitch, or the inventor's favorite—the nearest in pitch that is the highest or lowest note still held. Or another method may be used to determine the pitch of the pull-off note. When the last note is deselected, the pitch may fall to a constant base note, or a note one or two octaves below the last deselected note. Or deselection of all notes may cause the note to the pitch of the initially activated note, thus simulating a note that has been plucked or bowed, then a series of hammer-ons added and then pulled-off. An appropriate interval for each hammer-on or pull-off is determined according to a scheme implemented in Harmony-Interval 140 or another Harmony-Interval function implemented specifically for calculating deselection intervals.

Additional mapping functions may be provided that are activated by Attack Data synthesized by an interactive control envelope. Still other mappings may be built into audio and control rate signal generation functions themselves, or be activated under control of Continuation Data or other data generated by interactive control envelopes. Thus alternative mapping of both selection data and control operator data, including various harmonization schemes or scaling of interval data, or adding and subtracting offsets may be enabled under control of the latch hierarchy.

An alternative mapping may scale the interval resolution of note selection values generated by Channel Note Select 60 or Global Note Select 50 so successive note selections activate note transitions in fractional pitch amounts. Interval mappings may also be scaled dynamically. That is, data from one source may be mapped variably, responsive to data from another source or a related source. For example, interval distance between note selections may be scaled responsive to position of note selections. Other mapping functions may scale volume and/or timbre changes of activated audio signals in incremental amounts, the increment of which may also be varied in performance. The interval or position values of the note selections may also be mapped to the rate of change parameters of activated gestures, as may velocity data from note selections. Position and/or velocity and/or acceleration of operator deflection and release may also be mapped to parameters of audio signals and/or control rate signals.

The selection and deselection interval data from Harmony-Interval 140-1 is sent to Line Notes 170-1-2-3-4 and Line Notes 180-1-2-3-4 for use in Phrase Synthesis 70. Harmony-Interval 140-2-3-4 data are sent to Channel Control 160-2-3-4 and Line Control 180-2-3-4, also not shown.

Discussion of Simple Latch Circuits

Figure 4:
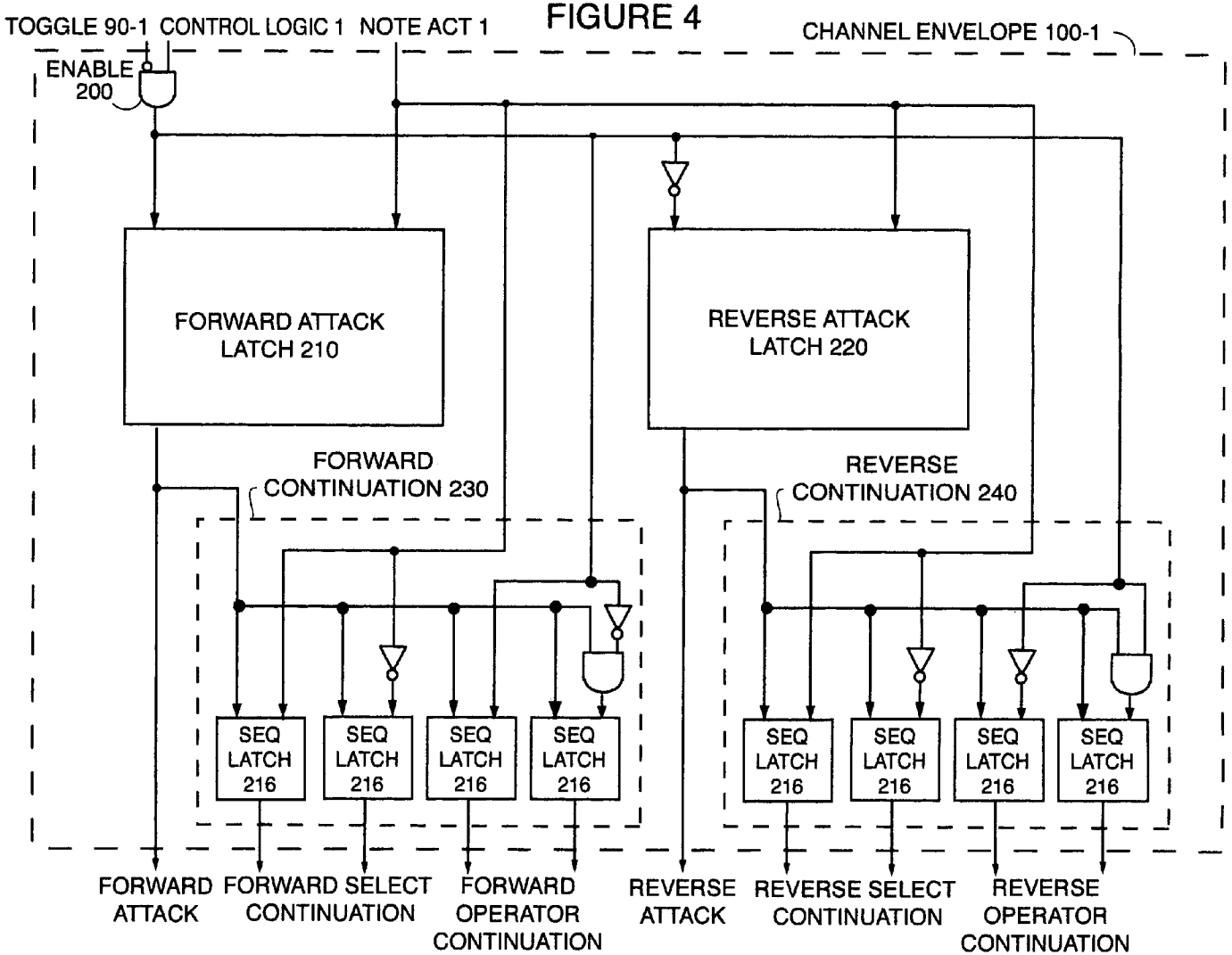
FIG. 4 shows a diagram for a Channel Envelope.

FIG. 4 is a generalized diagram for Channel Envelope 100-1. Depicted are function blocks containing implementations of attack latches and continuation latches. These latches can be implemented as circuits using standard electronic components. These circuits can also be simulated using computer code. Code for each type of circuit element used to implement these latch circuits will be discussed presently. The functions of Channel Envelope 100-1 can also be accomplished using simpler blocks of code using global variables representing input and output state of latches, and static variables representing intermediary states. The workings of example implementations will be discussed in more detail presently. However it may be easier to see how interactive control envelopes function by initially by examining some simple circuit diagrams.

It is helpful to first describe common latch circuits known in the art, and describe how they can be simulated using computer code. Enable 200 shown in FIG. 4 is an "And Gate". It can be represented by simple Boolean logic operations as embodied in the Visual Basic function shown in FIG. 6A. The code in FIG. 6A is referred to as a module or a class object, and may be implemented in other programming languages including C or C++.

Figure 5A:
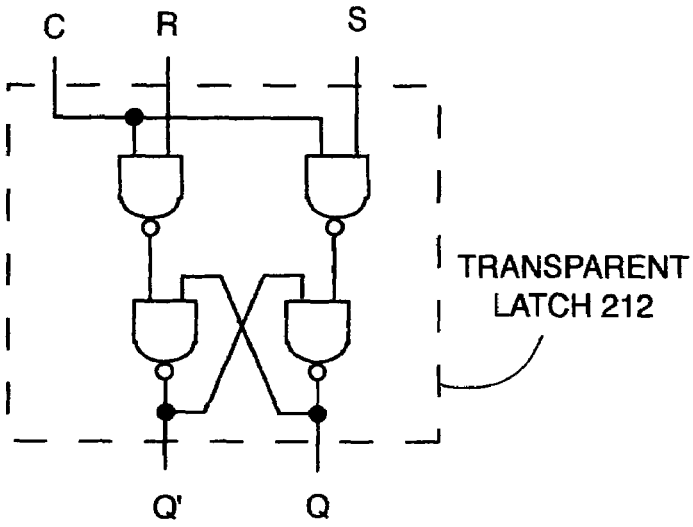
FIG. 5A shows a circuit diagram for a Transparent Latch.

A simple circuit for a Transparent Latch 212 built using Nand Gates is shown in FIG. 5A. This kind of latch is a standard circuit element known in the art. Based on a simple flip flop, it also uses two controlling Nand Gates and has a Set, Reset and Clock input. The Set and Reset inputs may be tied together with the Reset inverted from the Set. Thus with two inputs, SR and Clock, a transparent latch could be used as an Attack Latch in some of the disclosed embodiments. Except that this latch doesn't always change state in response to the same sequence of inputs. It's behavior isn't consistent, which is a necessary property for a user to easily be able to remember and predict the results of a set of actions. It will be appreciated that an equivalent circuit to this, and others to be disclosed presently, may be implemented using alternative circuit elements such as Nor Gates.

FIG. 6B shows a code module containing a function that can be used to simulate Transparent Latch 212. It calls the function in FIG. 6A, while negating the return value, in order to simulate the Nand Gates shown in FIG. 5A.

Figure 5B:
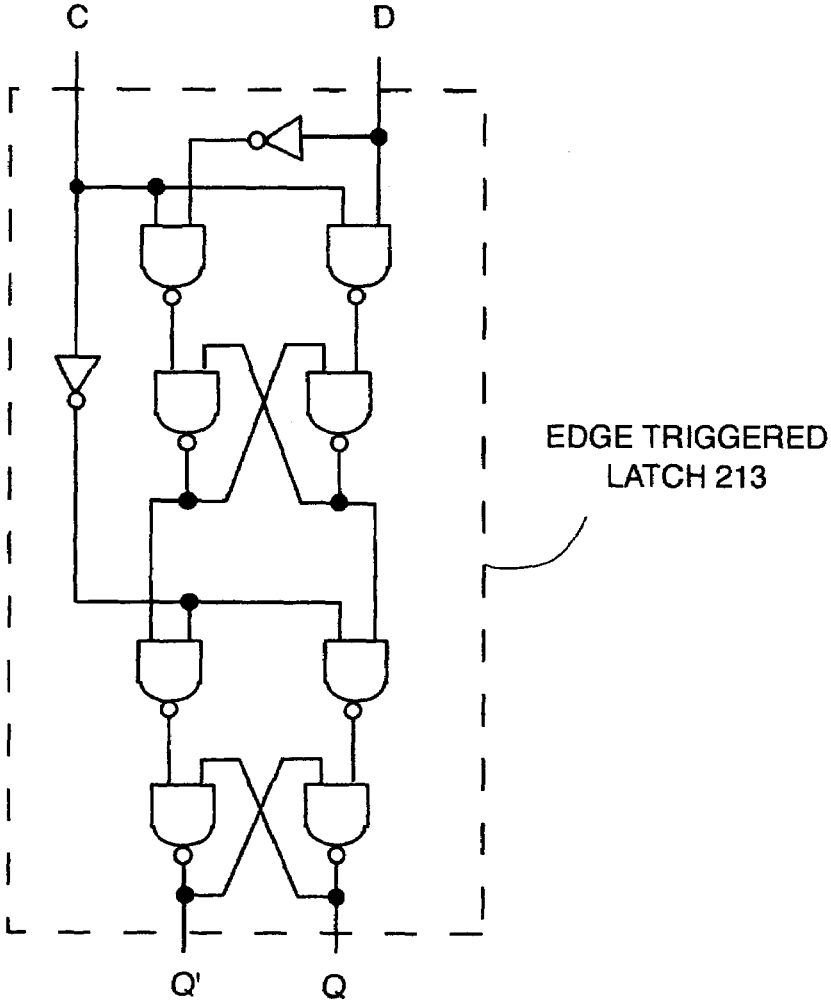
FIG. 5B shows a circuit diagram for an Edge Triggered Latch.

Edge Triggered Latch 213 shown in FIG. 5B is a negative edge triggered type D latch. It has two inputs, D and Clock, and uses two flip flops in a master slave configuration. This latch is also a standard circuit element known in the art. When a pulse is received in the clock input, the state of the D input passes to the output, on the trailing edge of the pulse. So if for example, a logical true at the D input represents a note selection, and a pulse in the Clock input represents an operator deflection, a note activation signal is sent from the output only when a note is selected and then an operator deflected. Similarly, a note deactivation signal is sent only when the note is deselected and the operator deflected again. These properties make this circuit ideal for use as an Attack Latch for an interactive control envelope. For example, it can be used for a variation of the Line Envelope disclosed in the present invention. Alternatively a positive edge triggered 7474 TTL flip flop or JK flip flop may be used to accomplish the same result. An edge triggered latch is particularly useful because it always changes state responsive to the same sequence of inputs. The interactive control envelopes to be disclosed presently use custom designed latch circuits that also have such predictable behavior, but that respond to other sequences of user inputs than standard circuit elements.

FIG. 6C shows a code module containing a function which can be used to simulate the action of Edge Triggered Latch 213. It calls both the functions in FIGS. 6A and 6B. Simulations of the custom circuits in the present invention may be built in a similar way by calling functions that simulate simpler circuits. Three of these simple circuits are shown in FIGS. 7A. 7B and 7C.

Figure 7A:
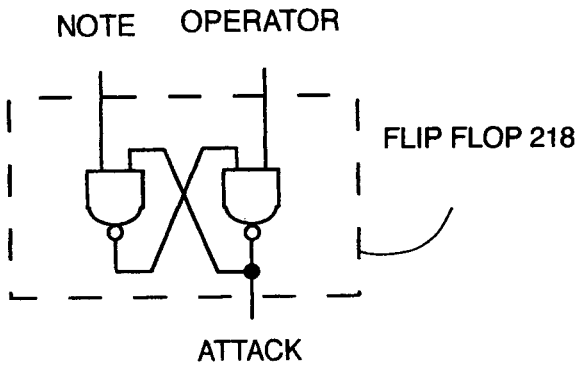
FIGS. 7A, 7B and 7C show circuit diagrams for basic latch circuits.

FIG. 7A shows a circuit for a standard flip flop, Flip Flop 215. This is the simplest of latch circuits built with logic gates. FIG. 8A shows a Visual Basic function that simulates a hardware flip flop. This circuit is important because it has memory. There are two stable states, but the current state is a function of the previous state of the inputs. Because the advantage provided by the present invention is that it remembers the sequence of gestures a user makes, flip flops are the essential element of latch circuits disclosed in the present invention. This circuit and the code function that simulates it's operation can be used to build custom latch circuits.

Figure 7B:
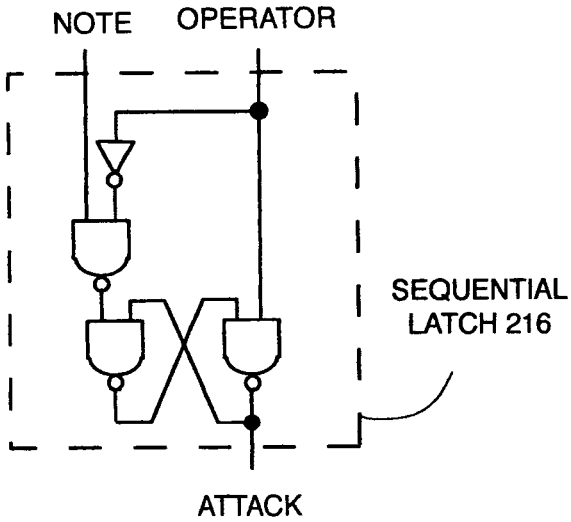
Figure 7C:
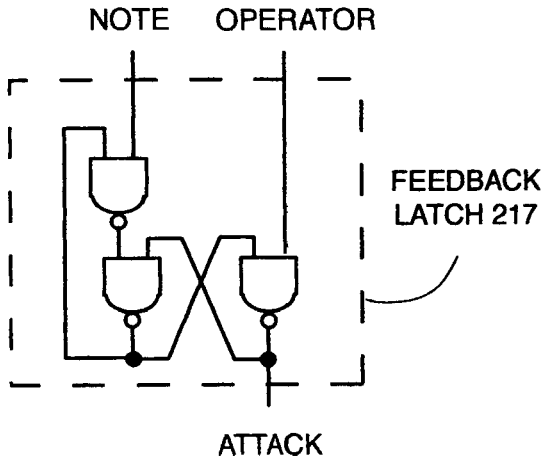

FIGS. 7B and 7C show two embodiments of the most basic latch circuit that is activated by a specific sequence of inputs, Sequential Latch 216 and Sequential Latch 217. For both of these circuits, the Note input must be True in order for the output to be True. So these latches output True in response to a True at the Operator input preceded in time by a True at the Note input. These circuits are identical in function and can be used to implement very simple interactive control envelopes. In the present embodiment, Sequential Latch 216 is used as a Continuation Latch that may only be activated subject to the prior activation of an Attack Latch in an interactive control envelope. It is also useful as a building block to develop more complex latches to be discussed presently. Visual Basic code that simulates these circuits is shown in FIG. 8B.

Figures 9A, 9B:
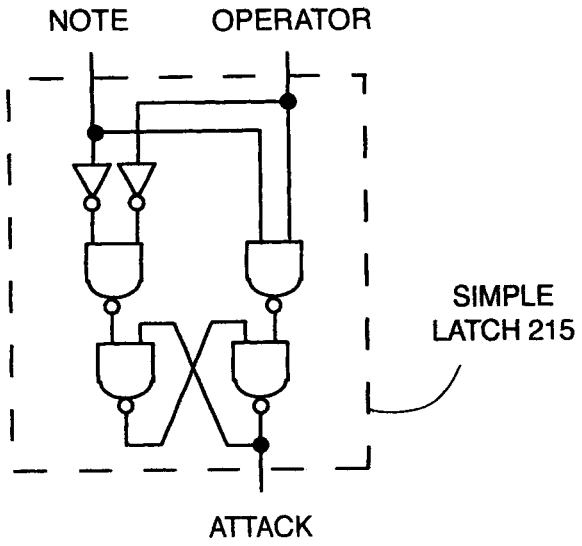
FIG. 9A shows a circuit diagram for a Simple Latch.
FIG. 9B shows Visual Basic code that simulates the Simple Latch circuit in FIG. 9A.

A circuit for another simple latch, Simple Latch 215 is shown in FIG. 9A. There are two sequences of user gestures that will activate this latch, operator release followed by note selection, or note selection followed by operator release. Changes of state of both operators are required to change the state of the latch. In each sequence, the first is the selection gesture and the second is the activation gesture. Likewise there are two sequences that deactivate the Attack Latch. This makes it possible to reuse either operator while the other is held, without changing the output. In other embodiments to be described presently, there is only one gesture sequence that will activate an Attack Latch and one that will deactivate it, making it possible to reuse both operators.

Code that simulates the properties of Simple Latch 215 is shown in FIG. 9B. The code disclosed above, and other code implementations to be discussed presently, may be included as part of a computer program designed to implement embodiments of the present invention. Each of these functions has two variables. The variable "Note" may represent Note Act 1 data. The variable "Op" may represent Control Logic 1 data. To implement latches for other embodiments these may be interchanged, or variables representing interaction rate event data generated by Control Logic 30, Global Note Select 50, or Channel Note Select 60, may be substituted.

These functions will generally be called responsive to changes of state of the input variables. Alternatively the state of each function may be updated at a regular clock rate. Likewise calls to other function may occur for changes of state of the latch data resulting from function operations, similarly to the leading and trailing edge of a clock pulse that causes a change of state of a latch circuit. This simulates the action of a connection from one circuit element to another in a larger circuit. All the circuits disclosed in the present invention, as well as variations of them, may thus be simulated in software.

Each of these functions may also each be separated into two functions, each called responsive to a single variable, with the current state of the other variable and/or the state of the latch output passed to it. These may then serve the same purpose as additional intermediary variables that store results of previous calls in the disclosed embodiments. These functions can also respond to specific messages which can be text strings i.e. "note64 on" or "operator1". It will be appreciated that code implementing conditional functions may also be written using the C++"case" or "switch" statement, or other built-in programming language function for generating state dependent results from input variables. Since latches are generally used to latch either control operator or note selection or activation to a channel, or to map a parameter to a signal generator, a number representing one of the above may be passed from an input variable to the output of the function under the latch activation conditions. Code that performs the same functions as the disclosed circuits may also be implemented using a single "count" variable to track a sequence of changes to input variables, or a time stamp to test for a specific sequence of inputs. Examples of these methods will be disclosed presently.

Description of Channel Envelope 100-1

FIG. 4 shows an implementation of Channel Envelope 100-1. Enable 200 is an And Gate. One input to Enable 200 is from Toggle 90-1. When Toggle 90-1 is False, logic data from Control Logic 1, is passed through by the And Gate to Forward Attack Latch 210, Reverse Attack Latch 220, Forward Continuation 230 and Reverse Continuation 240. All functions of the Channel Envelope 100-1 are thus enabled. Interaction rate event data labeled Control Logic 1 is generated by Control Logic 30 responsive to user operation of Control Operator 10-1. Interaction rate event data labeled Note Act 1 is generated by Channel Note Select 60 responsive to user operation of Note Select 20. So when Channel Envelope 100-1 is enabled by Toggle 90-1, the user may interact with Channel Envelope 100-1 using Control Operator 10-1 and Note Select 20.

When Channel Envelope 100-1 is first enabled, Forward Attack Latch 210 is selected. Otherwise Forward Attack Latch 210 is selected when a logical False is received from Control Logic 1. Forward Attack Latch 210 is then activated and latched when a logical True is received from Note Act 1. In terms of user actions, this means that if the note or notes represented by Note Act 1 are deselected and Control Operator 10-1 is deflected and then released, Forward Attack Latch 210 is selected. Then the next note that is selected for activates and latches Forward Attack Latch 210. Forward Attack Data is synthesized by Forward Attack Latch 210 and sent to Channel Control 150-1 and Channel Notes 160-1 and may be used to activate sequences, audio and/or control rate signals. Unless otherwise stated, reference to operation of Note Selection 12 and Control Operator 10-1-2-3-4 are understood to mean that interaction rate event data is generated responsive to user interaction gestures, via Channel Note Select 60 and Control Logic respectively, and input to Channel Envelope 100-1.

Forward Continuation 230 is selected by Attack Data from Forward Attack Latch 210. Forward Continuation Data is then synthesized by deflecting and releasing Control Operator 10-1 and by deselecting and then reselecting notes with Note Selection 12. Interaction rate signals thus synthesized are sent to Channel Note 150-1 and Channel Control 160-1 and may be used to activate audio or control data signals.

Similarly to Forward Attack Latch 210, if a previously selected note represented by Note Act 1 data is deselected and then Control Operator 10-1 is deflected, Reverse Attack Latch 220 is selected. If the same note is selected again, Reverse Attack Latch 220 is activated and latched. Or Reverse Attack Latch 220 may be activated and latched by a different note if all other channels are subsequently used, or if the selection latched to Note Act 1 is unlatched responsive to Attack Data False from Forward Attack Latch 210, so that Note Act 1 of Channel Note Select 60 must be reused.

Reverse Continuation 240 is selected by Reverse Attack Latch 220. Reverse Continuation Data is synthesized by deflecting and releasing Control Operator 10-1 and by deselecting and then reselecting notes. Interaction rate signals thus synthesized are sent to Channel Note 150-1 and Channel Control 160-1 and may be used to activate different audio and control rate signals.

The following will illustrate a possible use for the Channel Envelope 100-1 as embodied in Phrase Synthesis 70. In the prior art, if a pitch bend is performed and then a second note is played after the first one is bent, the second sounds higher by the bend amount. That is, the second note sounds at a higher pitch than it's selected position on the keyboard. This problem is partly solved by activating each note on a separate channel and only sending bend data to channels with activated notes, so a bend sent to one channel doesn't affect other notes. Or all notes can be activated on one channel until a bend is played. Then notes are activated on another channel.

It might be supposed that such an arrangement would require channelizing notes, and then implementing a simple switch such as an And Gate, that turns on the pitch bend for channels with activated notes. However if a note that is bent is deselected and the bend released, the bend will be turned off, and the previously bent amount retained when the bend operator is released, instead of bending back down. Then when another note is activated, it will be at the bent pitch. So it is necessary to initialize the pitch or frequency of an audio signal generation function to the selected pitch when a note is activated. This can be done in a MIDI implementation by sending a constant pitch bend number zero along with a selected note number to activate a note. Alternatively, the negative of the current pitch bend value may be summed back into an accumulation function used to increment pitch bend or note frequency data. For a non-MIDI implementation, the difference between the selected frequency and current frequency parameter for an audio signal may be used to initialize the frequency to the selected one.

The above scheme still has a flaw however. If a note is deselected and then reselected before the bend is released, the frequency of the signal, or pitch bend increment, is reinitialized, so the note sounds again at it's original selected pitch rather than the pitch it was bent to. So it is desirable that the pitch bend not only be switched on and initialized when a note is activated, but that it be latched on, so that it remains bent when a bent note is deselected and then reselected. This requires that both the note selection be latched to the originally selected channel and the pitch bend increment or bent frequency be latched to the same channel. The objective is that a note that is activated and then bent and then deselected should remain bent, while other notes that may be activated in between are not bent, until a control operator subsequently operated. Intervening notes should thus be activated on another channel and the pitch bend or frequency parameter initialized as above.

FIG. 10A shows code for a simple Attack Latch that may be used to implement this scheme. When the output of the module is True, pitch bend is enabled on the currently selected channel. Note selections are latched to a channel on selection, or under control of the Attack Data generated by the latch, but notes are activated independently of the latch output. This makes it possible to release a note when an operator is deflected, and then reselect it on the same channel. Notes activated on other channels after operator deflection have no pitch bend increments, because pitch bend is not activated on those channels, and so notes sound at their selected pitch rather than at the bent pitch.

It may also be desirable to bend a note down that is activated after a first note is bent up. This embodiment requires both a Forward and Reverse Attack Latch. Since the control operator performing the bend is already deflected when a Reverse Attack Latch is activated, starting the bend for a second note at a zero amount means the bend will be incremented to a negative amount. This may be done if the second note is bent on a second channel, and pitch bend turned on responsive to a Reverse Attack Latch. A number of embodiments for the pitch bend function are possible. A separate function that starts from zero and bends negative can be activated. Or a pitch bend function can be used for both forward and reverse directions that continuously sends a positive or negative increment that interpolates from an initialization value. Alternatively, pitch bend may always be sent on all channels, but when a note is activated after pitch bend is sent responsive to operator deflection, the Reverse Attack Latch Attack Data activates a function that sends a constant negative offset amount equal amount of the previous pitch bend, which is summed with the current pitch bend value. So the new note has a pitch bend of zero.

The above can also be implemented for a previously described embodiment in which note pitch is determined by a single number representing frequency, with pitch bend type effects created by incrementing this number rather than sending a separate number representing pitch bend increment. In another embodiment, numbers representing note selections may be mapped to other note numbers, responsive to activation of the reverse side of a latch, in order to compensate for the pitch offset resulting from prior deflection of a control operator. Other parameters of audio signals and score sequences can also be advantageously manipulated responsive to forward and reverse deflection of a control operator by separating notes activated before or after deflection.

Code that can be used to implement a simple Forward and Reverse Attack Latch is shown in FIG. 10B. Identical results may be obtained in these embodiments by using nested conditional statements that only test one variable at a time, instead of the disclosed Boolean logic operations of two or three variables. The code shown is contained in a single function, but a class object implemented in C++ for example, may be separated into two functions, one for each input variable.

In FIG. 10B, the command "Debug.Print" is used to output the Forward and Reverse Attack Data for demonstration purposes, as represented by the variables "AttackLeft" and "AttackRight" respectively. These variable names represent data distinguished by forward and reverse deflection of a control operator. Note selection and deselections are distinguished by True and False data. So note selection prior to operator deflection generates Attack Left True data. Note numbers representing selections on a MIDI keyboard may also be used distinguish a latch variable as for example, AttackLeft64. Alternatively or in addition to note selections, audio channel numbers may discretely identify a variable representing latch data that activates an audio signal on that channel. In addition, variable names may represent selections of audio and other signal generation functions assigned to respond to latch activation data. Variable names may be altered dynamically so that functions and channels may be reassigned to latch activation data under programmatic control. It will be appreciated that additional identifying information may be provided in order to distinguish latch activation data used in a selected Performance Mode.

In the code shown in FIG. 10B, the previously determined value of AttackLeft and AttackRight are used in the logic operations. It will be appreciated that in place of these variables, interaction rate event data derived from the output of control rate signals, that are activated by Attack Data synthesized by the module may be used. This implementation can allow for activated control rate signals to be completed, or another condition met, before the output of the module changes again. Similarly, interaction rate event data derived from an audio signal that is activated by Attack Data synthesized by the module, or by a control rate signal activated by Attack Data synthesized by the module, may be used in place of the output variable of the module itself, for conditional operations within the module. These modifications may also be made to other code implementations of Attack Latches disclosed in the present invention.

More complex Attack Latches than disclosed above are depicted in Channel Envelope 100-1. These have the advantage that once activated and latched, they stay latched, until a specific deactivation sequence is performed. So the interaction rate signal they synthesize can be used to activate both audio and control signals. FIG. 11A shows a code module that may be used to implement Forward Attack Latch 210. This code requires the use of an intermediary variable, "Gate1" that stores the result of conditional operations in between calls of the module. FIG. 11B shows a code module that can be used to implement Forward Attack Latch 210 and Reverse Attack Latch 220 combined. This function requires the use of two intermediary variables, "Gate1" and "Gate2".

Figure 12:
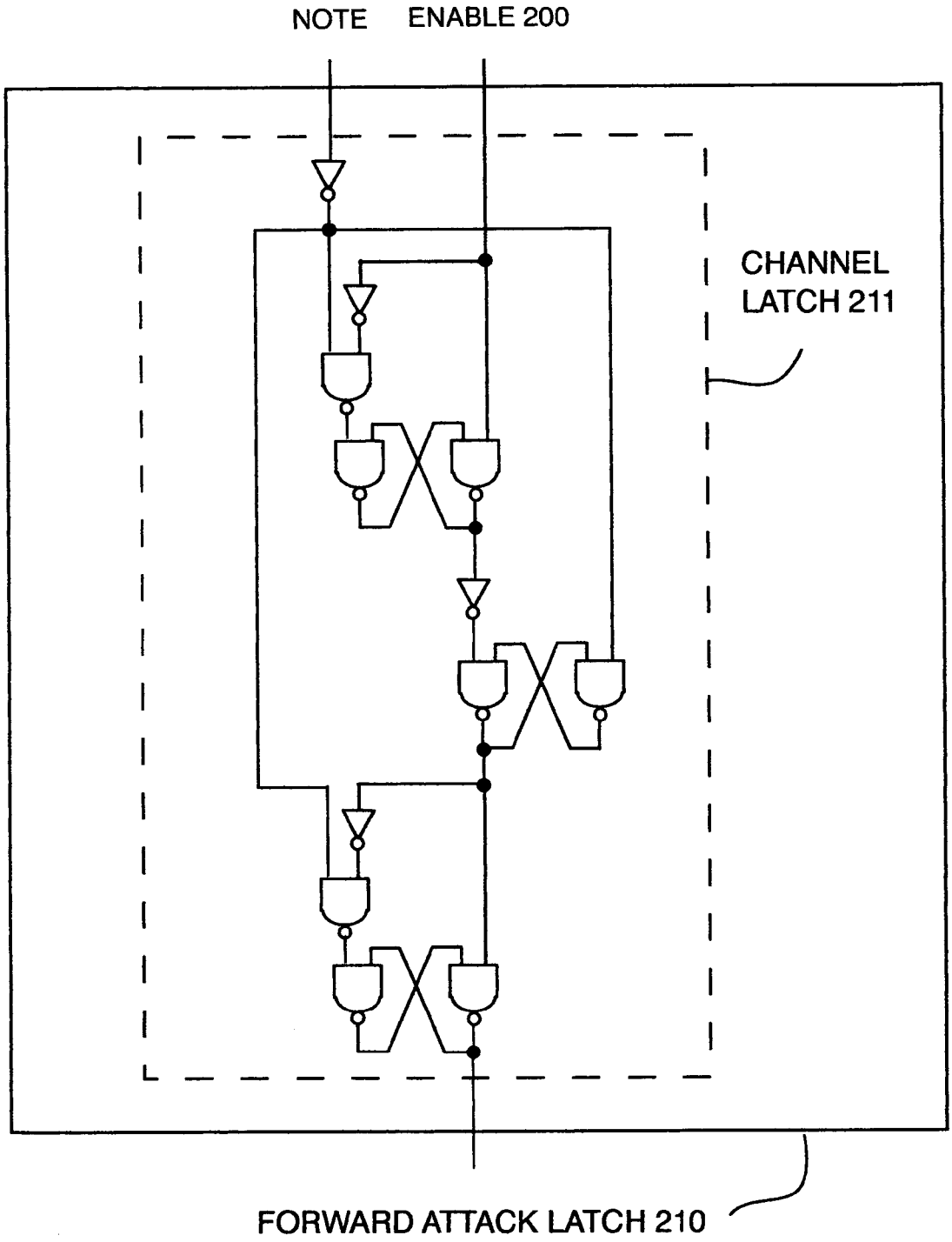
FIG. 12 shows a circuit diagram for a Channel Latch.
Figure 13:
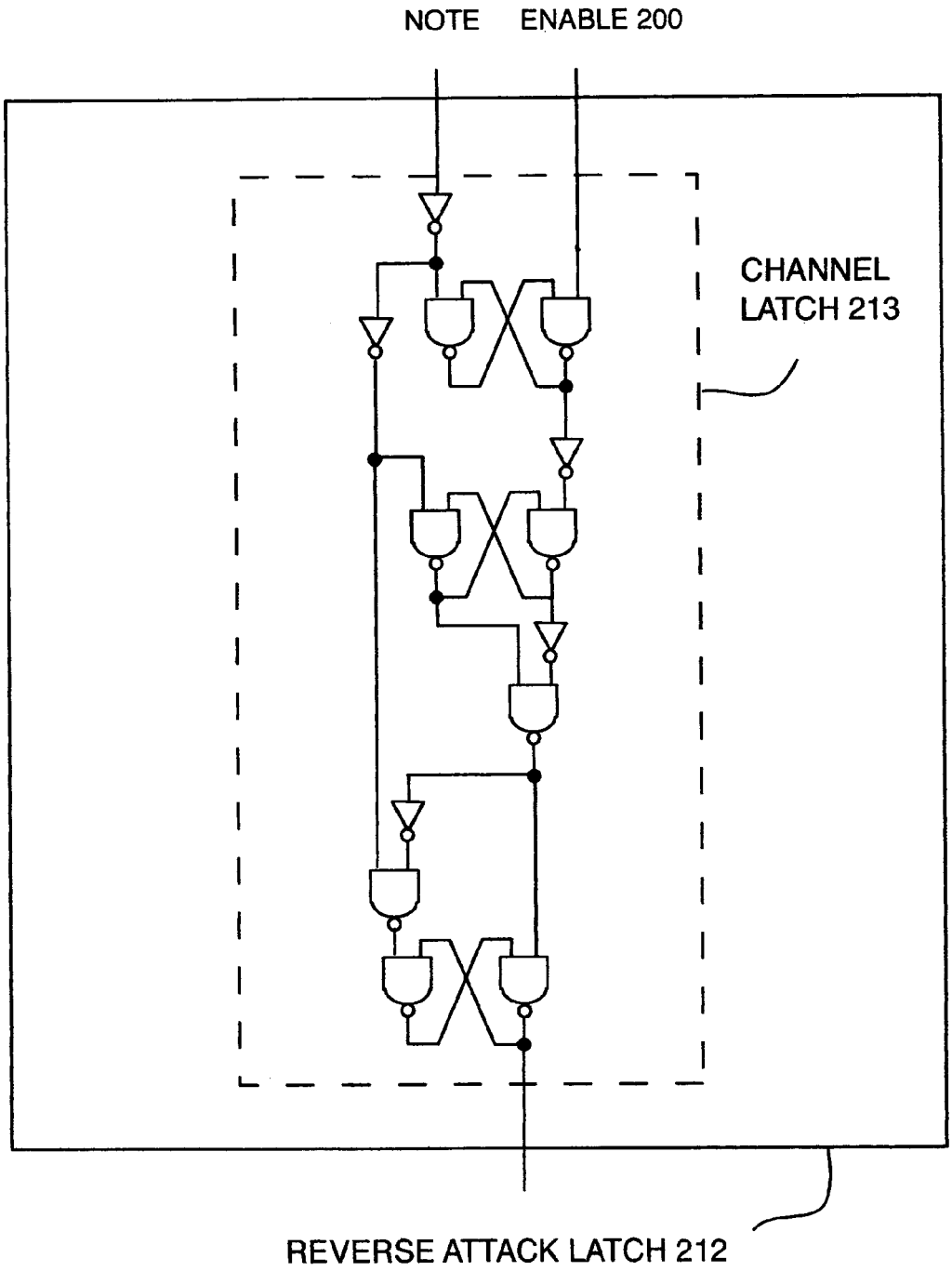
FIG. 13 shows another circuit diagram for a Channel Latch.

FIG. 12 shows a custom latch circuit, Channel Latch 211 that can be used to implement Forward Attack Latch 210. It has the same properties as the above code. Specific sequences of inputs are required to activate or deactivate the latch. FIG. 13 shows an alternative latch circuit, Channel Latch 213 that also has these properties. It is shown as an implementation of Reverse Attack Latch 212. But Channel Latch 211 and Channel Latch 213 are really alternative embodiments of the same circuit element, so each can be implemented as Forward Attack Latch 210 or Reverse Attack Latch 212.

Forward Continuation 230 and Reverse Continuation 240 in FIG. 4 are implemented using Sequential Latch 216, discussed in the previous section. It will be appreciated that continuation variables may be added to the code shown in FIG. 11A or FIG. 11B to simulate these functions. Changes in continuation data is conditional on the AttackLeft or AttackRight variable. Two outputs are shown for each continuation function. Note selection continuations send both note-ons and note-offs. Control Operator continuations send separate forward and reverse activations. Generated audio signals may only be active for a set time, such as the case for a sample that is read through once. Or audio signal generation functions may be implemented that generate continuous audio signals. In either case, note-off data that deactivates an audio signal may also be used to generate separate audio data, responsive to note releases. Similarly control rate functions may occur once and then turn off, or may loop continuously. In the former case, it is useful to have separate functions for forward and reverse operator deflection or note selection. In the latter, the reverse direction can deactivate the forward or selection function as well as activate the reverse or deselection function.

Description of Line Envelope 110

Figure 14:
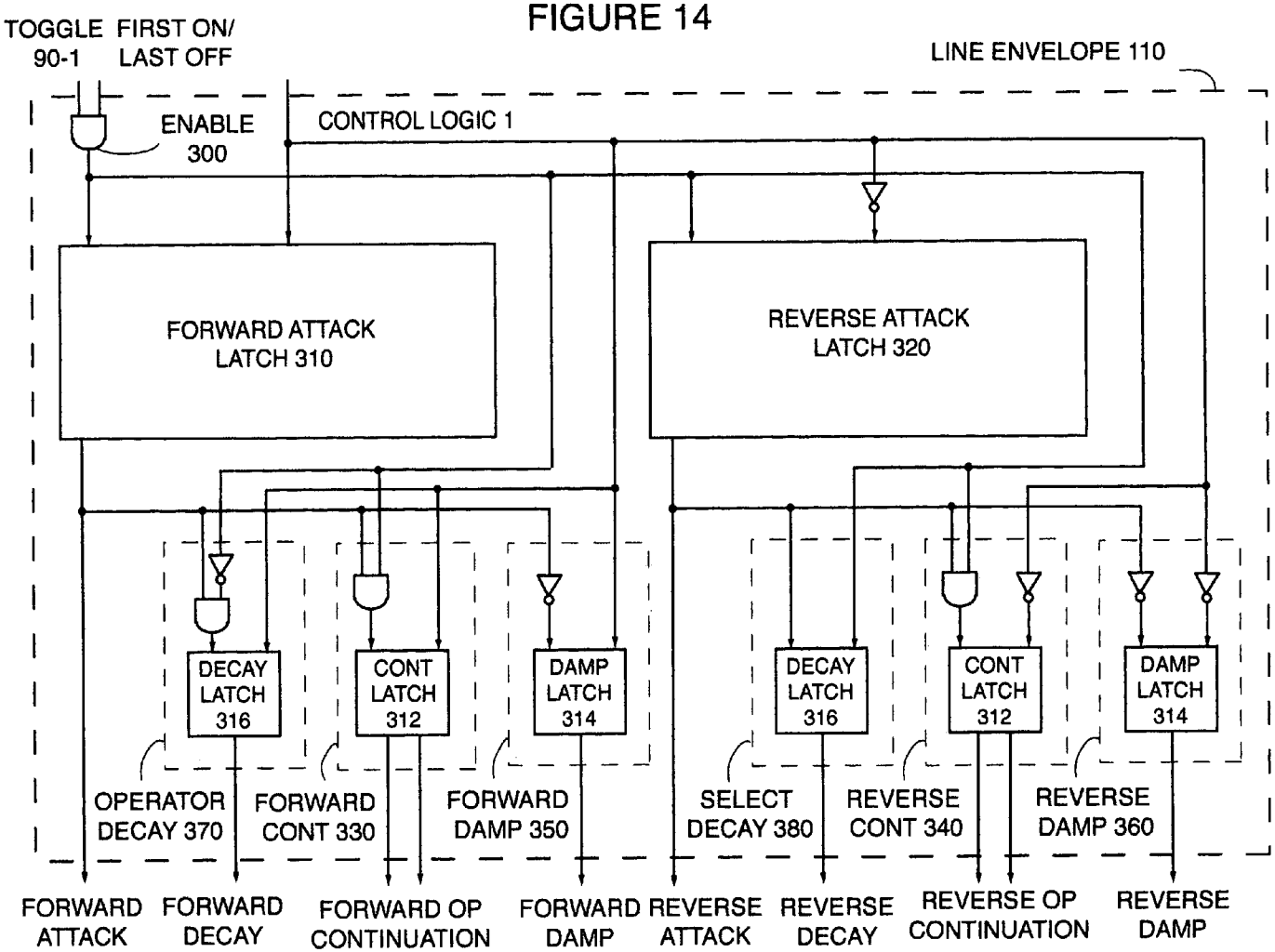
FIG. 14 shows a diagram for a Line Envelope.

FIG. 14 is a generalized circuit diagram for a Line Envelope 110. It operates in a similar manner to Channel Envelope 100-1, but with the roles of Note Selection 12 and Control Operator 10-1 reversed. That is, selection of Forward Attack Latch 310 is accomplished using Note Selection 12 and activation is accomplished using Control Operator 10-1. As thus operated, Line Envelope 110 may be used to simulate the actions of first selecting a note on a guitar fretboard, or violing fingerboard for example, and then activating the note with a separate gesture, such as plucking a guitar, or bowing a violin. For such an implementation, a MIDI note-on velocity value may also be input from Note Selection 12, or derived from deflection of Control Operator 10-1 using two threshold detectors, or from successive control rate data values.

In Line Envelope 110, And Gate Enable 300 operates to toggle Line Envelope 110 on responsive to Toggle 90-1. Once Enable 300 receives a logical True from Toggle 90-1, Line Envelope 110 is enabled. Incoming First On/Last Off data from Global Note Select 50 is passed to Forward Attack Latch 310 which selects it. Then deflecting Control Operator 10-1 activates and latches Forward Attack Latch 310. This synthesizes Attack Data True which is sent to Line Notes 170-1 and Line Control 180-1 for use in Phrase Synthesis 70.

Thus a note may be selected and then activated by a separate control operator. The note may be activated directly by Attack Data synthesized by Forward Attack Latch 310, or the Attack Data may activate a control rate signal from which interaction rate data is derived and used to activate an audio signal or sequence. Interaction rate data may be derived from an activated control rate signal by a threshold detector. Or the control rate signal itself may activate an audio signal, as is sometimes the case with physical modeling audio synthesis. The control rate signal may also be itself controlled by continuous control rate data from a control operator. Such an arrangement allows for a kind of "flex" activation that closely simulates the motion of picking or bowing a note for example. In such an embodiment, the control rate signal that activates an audio signal may start before the audio signal it generates, which may initiate a phrase. Such a time lag is natural when playing acoustic instruments, and typically a musician accounts for it. However, it may be seem more natural for a musician accustomed to playing a MIDI synthesizer, for an interaction rate signal to start a physical model from some initial bias state.

Another control rate signal or the same one, may be used as modulation data for the audio signal. For example, a simulated guitar slide of an octave or more, synchronized with note activation, is a stylistically recognizable gesture often used to initiate a phrase. In a variation of Line Envelope 110, 2nd Note/1st Note data is used to select the latch instead of First Note/Last Note. In this embodiment, the interval distance between the first and second note selections may be used to determine the distance of a control rate signal pitch bend effect, activated along with a note when the Attack Latch is subsequently activated responsive to deflection of Control Operator 10-1.

Once Forward Attack Latch 310 is activated, Forward Continuation 330 is selected. Notes may then be reactivated by deflecting and releasing Control Operator 10-1 while holding a note, similar to the action of picking a guitar or bowing a violin. If note selections are latched to channels responsive to Attack Data, then each time Control Operator 10-1 is deflected, the previously selected notes are deactivated and reactivated. If note pitches have been modified after activation, for example by additional note selections that activate pitch bend functions responsive to Continuation Data, then the reactivated notes will sound at the bent pitches. Alternatively, pitch bend may be reinitialized on reactivation. Additional continuation functions may be activated that cause the amplitude of deactivated notes to decay before a note-off is sent responsive to the end of an automated decay function, or a time delay function. Such a function may be used to implement a "cross fade" or legato effect for newly activated notes.

In another embodiment, note selections may not latch to channels, so previously activated notes are deactivated by Forward Continuation 330, while newly selected notes are simultaneously activated. Similarly to the action of Forward Attack Latch 310, newly selected notes may be activated directly by synthesized Continuation Data, or Continuation Data may activate a control rate signal that may be continuously controlled by Control Operator 10-1 and that is then used to activate an audio signal. Since Forward Attack Latch 310 is already activated, an introductory control rate gesture and/or introductory audio signal isn't repeated. However, additional transitional control rate signal generation functions may be advantageously activated responsive to Forward Continuation 330.

Continuation Data synthesized responsive to repeated deflection and release of Control Operator 10-1 can also be used to cumulatively vary one or more parameters of an activated audio signal. Or a preset sequence of audio or control rate signals may be activated by Continuation Data synthesized responsive to repeated deflections of Control Operator 10-1 or another Control Operator.

Forward Attack Latch 310 also selects Operator Decay 370. If a note is held following activation of Forward Attack Latch 310, while the activating Control Operator is released, Operator Decay 370 sends a logical True, which can be used to activate functions that are analogous to the decay segment of a traditional control envelope. That is, the attack portion of an interaction rate signal is often followed by retracement, or decay, before the interaction rate signal settles into a repeating or sustaining continuation pattern. Alternatively Decay Data can be used to deactivate a function activated responsive to Attack Data. Operator Decay 370 isn't deactivated itself until Attack Latch 310 is deactivated, which happens once all notes are deselected and then Control Operator 10-1 is released. Attack Latch 310 deactivation synthesizes Attack Data False, which can be used to activate a final audio or control rate signal, such as a simulated guitar slide down.

Reverse Attack Latch 320 is activated in a similar fashion to Attack Latch 310. First releasing all notes, then deflecting Control Operator 10-1 then selecting a note, selects Reverse Attack Latch 320. Releasing Control Operator 10-1 then activates and latches Reverse Attack Latch 320. Attack Data thus synthesized by Reverse Attack Latch 320 may activate a different initial control rate and/or audio rate signal from those activated responsive to Attack Data synthesized by Forward Attack Latch 310. Reverse Latch 320 activation may also select a different set of Continuation Latches and possibly a different Sub-Envelope from Attack Latch 310.

Reverse Continuation 340 works in a similar manner to Forward Continuation 330. Once Reverse Attack Latch 320 is activated, Reverse Continuation 340 is selected. Subsequent note selections and deselections may be made without deactivating Reverse Attack Latch 320. Holding a note while deflecting or releasing Control Operator 10-1 synthesizes Reverse Continuation Data, which may be used to activate additional audio and control rate signals. Reverse Continuation Data may also deactivate previously activated signals. All audio signals may then be deactivated by False Attack Data synthesized by Reverse Attack Latch 320 deactivation. Alternatively, activated signals may continue for a preset time, or until "Damping Data" synthesized by Reverse Damp 360 is received. Or activated signals may continue for a time determined by some other function of Phrase Synthesis 70.

Select Decay 380 works in a similar fashion to Operator Decay 370. After Reverse Attack Latch 320 is activated, if all notes are then deselected, Select Decay 380 sends a logical True which can be used to activate decay functions. Operator Decay 370 and Select Decay 380 are interchangeable. Either or both can be included in either side of Line Envelope 100, Channel Envelope 100-1 or other implementations of an interactive control envelope.

Another feature of Line Envelope 110 is Forward Damp 350 and Reverse Damp 360. Forward Damp 350 is selected when Forward Attack Latch 310 is deactivated, and activated by deflecting Control Operator 10-1 again. Another Damp Latch can be included that is activated by reselecting a note after Attack Latch 310 is deactivated. Damping Data may be used the same way the second release segment of a traditional control envelope is used. For example, an audio signal may be allowed to continue sounding even after Forward Attack Latch 310 has been deactivated. Damping Data synthesized responsive to operator deflection or note selection then stops the previous signal from sounding. Or Damping Data may activate a second final control or audio signal and then subsequently deactivate it. A Damp Latch used to synthesize Damping Data may also be implemented as part of Channel Envelope 100-1 or a Sub-Envelope.

The code shown in FIG. 9B can also be used for a simple Line Envelope. In this implementation, synthesized Attack Data output by the function is used to activate audio signals. Control rate signals are generated independently. Audio signals can be activated by deflection of a Control Operator, once a note has been selected, or by note selection, once a Control Operator has been deflected. FIG. 15 shows code that can be used for another simple embodiment of Line Envelope with both Forward and Reverse Attack Latches. In this embodiment, synthesized Forward and Reverse Attack Latch Data activate control rate signals, which then activate audio signals.

The embodiments made possible by the code modules shown in FIG. B and FIG. 15 suffer from the same limitations as the embodiments for a Channel Envelope previously discussed for FIGS. 10A and 10B. These limitations are resolved by the code shown in FIG. 16A and FIG. 16B which is similar to the code shown in FIGS. 11A and 11B for Channel Envelope 100-1. FIG. 16A has code that implements one side of an Attack Latch, and requires the use of an intermediary variable, "Gate1". FIG. 16B shows code that can be used to implement a combination of Forward Attack Latch 310 and Reverse Attack Latch 320. It uses two intermediary variables. For these implementations it is only necessary to input the selection data sometime prior to the activation data in order to activate the latch. In some implementations of a Line Mode or other Performance Mode, the sequences of interaction gestures required to activate certain functions can be become complex, and each possible sequence of gestures have a different effect. So preferably, activation of an Attack Latch requires a specific sequence of input data.

FIG. 17 shows another code module that can be used to implement Forward Attack Latch 310, and has the property that activation requires a specific sequence of input data. There are two intermediary variables, "Gate1" and "Gate2" that provide an activation buffer between inputs and outputs. The content of these intermediary variables is stored in between calls to the module. So even though the module is called at least every time there is a change of input, the output doesn't necessarily change. A variation of the code shown in FIG. 17 can also be used to implement an Attack Latch for Channel Envelope 100-1.

The code disclosed in FIG. 17 requires that the previous output of the latch be available within the module, for further calculations. It is also possible to implement a "top down" approach, which doesn't require that the previous output of the module be available for correct operation. Such a module is shown in FIG. 18. In this case, there are three variables, "Gate1", "Gate2", "Gate3" that retain their data in between calls.

FIG. 19 shows a code module for Forward Attack Latch 310 and Reverse Attack Latch 320 combined. Four intermediary variables are required, "Gate1", "Gate2", "Gate3", and "Gate4". Since there are two outputs, these are defined as variables also, AttackLeft and AttackRight, instead of the output being returned by the function name as in FIG. 18. FIG. 20 also shows a code module for Forward Attack Latch 310 and Reverse Attack Latch 320 combined. This is a top down implementation like FIG. 19. It requires four intermediary variables, but doesn't require that the previous state of either AttackLeft or AttackRight be available for logic operations within the module.

Figure 21A:
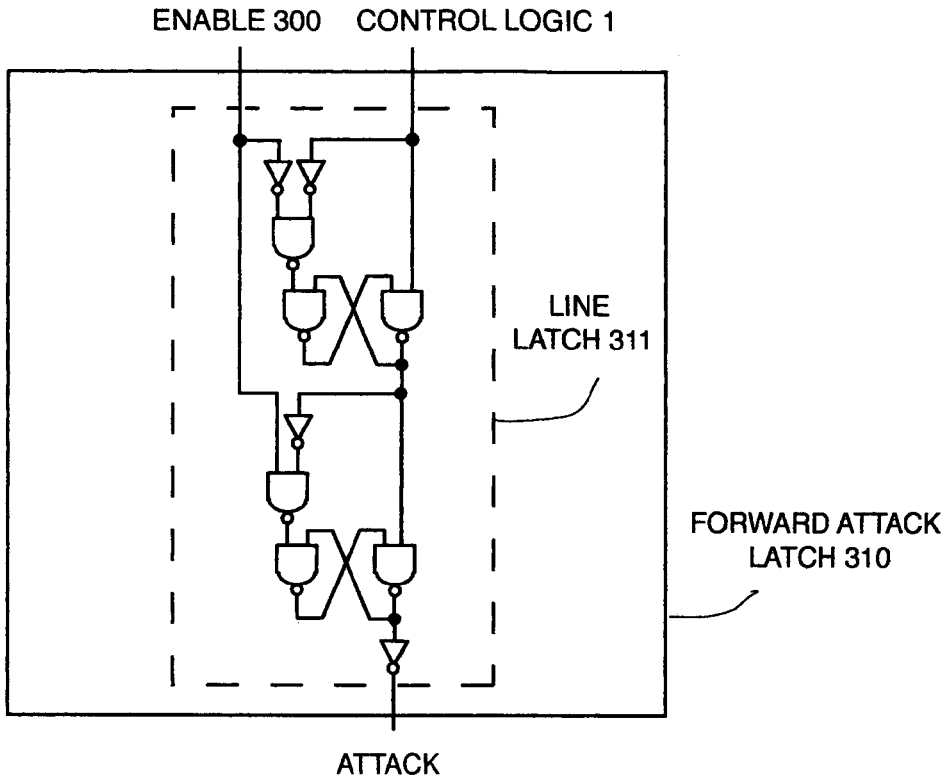
FIG. 21A shows a circuit diagram for a Line Latch.
Figure 21B:
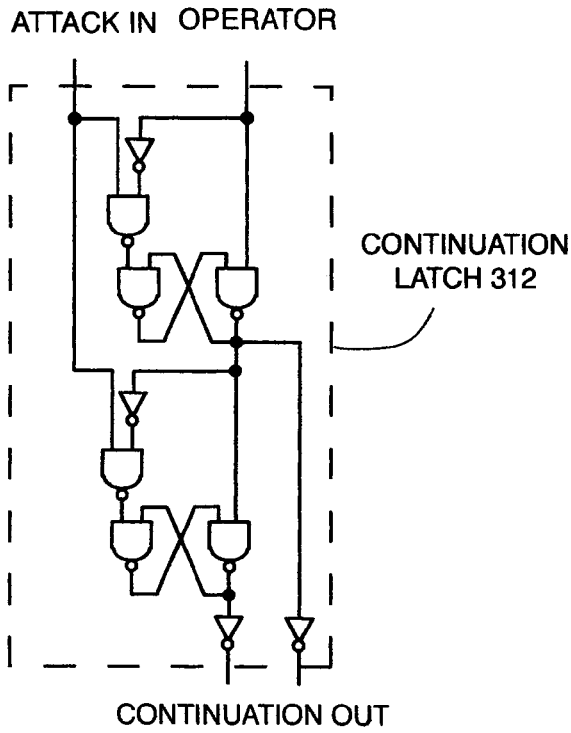
FIG. 21B shows a circuit diagram for a Continuation Latch.

Forward Attack Latch 310 and Reverse Attack Latch 320 in FIG. 9 may be implemented using a circuit shown in FIG. 21A, Line Latch 311. Forward Operator Continuation 330 and Reverse Continuation 340 may be implemented using a circuit shown in FIG. 21B, Continuation Latch 312. It will be appreciated that continuation variables may be added to any of the code functions discussed above to generate continuation data in a software implementation. Changes in Continuation Data are conditional on the Attack Data.

Figure 22A:
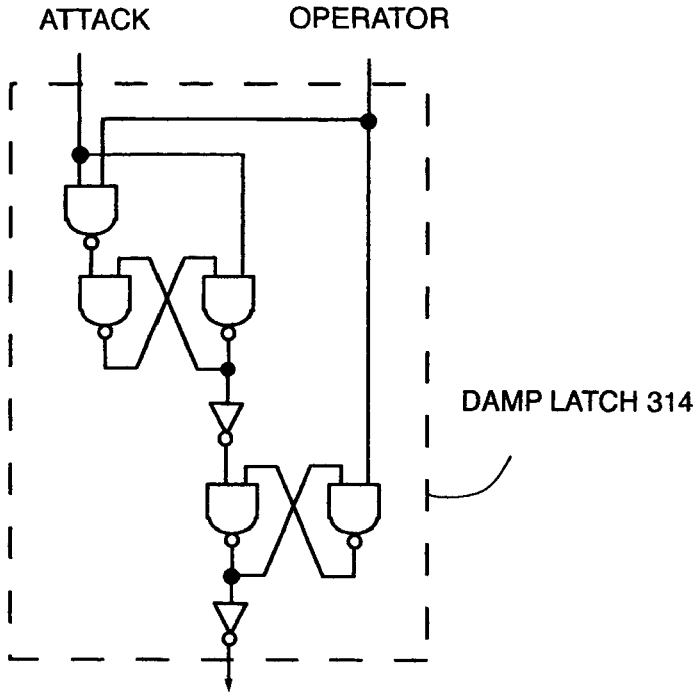
FIG. 22A shows a circuit diagram for a Damp Latch.
Figure 22B:
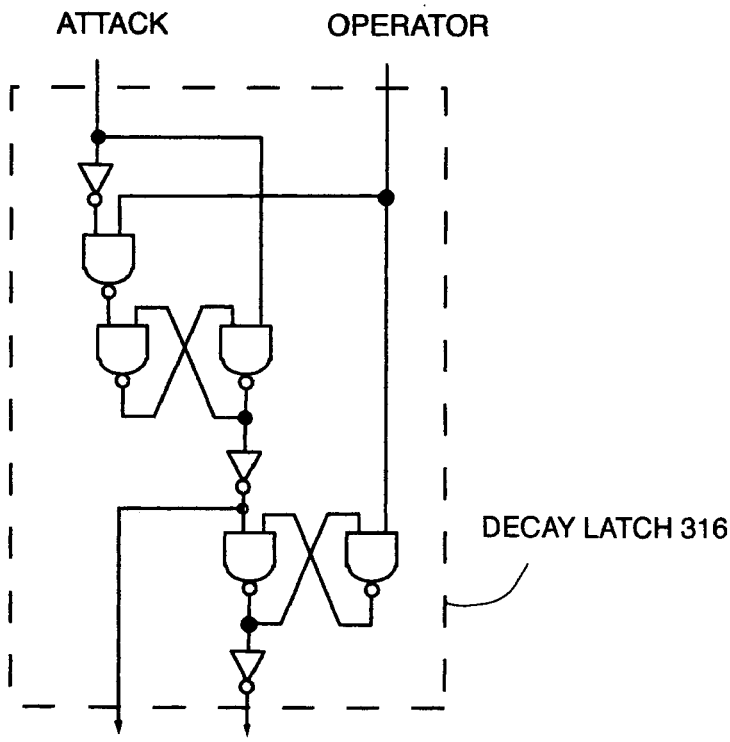
FIG. 22B shows a circuit diagram for a Decay Latch.

Forward Damp 350 and Reverse Damp 360 may be implemented using a circuit shown in FIG. 22A, Damp Latch 314. Operator Decay 370 and Select Decay 380 may be implemented using a circuit shown in FIG. 22B, Decay Latch 316. It will be appreciated that Decay and Damp variables may be added to any of the code functions discussed above to synthesize Decay and Damp Data for a software implementation. Decay Data is conditional on Attack Data True, while Damp Data is conditional on Attack Data False.

It will be appreciated that code modules may be implemented that differ from those disclosed, or are written in a different language, but accomplish the same ends. In order to be useful for the present invention, code that implements Attack Latches that have the characteristic that the output changes responsive to a time ordered series of input changes, and preferably to a specific sequence of input changes. The latter requires the use of at least one intermediary variable that stores data resulting from previous calls. These are specified as static variables in the present embodiments, to distinguish them from the Attack Data output by the latches. Attack Data is specified as public or global variables so that the current state of the latches is available to other functions.

It will be appreciated that intermediary data specified as "Gate" variables may also be public or global, so that redundant operations in several latches may be combined. In the case of a latch that uses two functions, each activated responsive to one input, the previous value of one input may be stored and passed to the other function. The Attack Data itself may be stored and used as an intermediary value for subsequently updating the current state of the latch. It is a distinguishing characteristic of all the latches disclosed that they "remember" the result of previous input changes.

Alternative methods may be used to implement latch functions in software. For example, FIG. 23A shows a method that implements Forward Attack Latch 210 in Channel Envelope 100-1 using a single Count variable, which is incremented or decremented given certain input conditions. This method can be used to implement a general latch, with programmable inputs, that includes an intermediary count variable and a threshold count value that activates the latch. The count is incremented responsive to a sequence of inputs which can be assigned programmatically to interaction rate data. Possible input may include the output of another latch, so that repeat activations increment the count. For example, instead of a "one shot" Damp Latch, a Damp Continuation Latch may be implemented, that is activated repeatedly after deactivation of it's associated Attack Latch. The count of Damp Latch activations may gradually decrement a parameter of a decaying audio signal, including volume and/or timbre, until a threshold count which deactivates all functions.

FIG. 23B is an implementation of Attack Latch 310 used in Line Envelope 110 that uses the Time( ) function in Visual Basic to time stamp interaction rate data as it is received by the function. It then compares a previously time stamped variable to determine if a specific sequence of inputs has occurred.

It will be appreciated that additional Line Envelopes may be implemented that are activated responsive to Control Operators 10-2, 10-3 and 10-4. These interactive control envelopes may only be distinguished by the functions that are activated by their respective Attack Latches. The respective audio rate signals and/or control rate signals may have initial pitch, volume, timbre, attack time or other parameter, which is selectable according to which Control Operator is used to activate an interactive control envelope once a note is selected. Once one interactive envelope is thus activated, the others may be disabled responsive to it's inverted Attack Data, by using a four input And Gate as an enable function for the Control Logic input to each of the other interactive active control envelopes.

Alternatively, each Control Operator may activate a separate mapping function for a single interactive control envelope. The mapping function sends initial parameter data to the functions activated responsive to the interactive control envelope. Activation or selection of the interactive control envelope with a particular Control Operator then latches the Control Operator selection, responsive to the Attack Latch, or other interaction rate signal data. This is similar to the function of latching note selections to audio channels, as previously discussed.

Note selections made prior to Control Operator deflection may themselves activate audio signals, for example simulating the sound made by selecting a note on an unplucked guitar string. Attack Data would then disable activation of this signal, or it could continue as an embellishing sound for control rate signals that modify subsequently activated audio signals. In another implementation, looped audio segments may be triggered by initial keyboard selections, possibly according to keyboard zones as previously described. Deflection of a Control Operator could then activate a transition audio segment, and by activating a Line Envelope, also make a new set of looped audio segments available to be activated by Continuation Data synthesized responsive to further note selections. In this embodiment, each keyboard zone represents a separate note selection device, so additional Continuation Latches could provide a plurality of selectable audio segments available for activation by the user.

In an implementation of a Channel Envelope similar to the above, initial deflection of a Control Operator may activate an introductory audio segment, selectable according to selection of Control Operator. Looped segments may then be made available to the user that may be activated responsive to note selections, according to split zones of a note selection device. Each such zone may activate a separate Channel Envelope, which then makes further segments available to the user, activated by Continuation Data synthesized responsive to further note selections and manipulation of Control Operators. It will be appreciated that the looped audio segments in the above implementations may be pre-recorded or generated in real time. Alternatively synthesized or pre-recorded MIDI sequences or other musical score representation data, for which audio signals are triggered by score data, may be made available for selection by the user.

Description of Line Sub-Envelope 130-1

Figure 24:
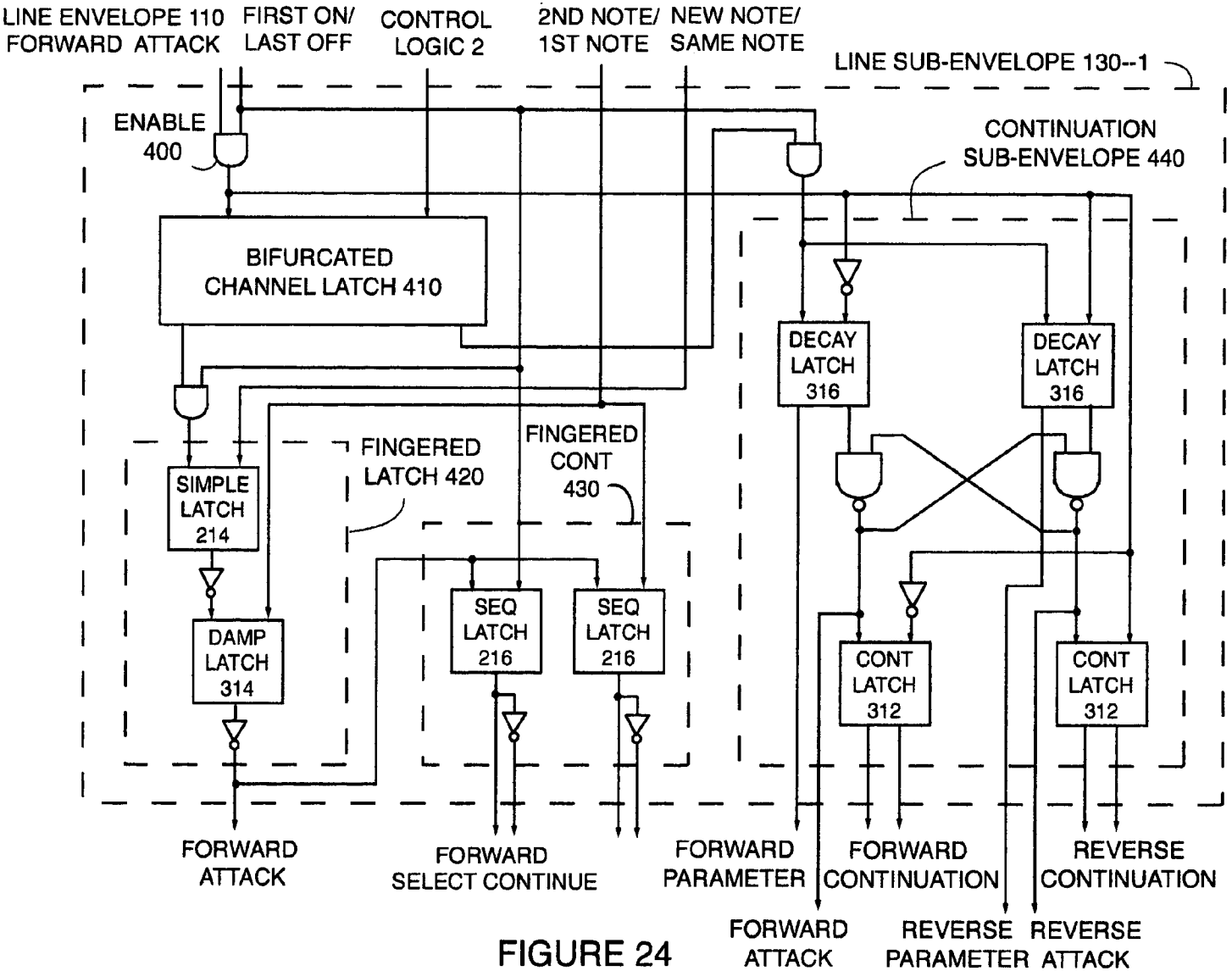
FIG. 24 shows a diagram for a Line Sub-Envelope

FIG. 24 shows a circuit diagram for Line Sub-Envelope 130-1.

There are two sides to this Sub-Envelope, each selected responsive to deflection or release of Control Operator 10-2. It will be appreciated that Line Sub-Envelopes 130-2, and 130-3 may be implemented that also have two sides responsive to deflection of Control Operators 10-3 and 10-4. Which Sub-Envelope is activated may be made dependent on the last activated Control Operator, which selects that Sub-Envelope, and simultaneously de-selects the others. Such an arrangement can be implemented using a variation of the latch depicted in FIG. 31, the operation of which will be discussed presently. Control operators could thus function as selection devices for various continuation functions implemented in the three respective Sub-Envelopes. For example, different continuation functions may generate control rate signals with different shapes, overall times, or distances, and may include offset constants.

Figure 25:
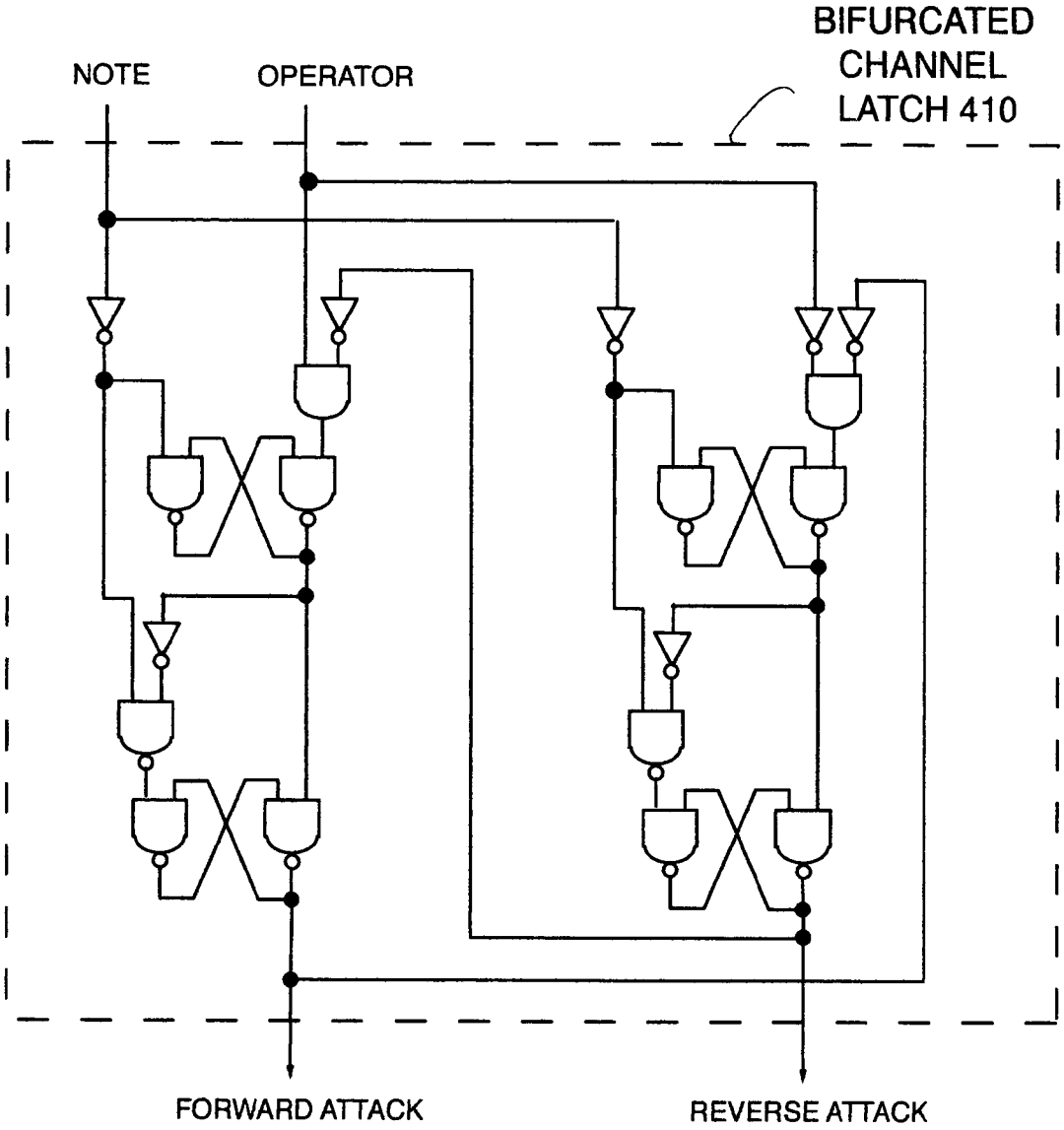
FIG. 25 shows a circuit diagram for a Bifurcated Channel Envelope.

The two sides of Line Sub-Envelope 130-1 provide additional variety. Each of these sides is actually a Sub-Envelope itself. Bifurcated Channel Latch 410 in this circuit, behaves the same way as Forward Attack Latch 210 and Reverse Attack Latch 212 in Channel Envelope 100-1, and may be substituted for them in Channel Latch 100-1. Here it enables selection of one side or the other of Line Sub-Envelope 130-1. A circuit for Bifurcated Channel Latch 410 is shown in FIG. 25. This circuit has two sides, which respectively enable the two sides of Line Sub-Envelope 130-1. Each side gates off the other when activated, to keep it from being latched on during further manipulation of the input data, until the first side is deactivated. This design could also be adopted for two sided implementations of other latches. As depicted in FIG. 24, Bifurcate Channel Latch 410 is enabled by Reverse Attack Data from Line Envelope 110. It will be appreciated that Forward Attack Data from Line Envelope 110 may also be used to enable Line Sub-Envelope 130-1. Or two separate Sub-Envelopes may be provided to be enabled by Forward and Reverse Attack data.

When Line Sub-Envelope 130-1 is enabled, Bifurcated Channel Latch 410 is also activated. Ordinarily Bifurcated Channel Latch 410 is activated by a note selection, but because a note is already selected, Reverse Attack Data from Line Envelope 110 causes the output of Enable 400 to be True, which activates Bifurcated Channel Latch 410. Data output from Bifurcated Channel Latch 410 enables one of two sides of Line Sub-Envelope 130-1, dependent on forward or reverse deflection of Control Operator 10-2. Assuming Control Operator 10-2 is released prior to activation of Reverse Attack Data from Line Envelope 110, the first side of Line Sub-Envelope 130-1 is automatically enabled by Forward Attack Data from Bifurcated Channel Latch 410.

The first side of Line Sub-Envelope 130-1, implemented using Fingered Latch 420, is really a Fingered Envelope as might be used in the Fingered Mode discussed previously. When a first note is held while a second is selected, Fingered Latch 420 is activated. In contrast to prior art fingered legato, activation of Fingered Latch 410 then allows the user to release all notes and move his or her hand up or down the keyboard. When implemented as an Attack Latch, Fingered Attack Data could be used to activate a note and a control data function that glides from the first note to the second. Or note data could be activated by First Note/Last Note data, and then the note latched on by the Fingered Latch Attack Data, which also activates a control data function to glide to the pitch of the second note selection that activates the latch. Instead of Second Note/First Note Data, Fingered Latch 420 may be activated responsive to a third, fourth or other count of notes selected while previous selections are held. The previously selected notes may then be activated according to a control signal that simulates a "strum". Once thus activated and latched, notes may be modulated responsive to further note selections.

In the present embodiment of Line Continuation Sub-Envelope 130-1, Fingered Latch 410 Attack Data can function as Select Decay Data, activated by selection of a second note, after a first note is selected and then activated responsive to Reverse Attack Latch 320 in Line Envelope 110. Fingered Attack Data also selects Fingered Continuation 430. Continuation Data may then be synthesized by selection of additional notes. As depicted, First On/Last Off data is used to activate a first Sequential Latch 216 and 2nd Note/1st Note data is used to activate a second Sequential Latch 216 in Fingered Continuation 430. Thus separate continuation functions may be activated for a first and second note selected or deselected, after activation of Fingered Latch 420.

It will be appreciated that additional continuation functions could be activated responsive to additional note selections and deselections according to count variables. Or all note selections subsequent to activations of a Fingered Latch 420 may activate the same functions. Selection values or interval distances between selections may be mapped to parameters of the activated functions.

Fingered Continuation Data may also be synthesized by deflection of Control Operators 10-2, 10-3 and 10-4. Deflection and release of Control Operators 10-3 and 10-4 may also select alternative Attack Latches, similar to the operation of Control Operator 10-2. Note selections may then activate these additional Attack Latches or may activate alternative Sub-Envelopes which select additional Continuation Latches.

The Fingered Attack Latch 420 is deactivated by deselecting all notes, then reselecting the last note previously selected. In this embodiment, the deselection of this note after deactivation of Fingered Latch 420, may then activate a Damp Latch. Alternatively, the Fingered Attack Latch 420 may be deactivated by deselecting all notes, then deflecting a control operator. Such an arrangement can be implemented by the circuit shown in FIG. 35 to be discussed presently, for which the "Note" input is 2nd Note/1st Note Data. In this case, subsequent release of the control operator may activate a Damp Latch. It will be appreciated that the functions of Fingered Latch 420 and associated latches may be implemented in software using any of the same methods previously disclosed for Channel Envelope 100-1 and Line Envelope 110 Attack Latches.

The Reverse side of Bifurcated Channel Latch 410 is selected when all notes are deselected and then Control Operator 10-2 is deflected. When a note is then selected, Bifurcated Channel Latch 410 Reverse Attack Data is sent. This enables Reverse Continuation Sub-Envelope 440, which is really an additional Sub-Envelope that creates still another level in the latch hierarchy.

One application of the hierarchical arrangement of Line Envelope 110 and Line Sub-Envelope 130-1 is the simulation of slurred musical phrases. If a note has been previously activated by operation of Line Envelope 110, and a phrase thereby initiated, further note selections may activate audio signals and/or control rate signals via Line Sub-Envelope 130-1. These signals may be used to simulate slurred note transitions.

Fingered Latch 420 and Fingered Continuation 430 may be used to activate such note transitions. An alternative method of doing this is enabled by Reverse Continuation Sub-Envelope 440. In this embodiment, successive note selections may be used to select interval distances for signals, which are subsequently activated by deflecting and releasing Control Operator 10-2. That is, a note is selected and held, while Control Operator 10-2 is used to activate an audio or control rate signal that traverses the interval.

As shown in FIG. 24, Forward Parameter and Reverse Parameter Data may activate a calculation of interval distance between successive note selections. Forward or Reverse Attack Data, synthesized responsive to Control Operator 10-2, then activates a function that traverses the interval distances. If the note selection is then held while Control Operator 10-2 is alternately deflected and released, Forward or Reverse Continuation Data is synthesized, which may be used to activate additional continuation functions. Note deselection then deactivates Forward or Reverse Attack Latch, whichever was previously activated. Release Data thus synthesized may select interval data for a subsequent control rate and/or audio rate function, or used to activate an additional function.

It will be appreciated that the functions of Reverse Continuation Sub-Envelope 440 and associated latches may also be implemented in software using any of the same methods previously disclosed for Channel Envelope 100-1 and Line Envelope 110 Attack Latches. The interaction rate signals synthesized by Line Sub-Envelope 130-1 is sent to Line Notes 170-1 and Line Control 180-1 for use in Phrase Synthesis 70.

Description of Channel Sub-Envelope 120-1-1

Figure 26:
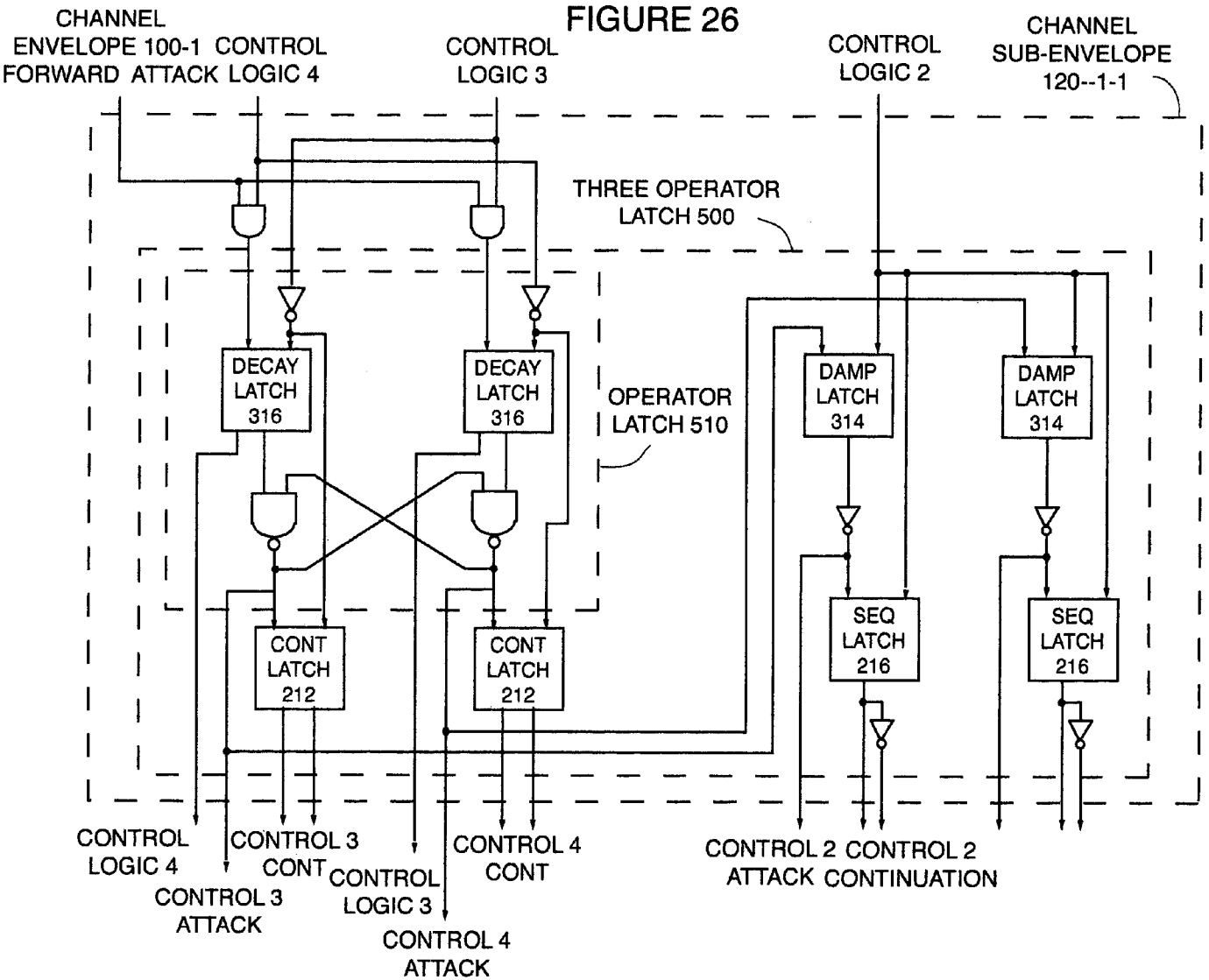
FIG. 26 shows a diagram for a Channel Sub-Envelope.

FIG. 26 shows a diagram for Channel Sub-Envelope 120-1-1. Three Operator Latch 500 is an example of a latch that requires the use of three different operators to fully activate. It contains Operator Latch 510, which is really an embodiment of an Operator Envelope as discussed previously for an Operator Mode. Here it is implemented as a Sub-Envelope.

Channel Envelope 100-1 Forward Attack Data enables Operator Latch 510. If Control Operator 4 is deflected while Control Operator 3 is released, Control Logic 4 output is activated. If Control Operator 4 deflection is followed by Control Operator 3 deflection, Control 3 Attack Data is sent. Further Control Operator 3 release and deflection sends Control 3 Continuation Data. Control Operator 4 release deactivates Control 3 Attack and also sends Control Logic 4 False data. The other side of this latch works exactly the same way, except that the roles of the Control Operators are reversed.

An example of how this embodiment can be used is to activate a typical series of pitch bend signals, with useful variations. For example if Channel Envelope 100-1 Attack Data activates a note, then Control Logic 4 activates a pitch bend, Control 3 Attack may activate a vibrato simulation function including a simulated biasing gesture. Further manipulation of Control Operator 3 may vary parameters of the vibrato function using Control 3 Continuation Data. Release of Control Operator 4 releases both the initial pitch bend, and deactivates the vibrato with accompanying release of the biasing gesture. Similarly if Control Operator 3 is activated first after activation of a note with Channel Envelope 100-1, a different pitch bend gesture can be activated, then followed by a trill simulation function activated by subsequent deflection of Control Operator 4, also with a simulated biasing gesture, and maybe with trill repetition rate variable by further manipulation of Control Operator 4. As above, release of Control Operator 3 deactivates the original pitch bend gesture as well as the trill function and biasing gesture.

If Control Operator 2 is deflected following activation of Control 3 Attack Data above, Control 2 Attack Data is activated followed by Control 2 Continuation Data. These can be used to add further simulated gestures, such as a leap followed by retracement, or additional audio signals or sequences. Similarly a separate Control 2 Attack Data is activated after the Control 4 Attack, making it possible to vary the simulated gesture sequence initiated by Control 4 Attack differently from that initiated by Control 3 Attack. Thus a few operators can be used to navigate a variety of gesture pathways controlled by latch hierarchies.

It will be appreciated that the functions of Sub-Envelope 120-1-1 may also be implemented in software using any of the same methods previously disclosed for Channel Envelope 100-1 and Line Envelope 110 Attack Latches. The interaction rate signal synthesized by Channel Sub-Envelope 120-1-1 is sent to Channel Notes 150-1 and Channel Control 160-1 for use in Phrase Synthesis 70.

An implementation or variation of the above Sub-Envelope can also be used as the interactive control envelope for an Operator Mode. For example, an interesting performance mode could be implemented in which deflection of one operator activates a note and also selects a Forward Attack Latch. Deflection of a second operator activates the Forward Attack Latch. Subsequent operator deflections synthesize Continuation Data that may activate control rate signals that simulate portamento pitch glides, maybe according to intervals determined by note selections. There may be no initial note selection if deflecting the first operator activates a predetermined audio rate signal. This is similar to a one-stringed bowed Chinese instrument, called a Zheng. Melodies are played by gliding one note to another along a fretboard. Four such Operator Envelopes could simulate the four strings of a violin, for which bowing a string with no note selection activates a note at a base pitch for the string. Each such "string" could also be assigned to a keyboard split zone, within which further note selections alter the pitch as described above.

In another embodiment for an Operator Envelope, four or more control operators could each select initial starting pitches and also activate a simulated picking gesture as for example a slide guitar. Each operator also selects or activates a separate Forward and/or Reverse Attack Latch, each of which selects a separate set of Continuation Latches, that may be activated by each of the other operators, and so on. Thus a large number of possible pathways for performing attack and continuation gestures, only by deflecting operators, could be provided. Additional interaction rate event data, such as New Operator/Same Operator and First Deflected/Last Released, could be useful for such an embodiment. Thus additional data generated by Logic Data 40, labeled D' and D" is shown in FIG. 2.

Signal Generation Functions

Figure 27:
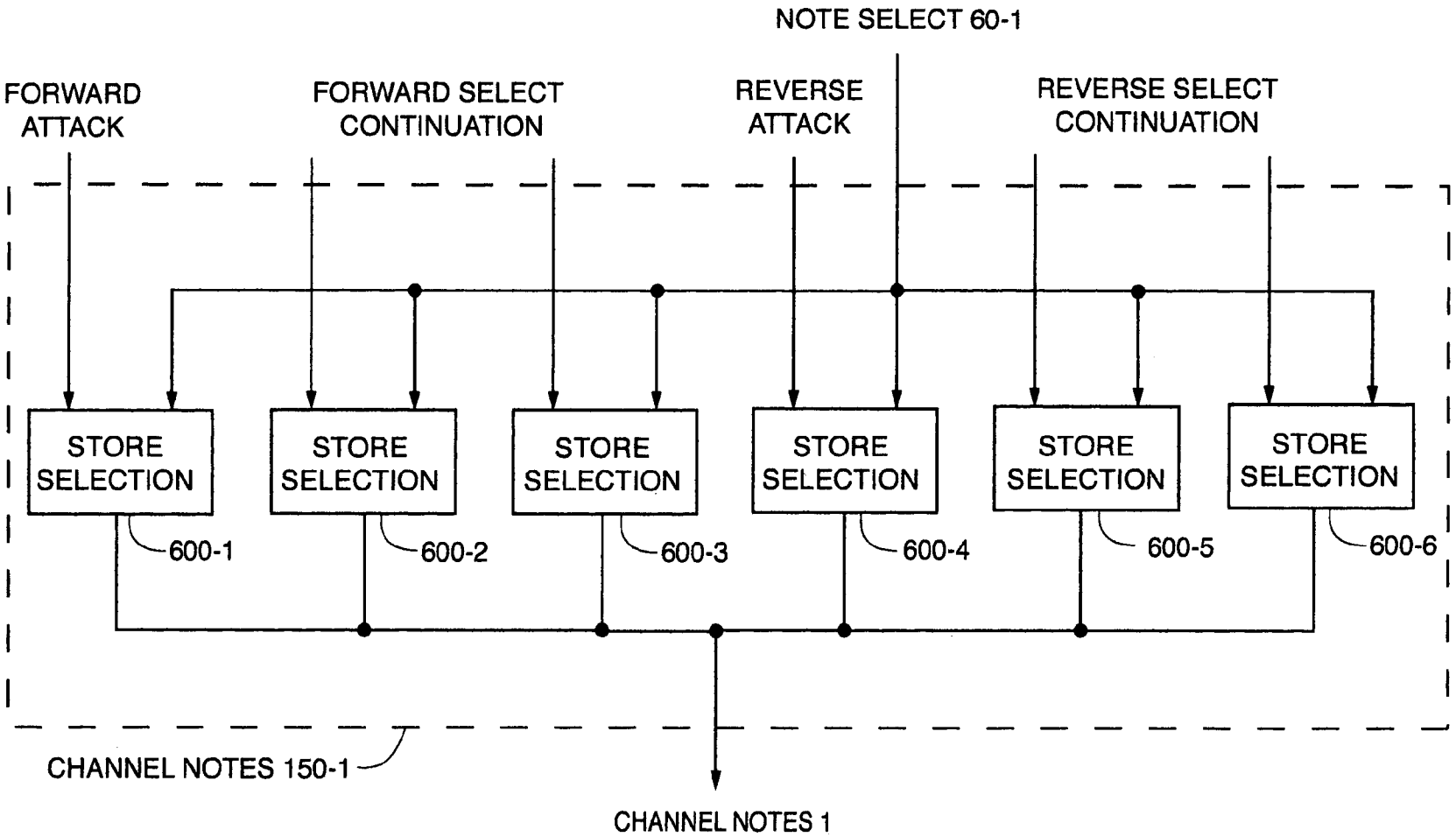
FIG. 27 shows the note selection storage and activation for the Channel Envelope.

FIG. 27 shows an implementation for Channel Notes 150-1. Store Selection 600-1-2-3-4-5-6 store data to be used to activate audio rate signals. As depicted, they store pitch data, such as MIDI note numbers. Other data, such as MIDI velocity data, channelization data, or data used to initialize audio parameters may be stored for use in activating an audio signal. Data such as MIDI note-on messages are generated by Channel Notes 150-1 and sent to Multichannel Audio Generator 80.

Only Six Store Selection functions are shown, although more inputs are depicted for Channel Notes 150-1. Of note are two Store Selection functions for Forward Select Continuation. These may separately generate MIDI note-on and note-off data. It will be appreciated that more such note activation functions could be employed, or as few as one. That is, interactive control envelope data may only be used to activate control rate signals that modulate a single audio signal per channel.

As previously disclosed, physical modeling or other kinds of audio signal generators may be activated by continuous control rate signals, rather than by discrete data events. In such an embodiment, Channel Notes 150-1 isn't required. However two versions of Channel Control 160-1 may be provided, one for generating continuous control rate signals that activate audio signals, and one for generating continuous control rate signals that modulate activated audio signals. It will be appreciated that functions available for generating audio signals may generate audio signals that play once and stop. Or generated audio signals may loop for a period of time, or continuously until deactivation data is received. It will be appreciated that audio signals may also be activated sequentially by data output automatically according to a score representation of notes, such as a MIDI sequence, initiated responsive to note activation data from interactive control envelopes, and variable responsive to note selections and/or manipulation of control operators.

Although there are only sixteen channels in the MIDI specification, various schemes have been devised by manufacturers to allow a virtually unlimited number of channels to be synchronized. So the present invention could be implemented using conventional MIDI synthesizers. Alternatively, the present invention could be implemented in a proprietary system for which a matrix of audio signal generators are available. In the pictured embodiment, a twelve by four matrix would be appropriate—six audio signal generators for each channel of the Channel and Line Envelopes.

Figure 28:
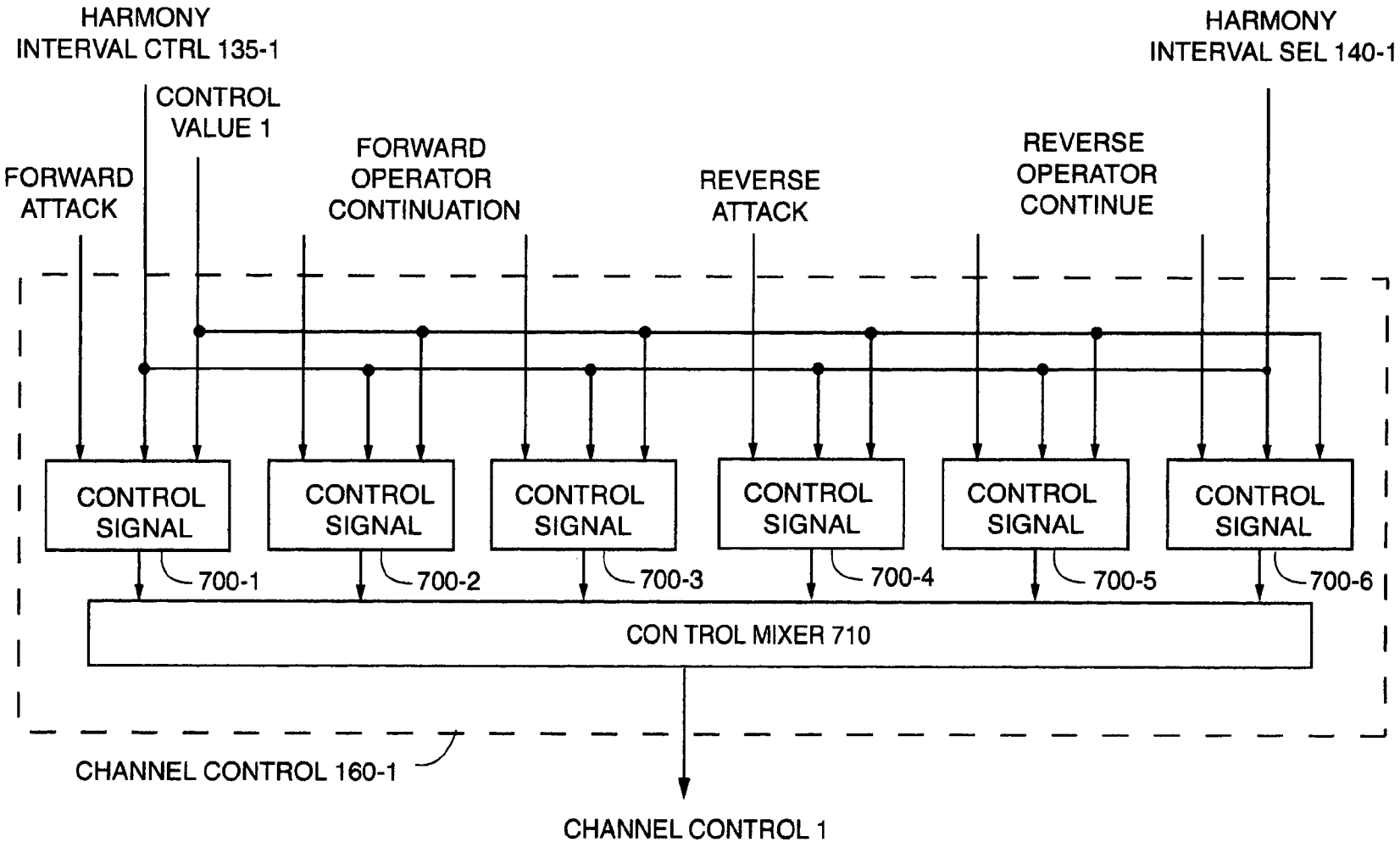
FIG. 28 shows the control signal select and generation for the Channel Envelope.

FIG. 28 shows an implementation for Channel Control 160-1. Control Signals 700-1-2-3-4-5-6 are used to generate continuous control rate signals. As depicted, they may use parameter data from Harmony-Interval 135-1 or Harmony-Interval 140-1, such as interval relationships calculated by subtracting successive MIDI note numbers. They may also use continuous data from Control Operator 10-1 to activate and modify control rate signals. Data output from 700-1-2-3-4-5-6 may include continuous control rate signals or discrete constants used to activate or modulate audio signals.

Continuous control rate data from Control Value 40 may be used directly as control rate signals, or as index values for tables containing gesture simulation data. Data output by the tables may be used directly, or interpolated and further processed. Control rate data from Control Value 40 may also be used directly as modulation data for control rate signals generated by Control Value 40, as in the gesture synthesis methods previously disclosed in the referenced U.S. Pat. No. 6,066,794 and Reissue Patent RE37,654.

It will be appreciated that continuous audio or control rate signals may include repeating functions such as simulated trills or vibrato. Activated control rate signals may also include a series of line segments that are activated automatically from one point to the next, with parameters determined by note selections and/or control operator activation. When activated by synthesized interaction rate signals from Channel Envelope 100-1 or Channel Sub-Envelope 120-1-1, Control Signal 700-1-2-3-4-5-6 generate channelized data such as MIDI controller messages, that are merged in Control Mixer 710 and sent to Multichannel Audio Generator 80.

Control Mixer 710 may represent summation of control rate signals. Alternatively, data from Control Signal 700-1-2-3-4-5-6 may be interpolation data representing change over time, that is accumulated by Control Mixer 710. Control Mixer 710 may also include an initialization input that sets the initial input and output values to zero or some other offset value. The current output value of Control Mixer 710 may also be available to Harmony-Interval 135-1 and Harmony-Interval 140-1 for use determining further interval data or other parameter data used to initialize or modulate audio or control rate signal generation functions or sequences.

Only Six Control Signal functions are shown, although more inputs are depicted for Channel Control 160-1. Those depicted receive inputs from Channel Envelope 100-1. It will be appreciated that more could be employed, or none. In this case all interactive control envelope data may be used to activate audio signals.

Figure 29:
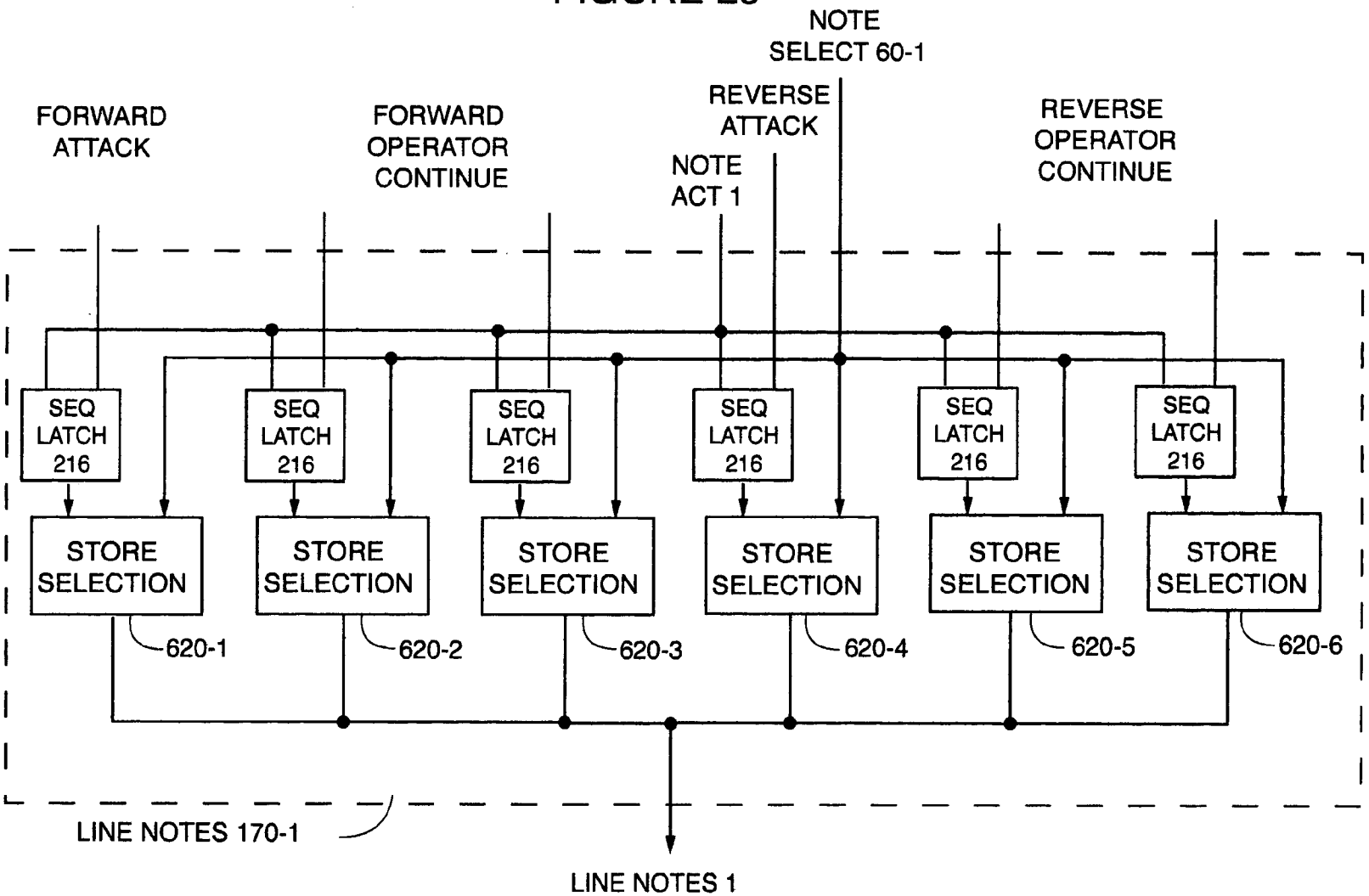
FIG. 29 shows the note selection storage and activation for the Line Envelope.
Figure 30:
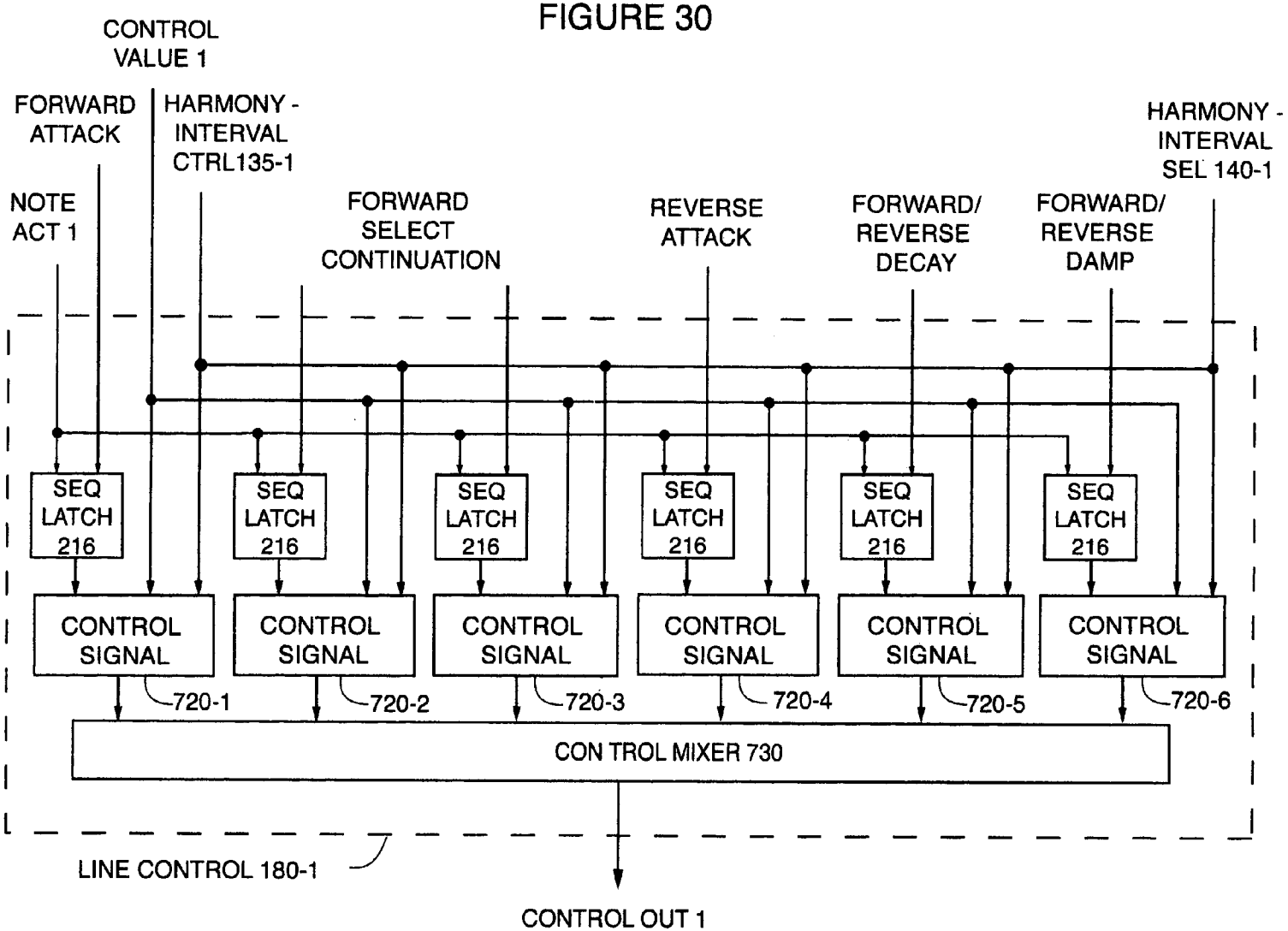
FIG. 30 shows the control signal select and generation for the Line Envelope.

FIGS. 29 and 30 depict Line Notes 170-1 and Line Control 180-1. These are very much the same as Channel Notes 150-1 and Channel Control 160-1. The only depicted difference is that since a single Line Envelope 110 and Line Sub-Envelope 130-1 are used to activate all four channels, a means of determining which channels are actived is preferably provided, to avoid sending spurious data to MultiChannel Audio Generator 80. Therefore, a Sequential Latch 216 is used to enable each Store Selection of Line Notes 170-1 and Control Signal of Line Control 180-1. The Sequential Latch 216's are selected by Note Act 1 data and activated by interaction rate signal data. In another embodiment, a separate Line Envelope and Line Sub-Envelope may be required for each channel. In this case, Line Notes 170-1 and Line Control 180-1 may be identical in function to Channel Notes 150-1 and Channel Control 160-1.

Only six control functions are depicted in Line Control 180-1. It will be appreciated that these only represent a fraction of control functions it is possible to implement to be activated responsive to the specified interactive control data. These ones are chosen to highlight certain features. Two control signal functions are depicted to be activated by Forward Select Continuation Data. This is to illustrate that separate functions may be implemented for selection continuation data and deselection continuation data. Also depicted are one control signal function each for both Forward and Reverse Decay Data and for both Forward and Reverse Damp Data. This illustrates that it is possible to implement a single control rate signal generation function that may be activated responsive to more than one interaction rate data. Parameters of such a function, such as data from Harmony-Interval 135-1 or Harmony-Interval 140-1 may be varied however. The depicted arrangement also illustrates that Decay and Damp Latches are specified to only be activated once under hierarchical control of Attack Latches, while Continuation Latches may typically be activated and deactivated repeatedly.

Additional Latch Circuits

Figure 31:
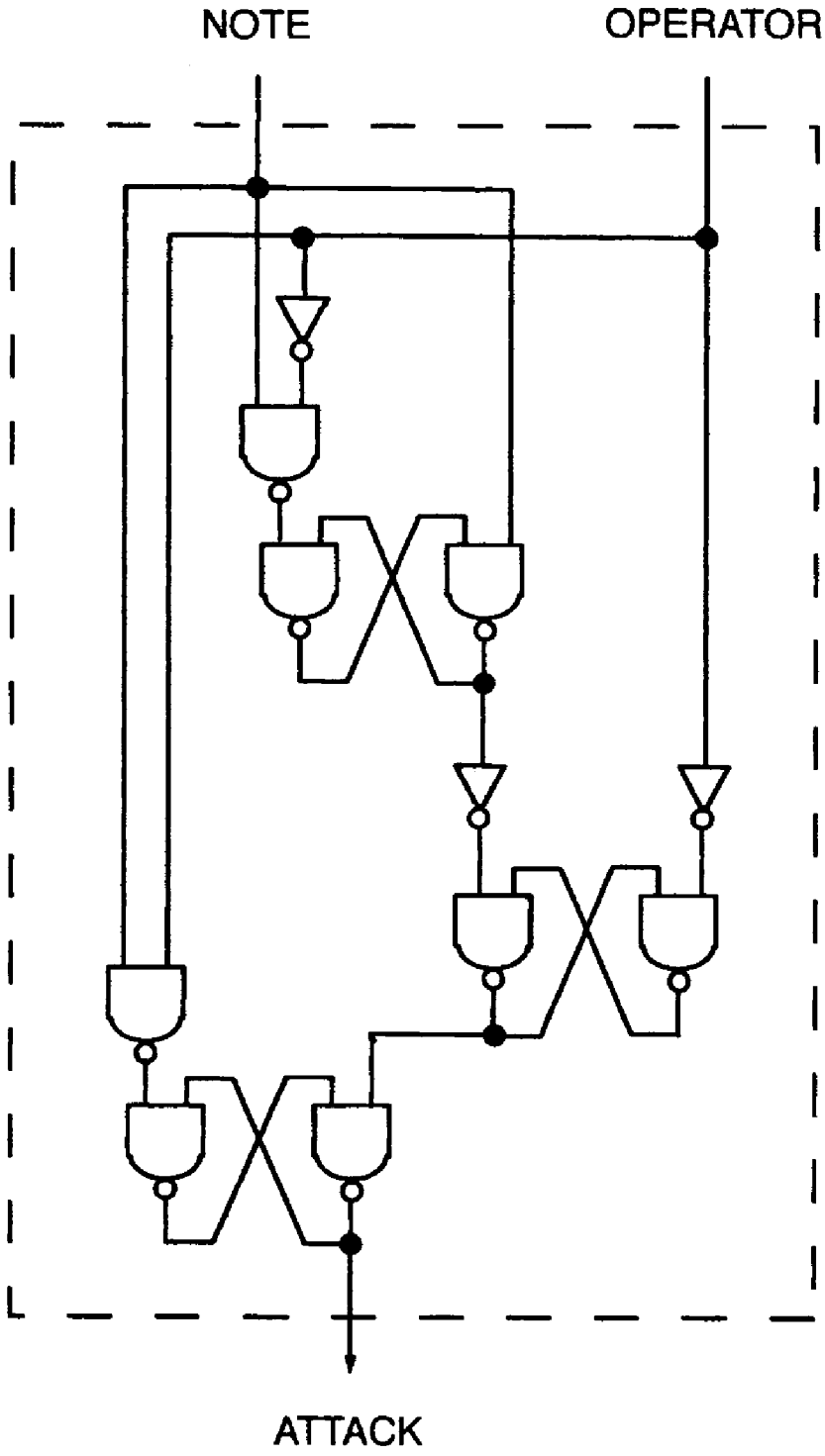
FIG. 31 shows a circuit diagram for an alternative Attack Latch.
Figure 32:
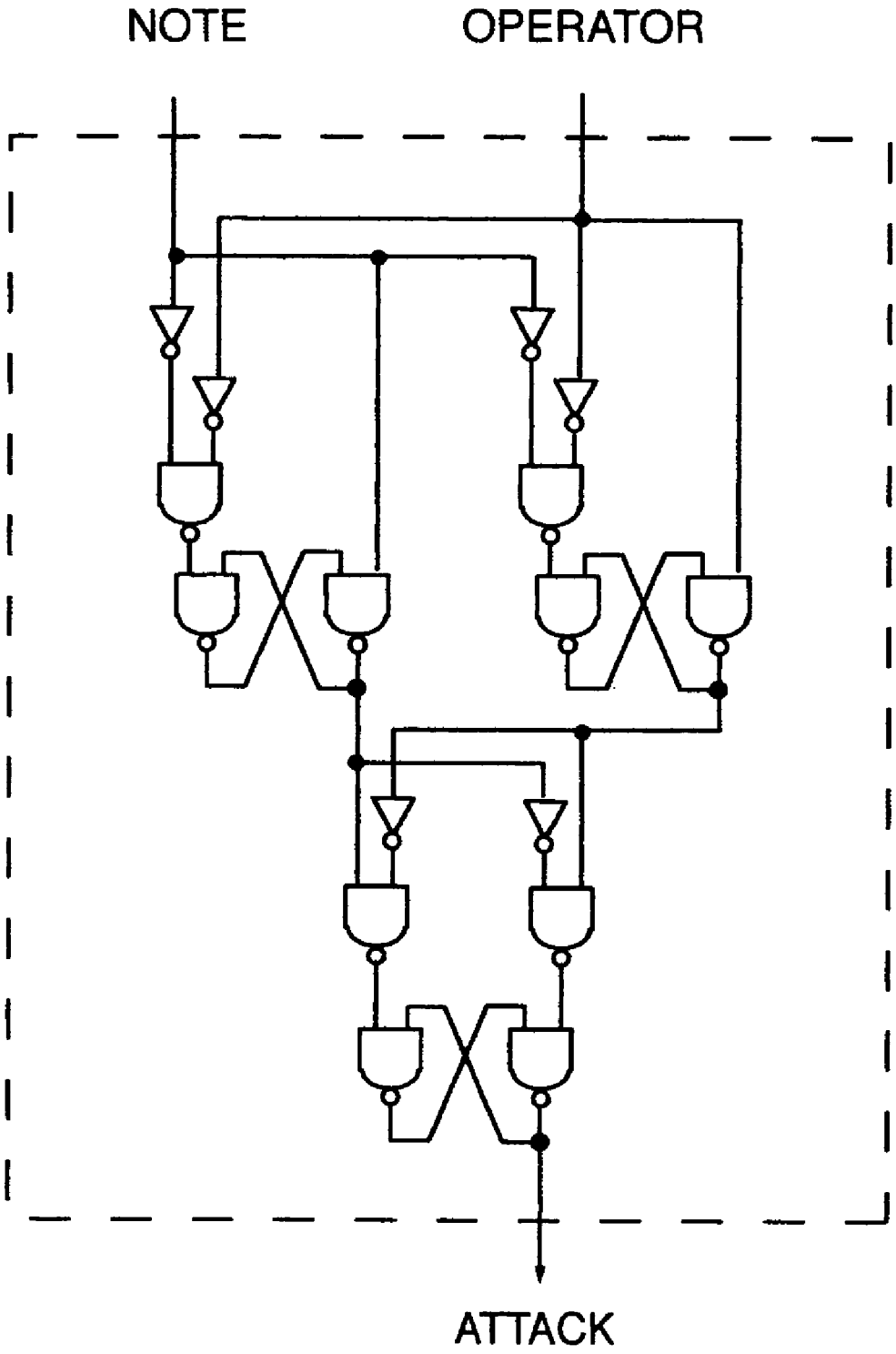
FIG. 32 shows a circuit diagram for an alternative Channel Latch.

It will be appreciated that other performance modes than those described above may be implemented. An alternative Attack Latch may be activated by one operator and deactivated by a different operator. A circuit that can be used to implement such an Attack Latch is shown in FIG. 31. Activation and deactivation of this latch occurs responsive to deflection and subsequent release of the operators controlling the first and second input respectively. Another circuit that is also activated by deflection and release of one operator, and deactivated by deflection and release of another is shown in FIG. 32. For this circuit, the change of state occurs on deflection rather than release. Interestingly, this circuit is actually another variation of a Channel Latch, and may also be used in an embodiment of a Channel Envelope.

More complex latches than those previously described may require a longer sequence of inputs to activate or deactivate. For example, an alternative Fingered Envelope may be implemented using a latch circuit shown in FIG. 33. This circuit is activated by first releasing a control operator, then selecting a note, and then subsequently deselecting the note. Thus selection may activate an audio signal and deselection latch the activation, so the signal stays activated. Then deflection of a control operator deactivates the latch and the audio signal.

The above illustrates that besides activation of audio and control rate signals, Attack Data synthesized by an interactive control envelope may be used to control the deactivation of signals. For example, in a variation of a Line Envelope, notes are selected and activated as would be the case when playing a MIDI keyboard. Then deflection of a control operator latches on previously activated notes, by latching off the deactivation function which may be implemented as a separate function from the audio signal activation function, as discussed previously. So activation of the Attack Latch latches the signal activation. A control rate signal generation function may be activated simultaneously. Once the deactivation function is latched off so the audio signal continues to sound, continuation functions can be activated with further note selections and deselections, and/or operator deflections and releases.

Figure 34:
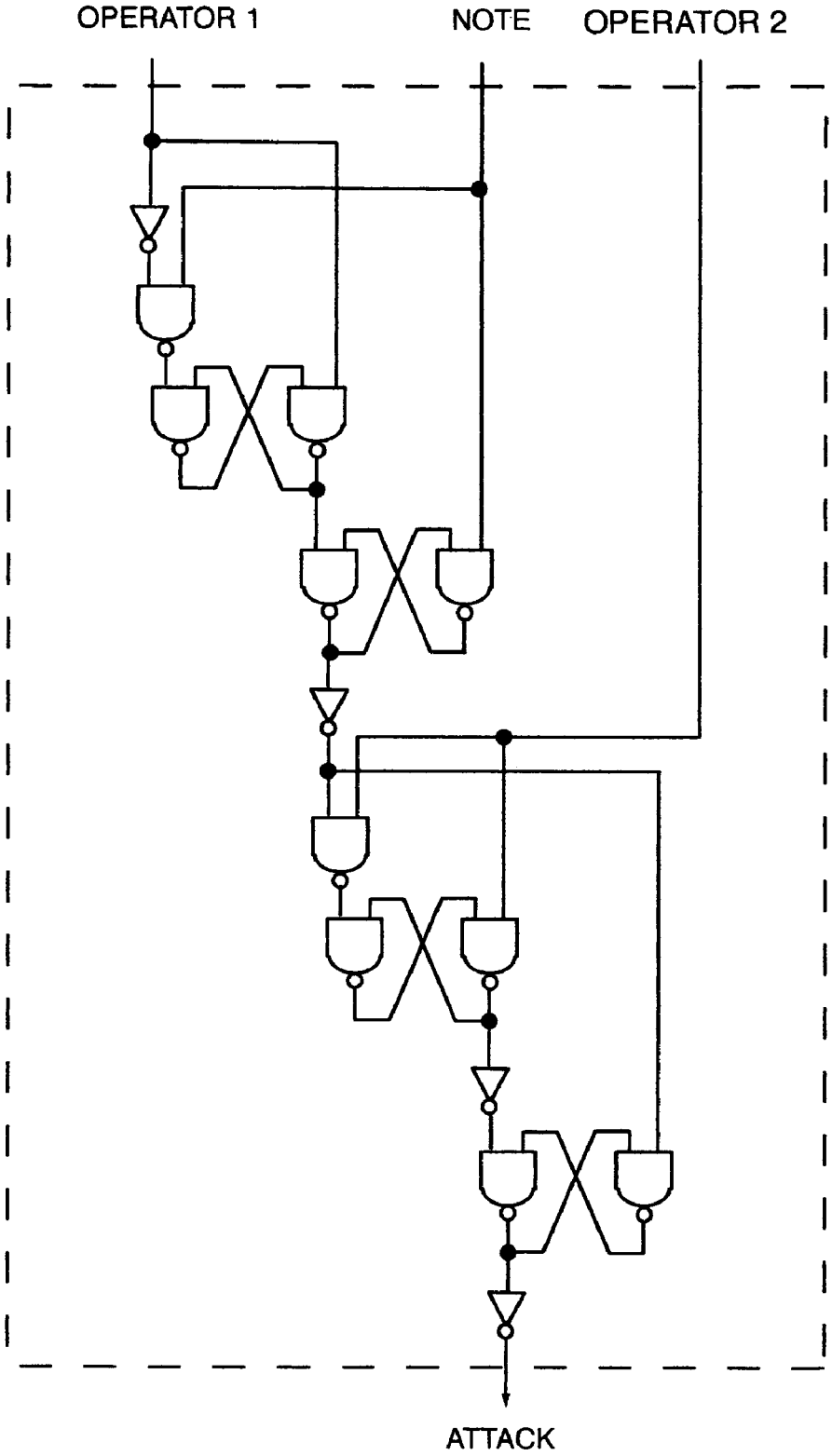
FIG. 34 shows a circuit diagram for a three operator Attack Latch.

In another possible variation of a Line Envelope Attack Latch, a note selection followed by operator deflection would activate the Attack Latch and then deflection of a second operator deactivate the Attack Latch, or deactivate the signals activated by the Attack Latch. A latch circuit that can be used to implement this arrangement is shown in FIG. 34. This is an embodiment of a three operator latch, different from the one previously described for Channel Sub-Envelope 120-1-1.

It will be appreciated that the Forward or Reverse side of Channel Envelope 100-1 and Line Envelope 110 can be combined into one envelope. Other previously discussed Attack Latches or some additional ones to be discussed presently, can be substituted for one side or the other of an interactive control envelope. Or an interactive control envelope may include only one Forward or Reverse Attack Latch.

It will further be appreciated that interactive control envelopes may be implemented for which the Attack Data of a synthesized interaction rate signal is activated by one latch, while the Release Data is activated by a second. That is, an interactive control envelope may include both an Attack Latch and a Release Latch. It may be advantageous to provide a means of deactivating the functions activated by an Attack Latch, while the other functions of an interactive control envelope remain enabled.

Figure 35:
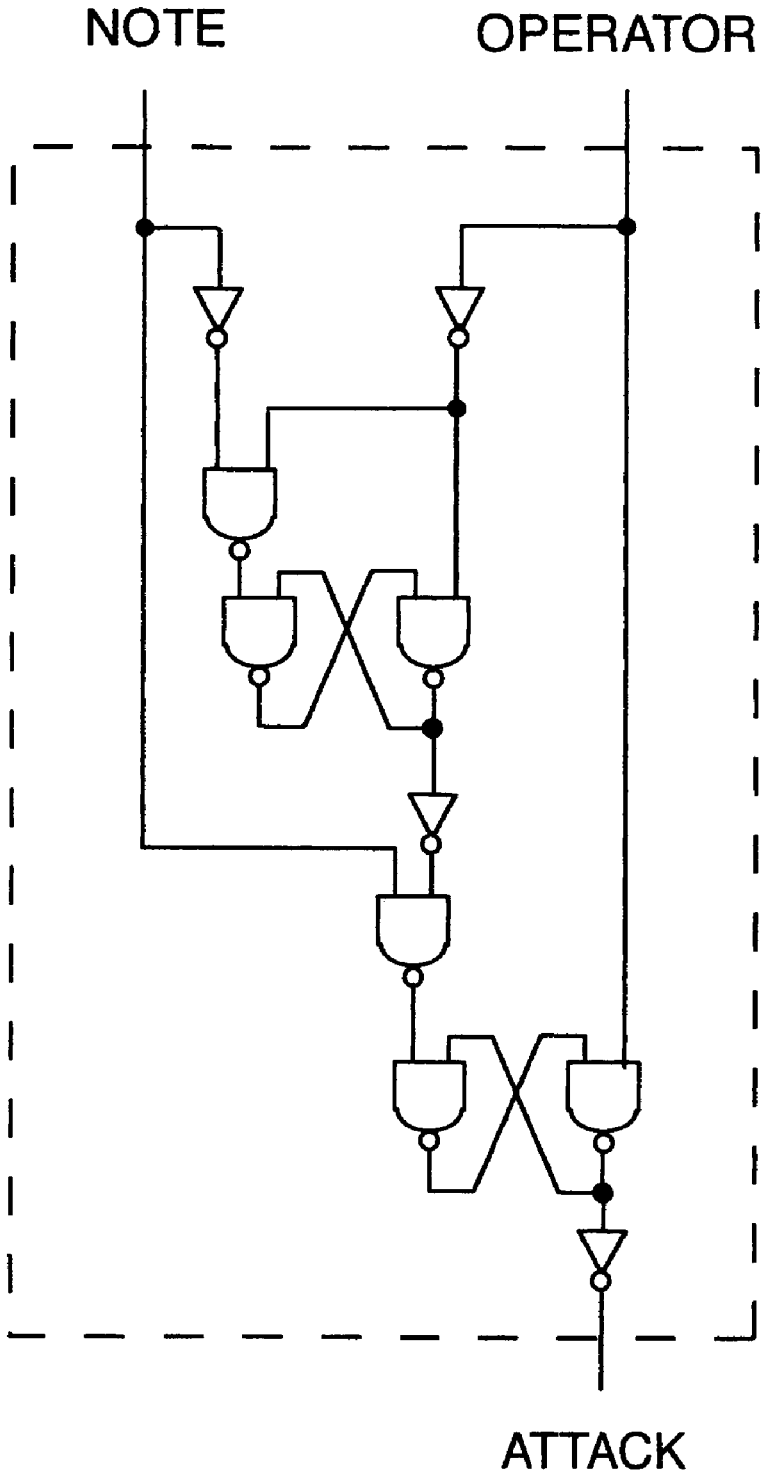
FIG. 35 shows a circuit diagram for an alternative Line Latch.

The latch circuit shown in FIG. 35 can be used as an Attack Latch in a variation of a Line Envelope that includes both an Attack Latch and a Release Latch. Selecting a note then deflecting a control operator activates the Attack Latch and activates associated attack functions. Then releasing the operator deactivates the Attack Latch and also the attack functions. However, it is desirable for decay, and continuation latches to be enabled by activation of the Attack Latch, and remain enabled when it is deactivated, until activation of the Release Latch. This requires another "enabling latch" that is activated by a sequence of deactivation of a Release Latch followed by activation of the Attack Latch. Activation of the Release Latch then deactivates this enabling latch. Either Damp Latch 314 or Decay Latch 316 may be implemented to function as such an enabling latch.

Figure 33:
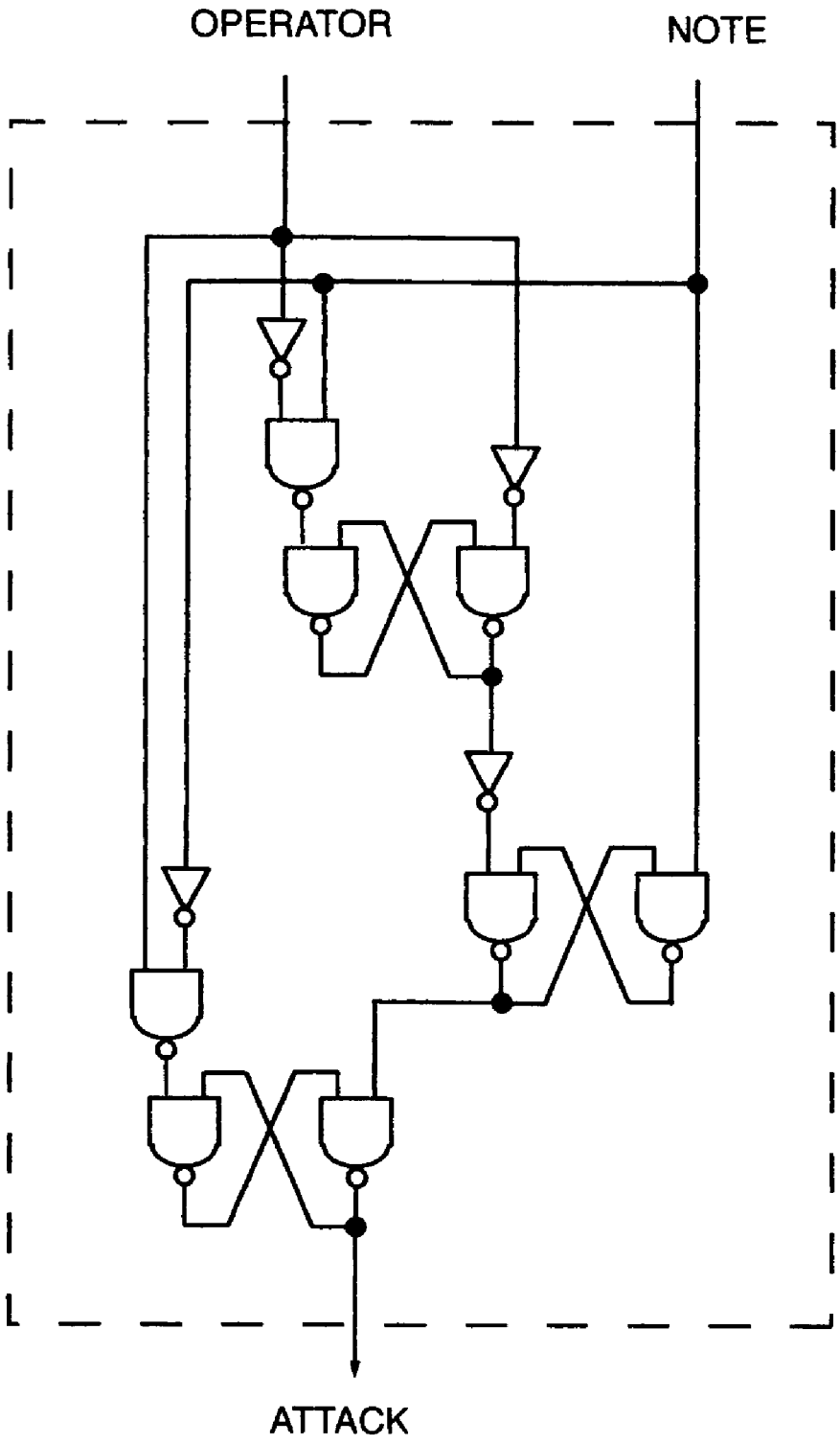
FIG. 33 shows a circuit diagram for another alternative Attack Latch.

The latch circuit shown in FIG. 33 can be used as a possible Release Latch in the above implementation if the roles of note selection and operator deflection are reversed from those depicted. Thus the latch is activated by releasing the note, then deflecting and subsequently releasing the operator. Or a minor variation of Line Latch 311 shown in FIG. 21A, previously disclosed as an embodiment of an Attack Latch for Line Envelope 110, can be used to implement a Release Latch. By inverting the note input of this circuit, the resulting Release Latch is activated by releasing the operator while a note is held, then deselecting the note, then deflecting the operator again. An embodiment of a Channel Envelope that has both an Attack Latch and a Release Latch can also be implemented using previously disclosed latch circuits. For example the latch shown in FIG. 35 and discussed above may be used as an Attack Latch in such a Channel Envelope if the roles of the note and operator are reversed, so the Attack Latch is activated by first deflecting the operator, then selecting a note. It is then deactivated by releasing the note. This Channel Envelope would also include an enabling latch as previously described, that is latched on responsive to Attack Data synthesized by the Attack Latch, until activation of a Release Latch. Such a Release Latch can be implemented using the circuit shown in FIG. 33 by reversing the roles of the input data, and inverting the note input. The resulting Release Latch is selected by holding a note, then deflecting and subsequently releasing the operator, and then activated by deselecting the note. It will be appreciated that additional embodiments of interactive control envelopes using both Attack Latches and Release Latches may be implemented using previously disclosed latch circuits, possibly with minor variations such as inverting inputs or outputs. It will further be appreciated that the interactive control envelopes described above, and possible other variations of them, may be implemented by program code equivalents, as previously described.

Additional Suggested Implementations

It will be appreciated that the disclosed Envelopes and Sub-Envelopes may be used to control additional functions from those depicted, such as the duration of audio signals. For example, a performance mode may be implemented so that each note is activated before the previous one is deactivated, according to synthesized interaction rate signals. This creates a kind of "legato" that is controlled responsive to an interaction rate signal.

Another type of phrase may be created with a single held note, once activated and latched on by a biasing gesture, by using interaction rate signals mapped to audio parameters to make subtle variations. More than one interactive control envelope may be used simultaneously, one to control amplitude, one to control pitch, and one more to control some aspect of timbre, for example. More than one interactive control envelope may also be used simultaneously to create layered phrases that are activated at different times in dovetail fashion by overlapping sequences of gestures. Similarly, note deselections may perform the same function in one interactive control envelope as note selections in another, allowing for alternating and overlapping effects. Likewise control operator deflection and release may activate alternating interaction rate signals via different interactive control envelopes, each controlling different aspects of the sound.

The disclosed interactive control envelopes, or modifications of them, may also be used to activate and deactivate layered audio signals simultaneously, as if played by an orchestra. Variations in harmonization and orchestration may be introduced, which may themselves form the Attack and Continuation segments of a phrase. These kinds of variations may include doubling of tones, expansion, dovetailing instrumentation, transposition or inversion or chords, variations in accents and duration of notes, or addition of ornaments or other features derived from input selections, under control of synthesized interaction rate signals.

The disclosed Continuation Latches, Decay Latches and Damp Latches may themselves be used as Attack Latches to implement interactive control envelopes. As such these circuits may be expanded to become Sub-Envelopes. Or they may be replaced by Sub-Envelopes.

For example a Channel Sub-Envelope might include a Forward Attack Latch activated when Control Operator 10-1 is deflected, after selection by Forward Attack Data from Channel Envelope 110-1. The Channel Sub-Envelope Reverse Attack Latch may similarly be activated by release of Control Operator 10-1, after being selected by the Reverse Attack Data from Channel Envelope 100-1. It will be appreciated that these kinds of variations may also be applied to the other interactive control envelopes disclosed in the present invention, to create a variety of alternative performance modes.

The element of time may also be introduced. For example, sending a logical True followed by a logical False is the equivalent of generating an interaction rate clock pulse. Such a pulse could be used as a time window specified as a selection, within which receipt of other data activates a latch. Or the pulse may be specified as interaction rate data that itself selects and activates a latch. Such a time window or interaction rate pulse may be generated by either detecting or generating velocity data of a continuous control operator. For example, transition from zero to positive velocity is pulse on, while transition back to zero velocity is pulse off. Motion in the reverse direction may subsequently be represented as a negative pulse. Or an interaction rate pulse may be generated by a timing function that generates a pulse off responsive to a pulse on after a time delay.

Or a timing function can be implemented to delay data used activate latches or functions.

SUMMARY AND CONCLUSION

The present invention provides an Interactive Performance Interface for an electronic audio system, that includes at least one performance mode. Within a performance mode, a musician-user can create phrases by selecting and activating a variety of control rate and audio rate signals, according to interaction rate signals synthesized by interactive control envelopes. Performance modes, envelopes, control rate signals, audio signals and both audio rate and control rate sequences may be selected and activated using a limited number of user controls, which change function according to a hierarchy of conditional latches.

The above description should not be construed as limiting the scope of the invention. Other possible performance modes implemented using interactive control envelopes, selected and activated by sequences of user actions, may be recognized by those skilled in the art, including embodiments and combinations of elements that are natural variations of the present disclosure. The invention itself may be embodied in a variety of physical constructions, including, but not limited to, an outboard accessory for use with music synthesizers, or a stand alone controller that includes hardware operators, for use with tone modules or computer music systems. It may also be implemented as a software upgrade for existing synthesizers, or as personal computer based synthesis software. Or the disclosed system may be integrated into an all-in-one music workstation. The interface layer itself may be built into a computer chip, or other electronic device, or may be stored on magnetic, optical, or other machine readable memory storage medium for use in a host system. It may also be transferred as an electrical signal over a computer or other network system, for use by a client of the network. For any of the disclosed embodiments, the specified interaction rate data and control rate data to be input to the interactive control interface could be pre-recorded in a time-ordered format and played back automatically.

It will be appreciated that in addition to, or instead of MIDI note numbers, pitch bend and MIDI controller data, MIDI Sysex data could be synthesized to directly modify the programming arguments of a MIDI synthesizer. For example, layered elements of a MIDI synthesizer sound program, such as the four partials of a Roland D-50 patch, could be independently controlled with interactive control envelopes. It will further be appreciated that the present invention is not limited to the manipulation of musical data as set forth in the MIDI specification. Other data protocols representing audio parameters, as described in the present invention, may be utilized. For example, the pitch of a note may not be specified as in the MIDI specification using a note number plus a pitch bend increment. Alternatively, one number may represent an initial pitch value for a note, and pitch bend type modifications to the note performed by incrementing or decrementing the initial number. Or non-musical data may be manipulated as here described, and used within an audio system. In general, modifications and variations may be made to the disclosed embodiments without departing from the subject and spirit of the invention as defined by the following claims.

What is claimed is:

1. An interactive performance interface for use with an audio system that generates at least one audio signal, said interactive performance interface coupleable to a first and second user-input control device, and including at least one performance mode comprising;

interaction rate data generation functions for generating first interaction rate control data responsive to user operation of said first user-input control device and for generating second interaction rate control data responsive to said second user-input control device, and at least one interactive control envelope means for synthesizing an interaction rate signal including interaction rate attack data and interaction rate release data, said interactive control envelope means including at least a first latch for synthesizing at least one of, (i) a first logic state of said interaction rate attack data upon activation of said latch responsive to a specified first logic state of said second interaction rate control data, always conditional upon prior selection of said latch responsive to a specified first logic state of said first interaction rate control data, wherein prior to said activation, logic state of said interaction rate attack data unconditionally persists responsive to said selection, and whereupon said activation, said first logic state of said interaction rate attack data unconditionally persists responsive to a change of logic state of at least one of said first and second interaction rate control data, (ii) a first logic state of said interaction rate release data upon deactivation of said latch responsive to a specified first logic state of said second interaction rate control data, always conditional upon prior deselection of said latch responsive to a specified first logic state of said first interaction rate control data, wherein prior to said deactivation, logic state of said interaction rate release data unconditionally persists responsive to said deselection, and whereupon said deactivation, said first logic state of said interaction rate release data unconditionally persists responsive to a change of logic state of at least one of said first and second interaction rate control data, and (iii) a first logic state of said interaction rate release data upon activation of said latch responsive to a specified first logic state of said second interaction rate control data, always conditional upon prior selection of said latch responsive to a specified first logic state of said first interaction rate control data, wherein prior to said activation, logic state of said interaction rate attack data unconditionally persists responsive to said selection, and whereupon said activation, said first logic state of said interaction rate release data unconditionally persists responsive to a change of logic state of at least one of said first and second interaction rate control data, wherein said interactive control envelope means synthesizes said interaction rate signal responsive to said interaction rate control data such that said audio signal at least initiates a phrase responsive to said interactive control envelope, and such that said phrase may be effected by user operation of said first and second user-input control devices.

2. The interactive performance interface of claim 1, wherein said interaction rate data generation functions include a function for counting present first logic states of at least said first and second interaction rate control data;

wherein said function generates additional interaction rate control data consisting of, a first logic data generated responsive to a transition from a count of zero, to a count of a first specified number greater than zero, of said present first logic states, and a second logic state generated responsive to a transition from a count of a specified number, to a count of zero, of said present first logic states.

3. The interactive performance interface of claim 1, wherein said interaction rate data generation functions include a function for counting repeat changes from a first logic state to a second logic state of one of said first and second interactive rate control data, representing user operation of one of a corresponding said first and second control operators, and for resetting said count to zero, responsive to a change from a first logic state to a second logic state of the other of said first and second interaction rate control data, said reset representing a change of user operation from one to the other of said user-input control devices;

wherein said function for counting generates additional interaction rate control data consisting of, a first logic state generated responsive to a transition from a count of zero, to a count of a specified number, of said changes of logic state, and a second logic state generated responsive to said reset from a count greater than zero, to a count of zero, of said changes of logic state.

4. The interactive performance interface of claim 1, wherein said interactive control interface is implemented in at least one device selected from a group comprising (i) an outboard accessory for use with music synthesizers, (ii) a controller that includes hardware operators, (iii) an interface layer built into a computer chip, and (iv) a stand-alone music workstation.

5. The interactive performance interface of claim 1 wherein said interactive control envelope further includes at least a second latch for synthesizing interaction rate signal data upon activation of said second latch responsive to a specified logic state of interaction rate control data, always conditional upon prior selection of said second latch responsive to a specified logic state of at least one of (i) interaction rate attack data, (ii) interaction rate release data, and (iii) interaction rate continuation data;

wherein prior to said activation, logic state of said interaction rate signal data unconditionally persists responsive to said selection.

6. The interactive performance interface of claim 1, wherein said performance mode is includes a mode of operation selected from the group comprising (i) Line Mode, (ii) Channel Mode, (iii) Fingered Mode, and (iv) Operator Mode.

7. The interactive performance interface of claim 1 that includes data protocol compatibility selected from a group consisting of, (i) said first detection means inputs OSC compatible data, (ii) said interaction rate control data is OSC compatible, (iii) said interaction rate signal is OSC compatible, (iv) said electronic audio system is OSC compatible.

8. The interactive performance interface of claim 1 wherein said interactive control means enables user interaction to effect at least one element of said phrase selected from the group comprising (i) duration of notes, (ii) variations in accents of notes (iii) dovetailing of instrumentation, (iv) layered audio signals, (v) doubling of tones, (vi) orchestration, (vii) expansion of chords, (viii) transposition of chords, (ix) inversion of chords, and (x) ornamentation.

9. The interactive performance interface of claim 1, further including a harmony-interval means for generating at least one harmony-interval data selected from a group comprising (i) data that conforms to a harmonization scheme, (ii) calculated interval relationships, (iii) calculated deselection data, and (iv) data that maps to another parameter than pitch.

10. The interactive performance interface of claim 1 wherein said interactive control interface includes at least one control rate signal generation means for generating control rate signal data responsive to said interaction rate signal, wherein at least one parameter of said control rate signal is determined responsive to at least one of (i) a note selection, and (ii) control operator activation.

11. A method of providing an interactive performance interface for an electronic audio system, including at least one performance mode comprising the steps of:

(a) generating first interaction rate data responsive to user operation of a first user input-device (b) generating second interaction rate data responsive to user operation of a second user-input devices, (c) synthesizing an interaction rate signal, including interaction rate attack and release data generated responsive to activation and deactivation of a first latch, by steps including at least one selected from the group consisting of (i) synthesizing a first logic state of said interaction rate attack data, upon activation of said latch responsive to a specified first logic state of said second interaction rate control data, always conditional upon prior selection of said latch responsive to a specified first logic state of said first interaction rate control data, wherein prior to said activation, logic state of said interaction rate attack data unconditionally persists responsive to said selection, and whereupon said activation, said first logic state of said interaction rate attack data unconditionally persists responsive to a change of logic state of at least one of said first and second interaction rate control data, (ii) synthesizing a first logic state of said interaction rate release data, upon deactivation of said latch responsive to a specified first logic state of said second interaction rate control data, always conditional upon prior deselection of said latch responsive to a specified first logic state of said first interaction rate control data, wherein prior to said deactivation, logic state of said interaction rate release data unconditionally persists responsive to said deselection, and whereupon said deactivation, said first logic state of said interaction rate attack data unconditionally persists responsive to a change of logic state of at least one of said first and second interaction rate control data, and (iii) a first logic state of said interaction rate release data upon activation of said latch responsive to a specified first logic state of said second interaction rate control data, always conditional upon prior selection of said latch responsive to a specified first logic state of said first interaction rate control data, wherein prior to said activation, logic state of said interaction rate attack data unconditionally persists responsive to said selection, and whereupon said activation, said first logic state of said interaction rate release data unconditionally persists responsive to a change of logic state of at least one of said first and second interaction rate control data, (d) generating an audio signal at least initiating a phrase responsive to said interaction rate signal whereby said phrase may be effected responsive to said first and second user-input control devices.

12. The method of claim 11 further including the steps of, (a) counting present first logic states of at least said first and second interaction rate control data, (b) generating additional interaction rate control data consisting of, first logic data generated responsive to a transition from a count of zero, to a count of a specified number greater than zero, of said present first logic states, and second logic state generated responsive to a transition from a count of a specified number, to a count of zero, of said present first logic states.

13. The method of claim 11, further including the steps of, (a) counting repeat changes from a first logic state to a second logic state of one of said first and second interactive rate control data, representing repeat user operation of one of corresponding said first and second user input control operators, (b) resetting the count to zero, responsive to a change from a first logic state to a second logic state of the other of said first and second interaction rate control data, said reset representing a change of user operation from one to the other of said user-input control devices, and (c) generating additional interaction rate control data consisting of a first logic state responsive to a transition from a count of zero, to a count of a specified number, of said changes of logic state, and a second logic state responsive to said reset from a count greater than zero, to a count of zero, of said changes of logic state.

14. The method of claim 11, wherein said method is embodied in at least one device selected from the group comprising (i) an outboard accessory for use with music synthesizers, (ii) a controller that includes hardware operators, (iii) an interface layer built into a computer chip, and (iv) a stand-alone music workstation.

15. The method of claim 11, further including the step of generating interaction rate signal data upon activation of a second latch, responsive to a specified logic state of interaction rate control data, always conditional upon prior selection of said second latch responsive to a specified logic state of at least one of (i) interaction rate attack data, (ii) interaction rate release data, and (iii) interaction rate continuation data.

16. The method claim 11, wherein said performance mode includes a mode of operation selected from the group comprising (i) Line Mode, (ii) Channel Mode, (iii) Fingered Mode, and (iv) Operator Mode.

17. The method claim 11, wherein at least one of steps (a), (b), (c) and (d) include OSC compatible data.

18. The method of claim 11 that further includes the step of effecting at least one element of said phrase selected from the group comprising (i) duration of notes, (ii) variations in accents of notes (iii) dovetailing of instrumentation, (iv) layered audio signals, (v) doubling of tones, (vi) orchestration, (vii) expansion of chords, (viii) transposition of chords, (ix) inversion of chords, and (x) ornamentation.

19. The method of claim 11 that further includes the step generating harmony-interval data selected from the group comprising (i) data that conforms to a harmonization scheme, (ii) calculated interval relationships, (iii) calculated deselection data, and (iv) data that maps to another parameter than pitch.

20. The method of claim 11 that further includes the step of generating at least one control rate signal responsive to said interaction rate signal, wherein at least one parameter of said control rate signal is determined responsive to at least one of (i) a note selection, and (ii) user operation of a continuous control operator.

21. A processor readable medium whereon is stored a routine implementing a performance mode that upon execution by a processor will perform the following steps:

(a) generate first interaction rate data responsive to user operation of a first user input-device (b) generate second interaction rate data responsive to user operation of a second user-input devices, (c) synthesize an interaction rate signal, including interaction rate attack and release data generated responsive to activation and deactivation of a first latch, by steps including at least one selected from the group consisting of, (i) synthesizing a first logic state of said interaction rate attack data, upon activation of said latch responsive to a specified first logic state of said second interaction rate control data, always conditional upon prior selection of said latch responsive to a specified first logic state of said first interaction rate control data, wherein prior to said activation, logic state of said interaction rate attack data unconditionally persists responsive to said selection, and whereupon said activation, said first logic state of said interaction rate attack data unconditionally persists responsive to a change of logic state of at least one of said first and second interaction rate control data, (ii) synthesizing a first logic state of said interaction rate release data, upon deactivation of said latch responsive to a specified first logic state of said second interaction rate control data, always conditional upon prior deselection of said latch responsive to a specified first logic state of said first interaction rate control data, wherein prior to said deactivation, logic state of said interaction rate release data unconditionally persists responsive to said deselection, and whereupon said deactivation, said first logic state of said interaction rate attack data unconditionally persists responsive to a change of logic state of at least one of said first and second interaction rate control data, and (iii) a first logic state of said interaction rate release data upon activation of said latch responsive to a specified first logic state of said second interaction rate control data, always conditional upon prior selection of said latch responsive to a specified first logic state of said first interaction rate control data, wherein prior to said activation, logic state of said interaction rate attack data unconditionally persists responsive to said selection, and whereupon said activation, said first logic state of said interaction rate release data unconditionally persists responsive to a change of logic state of at least one of said first and second interaction rate control data, (d) generate an audio signal at least initiating a phrase responsive to said interaction rate signal whereby said phrase may be effected responsive to said first and second user-input control devices.

22. The processor readable medium of claim 21 whereon is stored said routine that upon execution by said processor will further perform the following steps:

(a) count present first logic states of at least said first and second interaction rate control data, (b) generate additional interaction rate control data consisting of, first logic data generated responsive to a transition from a count of zero, to a count of a specified number greater than zero, of said present first logic states, and second logic state generated responsive to a transition from a count of a specified number, to a count of zero, of said present first logic states.

23. The processor readable medium of claim 21 whereon is stored said routine that upon execution by said processor will further perform the following steps:

(a) count repeat changes from a first logic state to a second logic state of one of said first and second interactive rate control data, representing repeat user operation of one of corresponding said first and second user input control operators, (b) reset the count to zero, responsive to a change from a first logic state to a second logic state of the other of said first and second interaction rate control data, said reset representing a change of user operation from one to the other of said user-input control devices, and (c) generate additional interaction rate control data consisting of a first logic state responsive to a transition from a count of zero, to a count of first specified number, of said changes of logic state, and a second logic state responsive to said reset from a count greater than zero, to a count of zero, of said changes of logic state.

24. The processor readable medium of claim 21 wherein said routine executable by said processor is implemented as at least one of, (i) a software upgrade for existing synthesizers, and (ii) personal computer based synthesis software.

25. The processor readable medium of claim 21 whereon is stored said routine that upon execution by said processor will further perform the step of generating interaction rate signal data upon activation of a second latch, responsive to a specified logic state of interaction rate control data, always conditional upon prior selection of said second latch responsive to a specified logic state of at least one of (i) interaction rate attack data, (ii) interaction rate release data, and (iii) interaction rate continuation data.

26. The processor readable medium of claim 21, whereon is stored said routine wherein said implemented performance mode includes a mode of operation selected from the group comprising (i) Line Mode, (ii) Channel Mode, (iii) Fingered Mode, and (iv) Operator Mode.

27. The processor readable medium of claim 21 whereon is stored said routine that upon execution by said processor will perform at least one of steps (a), (b), (c) and (d) to include OSC compatible data.

28. The processor readable medium of claim 21 whereon is stored said routine that upon execution by said processor will further perform the step of effecting at least one element of said phrase selected from the group comprising (i) duration of notes, (ii) variations in accents of notes (iii) dovetailing of instrumentation, (iv) layered audio signals, (v) doubling of tones, (vi) orchestration, (vii) expansion of chords, (viii) transposition of chords, (ix) inversion of chords, and (x) ornamentation.

29. The processor readable medium of claim 21 whereon is stored said routine that upon execution by said processor will further perform the step of generating harmony-interval data selected from the group comprising (i) data that conforms to a harmonization scheme, (ii) calculated interval relationships, (iii) calculated deselection data, and (iv) data that maps to another parameter than pitch.

30. The processor readable medium of claim 21 whereupon is stored said routine that upon execution by said processor will further perform the step of generating at least one control rate signal responsive to said interaction rate signal, wherein at least one parameter of said control rate signal is determined responsive to at least one of (i) a note selection, and (ii) user operation of a continuous control operator.

* * * * *